US010549554B2

(12) United States Patent
Kurata et al.

(10) Patent No.: US 10,549,554 B2
(45) Date of Patent: Feb. 4, 2020

(54) PRINTING APPARATUS AND PLATEN

(71) Applicant: CANON KABUSHIKI KAISHA, Tokyo (JP)

(72) Inventors: Tetsuji Kurata, Yokohama (JP); Seiji Ogasawara, Machida (JP); Masakazu Tsukuda, Yokohama (JP); Takahide Onuma, Kawasaki (JP); Yasunori Saito, Yokohama (JP); Arihito Miyakoshi, Tokyo (JP); Masahiko Kubota, Tokyo (JP); Yusuke Imahashi, Kawasaki (JP); Nobuhito Yamaguchi, Inagi (JP); Hiroshi Arimizu, Kawasaki (JP); Yoshinori Itoh, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/057,011

(22) Filed: Aug. 7, 2018

(65) Prior Publication Data

US 2018/0339530 A1 Nov. 29, 2018

Related U.S. Application Data

(62) Division of application No. 15/160,532, filed on May 20, 2016, now Pat. No. 10,071,572.

(30) Foreign Application Priority Data

May 27, 2015 (JP) ..... 2015-107991
May 27, 2015 (JP) ..... 2015-107994
May 27, 2015 (JP) ..... 2015-107999

(51) Int. Cl.
*B41J 11/00* (2006.01)
*B41J 2/17* (2006.01)
*B41J 11/06* (2006.01)

(52) U.S. Cl.
CPC ..... *B41J 11/0085* (2013.01); *B41J 2/1721* (2013.01); *B41J 11/0065* (2013.01); *B41J 11/06* (2013.01); *B41J 2002/1742* (2013.01)

(58) Field of Classification Search
CPC ..... B41J 11/0085; B41J 11/0065
See application file for complete search history.

(56) References Cited

U.S. PATENT DOCUMENTS 5,200,767 A 4/1993 Tsukada et al.
5,398,049 A 3/1995 Terasawa et al.
(Continued)

FOREIGN PATENT DOCUMENTS

CN 1935523 A 3/2007
CN 1958290 A 5/2007
(Continued)

OTHER PUBLICATIONS

Office Action (with Translation) dated Jan. 17, 2019, issued in Japanese Application No. 2015-107991.
(Continued)

*Primary Examiner* — Shelby L Fidler
(74) *Attorney, Agent, or Firm* — Venable LLP

(57) ABSTRACT

A platen includes: a supporting portion that can support a sheet; a suction unit that sucks the sheet in such a manner as to attach the sheet to the supporting portion; a first ink receiver that receives ink ejected downstream of the leading end of the sheet passing the supporting portion; and a second ink receiver that receives ink ejected upstream of the trailing end of the sheet passing the supporting portion.

7 Claims, 42 Drawing Sheets

(56) References Cited

U.S. PATENT DOCUMENTS

| | | | | |
|---|---|---|---|---|
| 5,880,754 | A | 3/1999 | Niikura et al. | |
| 6,299,293 | B1 | 10/2001 | Imanaka et al. | |
| 6,435,655 | B1 | 8/2002 | Yoshihira et al. | |
| 6,471,315 | B1 | 10/2002 | Kurata | |
| 6,543,892 | B2 | 4/2003 | Kubota et al. | |
| 6,886,909 | B2 | 5/2005 | Ogasawara | |
| 6,899,411 | B2 | 5/2005 | Niikura et al. | |
| 7,216,945 | B2 | 5/2007 | Nojima et al. | |
| 7,284,814 | B2 | 10/2007 | Ogasawara | |
| 7,296,876 | B2 | 11/2007 | Kagami et al. | |
| 7,690,784 | B2 | 4/2010 | Nishi et al. | |
| 7,699,431 | B2 | 4/2010 | Nakazawa et al. | |
| 8,132,879 | B2 | 3/2012 | Imahashi et al. | |
| 8,287,119 | B2 | 10/2012 | Yamaguchi et al. | |
| 8,419,155 | B2 | 4/2013 | Kawakami et al. | |
| 8,950,844 | B2 | 2/2015 | Takahashi et al. | |
| 9,090,099 | B2 | 7/2015 | Ogasawara | |
| 9,150,022 | B2 | 10/2015 | Miyakoshi et al. | |
| 9,802,426 | B2 | 10/2017 | Onuma et al. | |
| 10,011,124 | B2 | 7/2018 | Ogasawara et al. | |
| 2003/0085979 | A1* | 5/2003 | Ishii | B41J 11/005 347/104 |
| 2003/0151639 | A1 | 8/2003 | Takahashi | |
| 2004/0027412 | A1* | 2/2004 | Takahashi | B41J 11/0065 347/34 |
| 2005/0062794 | A1 | 3/2005 | Kanamitsu et al. | |
| 2005/0122375 | A1 | 6/2005 | Otsuki | |
| 2006/0132513 | A1 | 6/2006 | Ozaki et al. | |
| 2007/0070113 | A1 | 3/2007 | Kawabata et al. | |
| 2007/0097171 | A1 | 5/2007 | Kagami et al. | |
| 2007/0126832 | A1 | 6/2007 | Kito | |
| 2007/0291096 | A1* | 12/2007 | Toyoshima | B41J 11/0025 347/104 |
| 2009/0021556 | A1 | 1/2009 | Zhao et al. | |
| 2012/0044308 | A1 | 2/2012 | Kobayashi | |
| 2014/0022300 | A1 | 1/2014 | Lo et al. | |
| 2015/0352846 | A1 | 12/2015 | Miyakoshi et al. | |
| 2016/0288505 | A1 | 10/2016 | Tsukuda et al. | |
| 2016/0347093 | A1 | 12/2016 | Ogasawara et al. | |
| 2017/0259571 | A1* | 9/2017 | Miyakoshi | B41J 2/165 |

FOREIGN PATENT DOCUMENTS

| | | | |
|---|---|---|---|
| JP | 2001-219548 | A | 8/2001 |
| JP | 2005-096413 | A | 4/2005 |
| JP | 2006-021475 | A | 1/2006 |
| JP | 2007-083452 | A | 4/2007 |
| JP | 2007-144825 | A | 6/2007 |
| JP | 2009-039982 | A | 2/2009 |
| JP | 2010-188697 | A | 9/2010 |
| JP | 2011-046145 | A | 3/2011 |
| JP | 2011-148255 | A | 8/2011 |
| JP | 2012-166510 | A | 9/2012 |
| JP | 2015-027751 | A | 2/2015 |

OTHER PUBLICATIONS

Office Action (with Translation) dated Jan. 22, 2019, issued in Japanese Application No. 2015-107999.

European Search Report dated Oct. 25, 2016, issued in European Patent Application No. 16000985.8.

Office Action dated Dec. 4, 2017, in Chinese Patent Application No. 201610364521.4.

Office Action dated Sep. 25, 2018, in Japanese Patent Application No. 2015-107991.

Office Action dated Sep. 25, 2018, in Japanese Patent Application No. 2015-107999.

Office Action dated Oct. 9, 2018, in Japanese Patent Application No. 2015-107994.

* cited by examiner

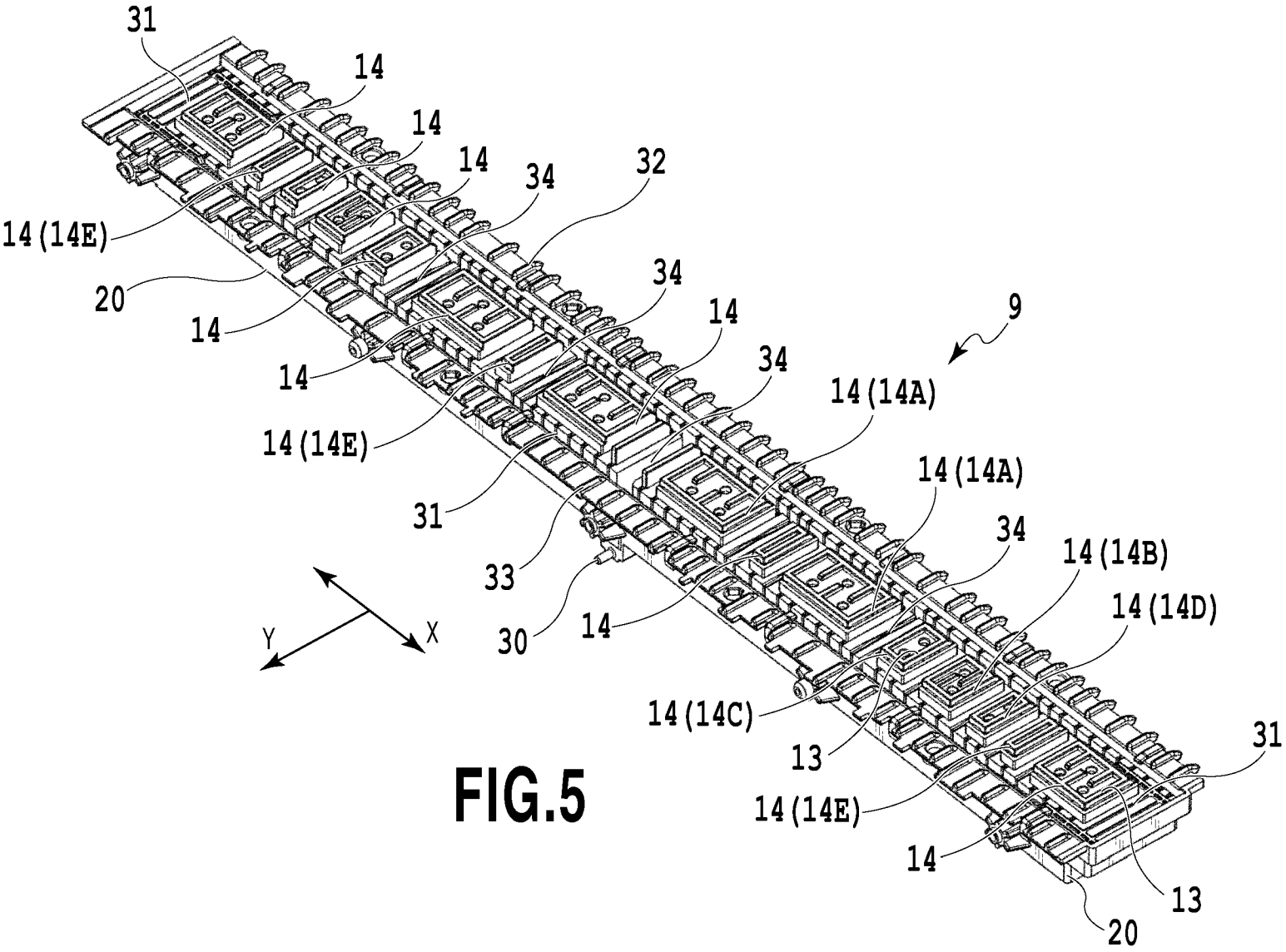
9
31
14
14
14

PRINTING APPARATUS AND PLATEN

This application is a divisional application of U.S. patent application Ser. No. 15/160,532, filed May 20, 2016, which claims the benefit of Japanese Patent Application No. 2015-107994, filed May 27, 2015, No. 2015-107999, filed May 27, 2015, and No. 2015-107991, filed May 27, 2015, which are hereby incorporated by reference herein in their entirety.

BACKGROUND OF THE INVENTION

Field of the Invention

The present invention relates to an inkjet printing apparatus provided with a platen for supporting a sheet.

Description of the Related Art

Japanese Patent Laid-Open No. 2006-021475 discloses an ink jet printing apparatus capable of forming an image without a margin at a sheet end, that is, performing so-called "marginless printing." The apparatus uses a suction platen that sucks a sheet by a negative pressure.

According to the invention disclosed in Japanese Patent Laid-Open No. 2006-021475, in a case where marginless printing is performed at the trailing end of a sheet, the sheet is sucked to a sucking unit of a platen. In contrast, in a case where marginless printing is performed at the leading end of a sheet, the leading end of the sheet has not yet reached the sucking unit, and therefore, it has not yet sucked to the sucking unit. Thus, the floating of the leading end of the sheet cannot be suppressed at the time of the introduction of the sheet, and thus, ink is landed on the sheet that remains floating. As a consequence, there is a possibility that the quality of an image is reduced at the floating portion of the sheet or the sheet smears due to the contact of the sheet with a printhead. Furthermore, ink discarded outside of the end of a sheet may float in the form of atomized ink mist during the marginless printing, thereby adhering to the reverse of the sheet.

SUMMARY OF THE INVENTION

An object of the present invention is to provide a printing apparatus capable of suppressing floating or flexure of a sheet so as to obtain an image of a high quality in marginless printing.

Moreover, another object of the present invention is to provide a printing apparatus capable of securely performing four-side marginless printing with respect to a cut sheet, and a platen.

According to one aspect of the present invention, a printing apparatus comprising: a printhead configured to eject ink; a sheet conveying unit configured to convey a sheet in a first direction, and a platen configured to support the sheet to be printed under the printhead, the platen comprising: a plurality of supporting portions, arranged in a second direction perpendicular to the first direction, each configured to suck the sheet; a first ink receiver disposed adjacent to the plurality of supporting portions downstream in the first direction and configured to receive ink ejected to outside of a sheet leading end from the printhead; a second ink receiver disposed adjacent to the plurality of supporting portions upstream in the second direction and configured to receive ink ejected to outside of a sheet trailing end from the printhead; and third ink receivers each formed between two of the supporting portions and configured to receive ink ejected to outside of sheet side ends from the printhead, wherein both of the first ink receiver and the second ink receiver are elongated in the second direction, and the first ink receiver and the second ink receiver are connected to each other via the third ink receivers, each of the plurality of the supporting portions being surrounded by the first ink receiver, the second ink receiver, and the third ink receivers, as viewed from above.

Further features of the present invention will become apparent from the following description of exemplary embodiments (with reference to the attached drawings).

BRIEF DESCRIPTION OF THE DRAWINGS

FIG. 5 is a perspective view showing the general configuration of the platen;

DESCRIPTION OF THE EMBODIMENTS

Descriptions will be given below of embodiments of a printing apparatus according to the present invention. Hereinafter, the present invention will be described by way of an inkjet printing apparatus of a serial type for performing printing by reciprocating a printhead capable of ejecting ink in a direction transverse a sheet conveyance direction with respect to a sheet that is intermittently conveyed in a predetermined direction. The present invention is applicable to not only a printing apparatus of a serial type but also a line printing apparatus for sequentially performing printing by the use of an elongated printhead. Moreover, the printing apparatus is applicable to not only a printing apparatus having a single function but also a multiple function printer equipped with a copying function, a facsimile function, and the like.

(First Embodiment)

1. Outline of Apparatus

Figure 1:
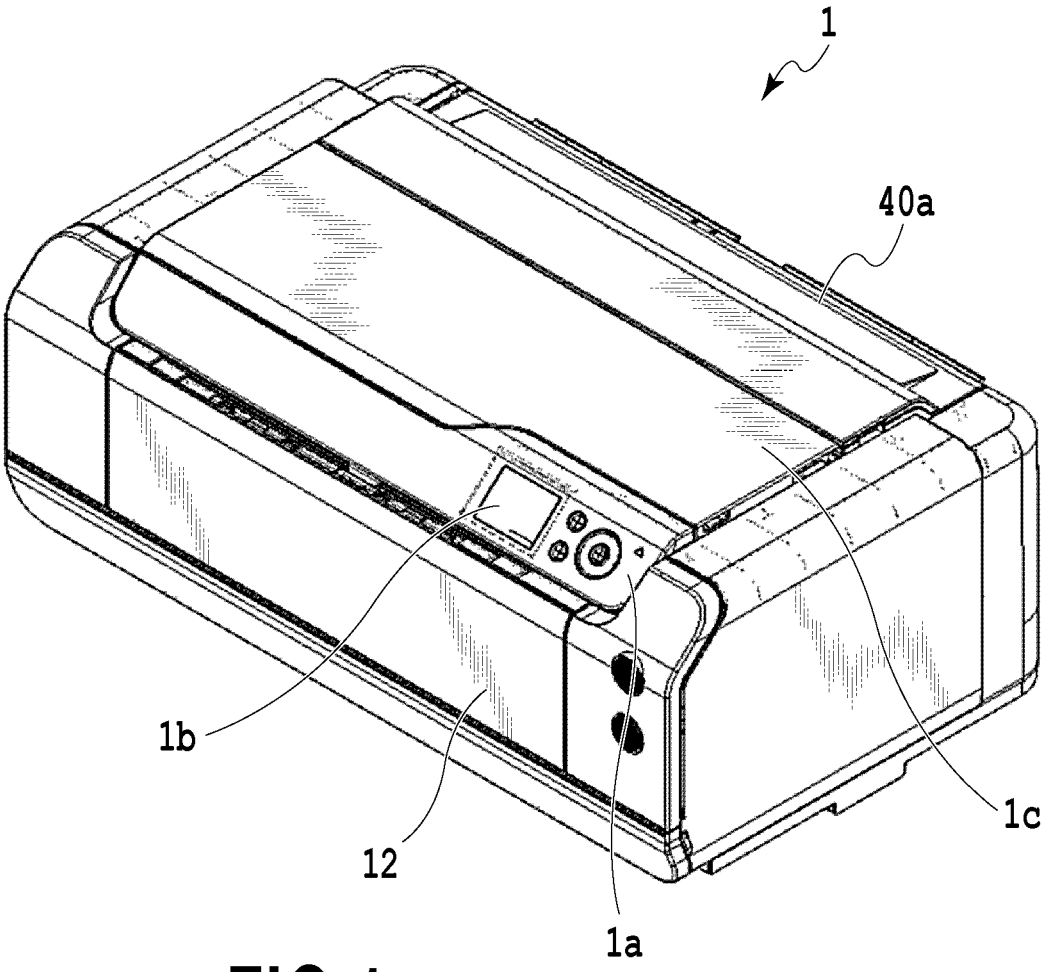
FIG. 1 is a perspective view showing the outer appearance of a printing apparatus in a first embodiment.
Figure 2:
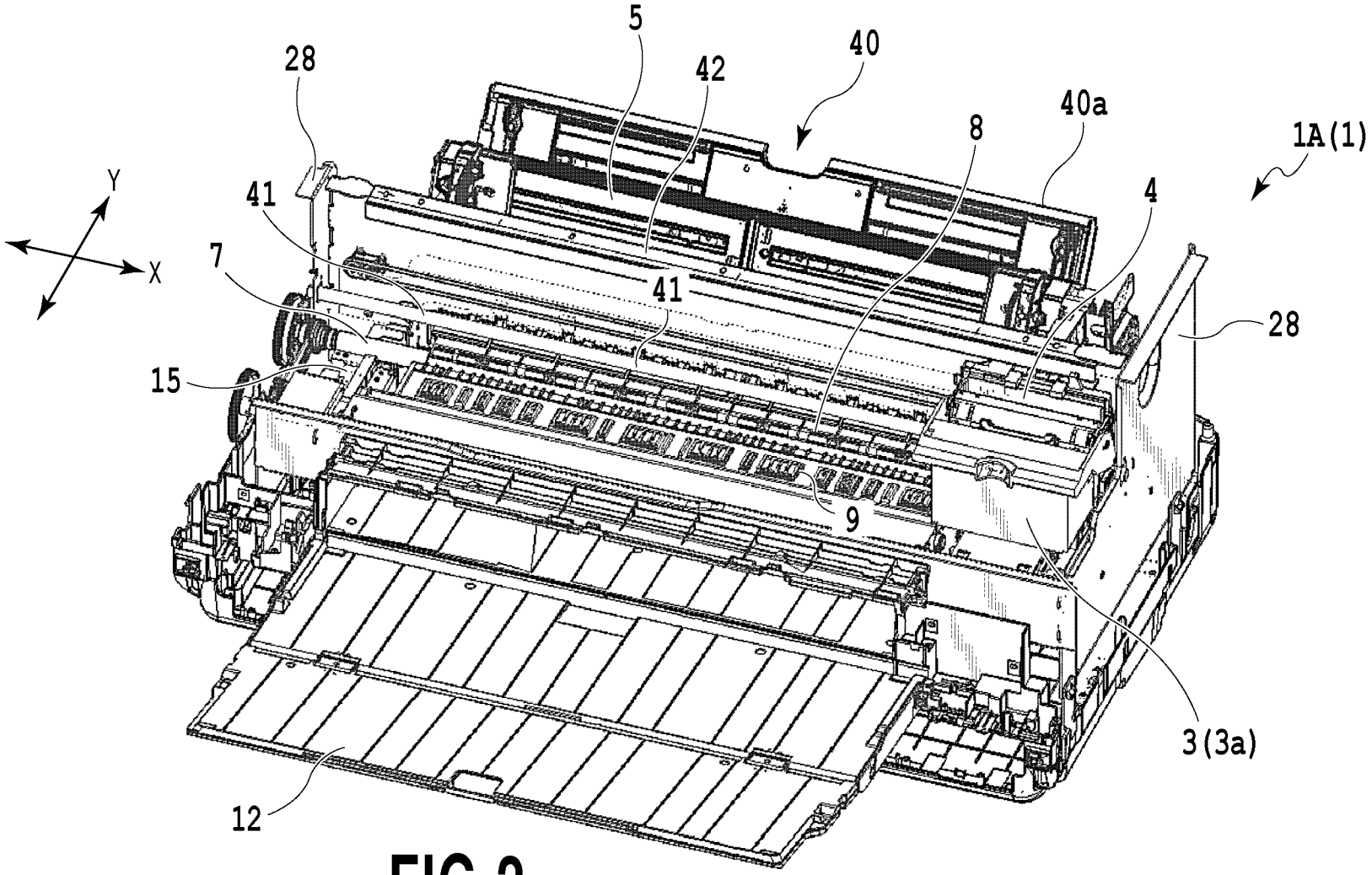
FIG. 2 is a perspective view showing the general configuration of a printing apparatus body.

FIG. 1 is a perspective view showing the outer appearance of a printing apparatus 1 in an embodiment. At the front of the printing apparatus 1, a discharge tray 12 for supporting a printed sheet is provided, and furthermore, a console panel 1*a* for performing various setting operations and a display 1*b* are disposed. Moreover, a top cover 1*c* for covering the inside structure such as a carriage, described later, is openably disposed at the top of the printing apparatus 1, and furthermore, a feed tray 5 for stacking thereon sheets to be fed to a feeder 40, described later, is openably disposed at the back of the printing apparatus 1. Incidentally, although FIG. 1 shows a state in which the discharge tray 12 and the feed tray 40*a* are closed, both of the trays 12 and 40*a* can be opened during a printing operation, as shown in FIG. 2.

Figure 3:
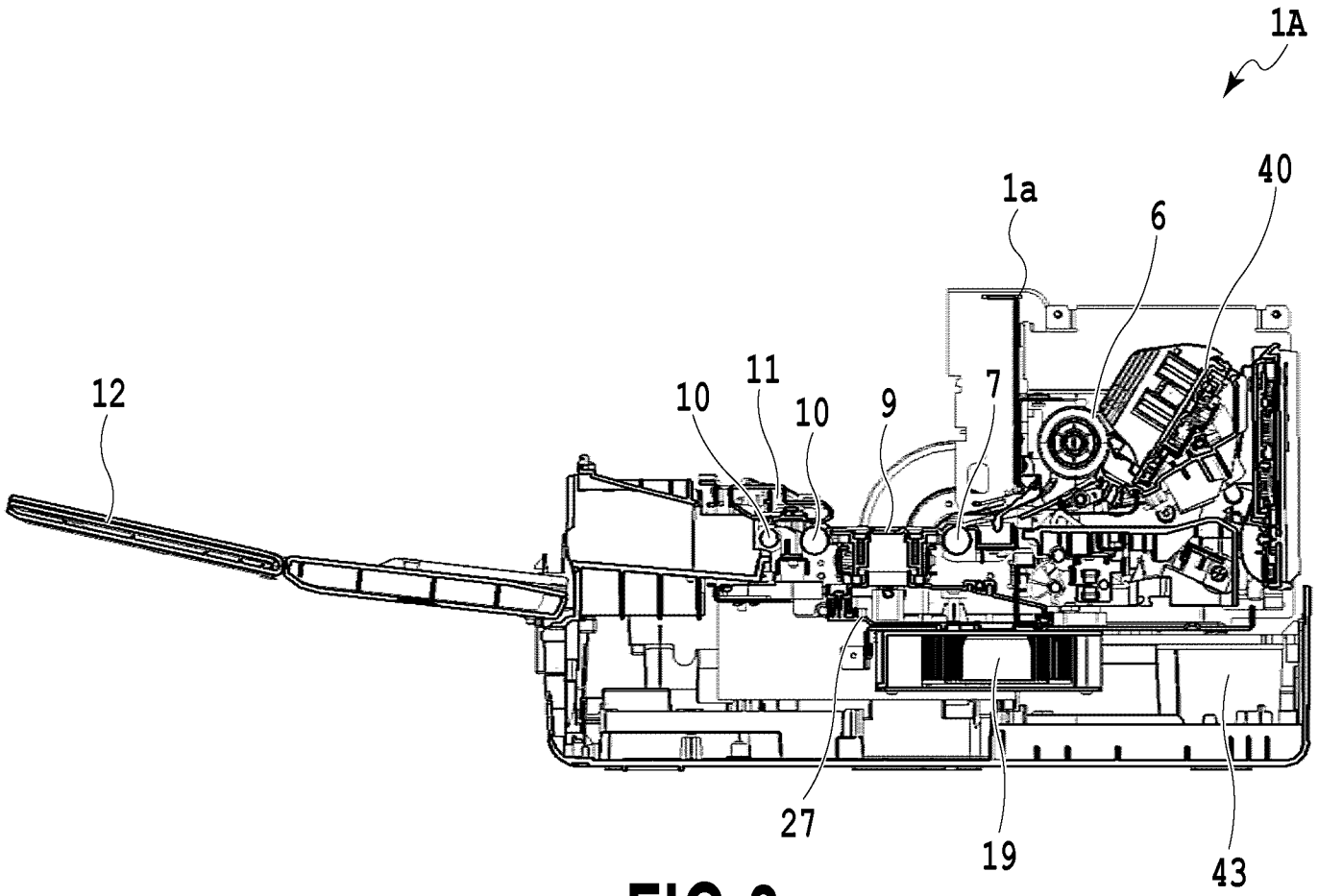
FIG. 3 is a vertical side view showing the printing apparatus.

Here, referring to FIGS. 2 and 3, explanation will be made on the configuration of a printing apparatus body 1A. FIG. 2 is a perspective view showing the entire configuration of the printing apparatus body 1A in which a jacket is detached from the printing apparatus 1; and FIG. 3 is a vertical side view showing the printing apparatus body 1A shown in FIG. 2.

The feeder 40 is disposed at the back of the printing apparatus body 1A. The feeder 40 separates a bundle of cut sheets (hereinafter simply referred to as sheets) stacked on the feed tray 5 one by one according to the rotation of a feed roller 6, and then, feeds them to a conveyor such as a conveyance roller 7. In addition, a carriage 4 mounting thereon a printhead 3 capable of ejecting ink is disposed at the printing apparatus body 1A. The carriage 4 is supported in a freely reciprocating manner along a carriage guide shaft 41 and a carriage rail disposed in a direction (i.e., an X direction) transverse (perpendicularly in the embodiment) to a sheet conveyance direction (i.e., a Y direction). The movement of the carriage 4 and the printhead 3 in the X direction will also be referred to as scanning in the following description. The X direction represents the carriage movement direction, and furthermore, is a sheet widthwise direction of the sheet to be conveyed. The Y direction represents the sheet conveyance direction.

One sheet separated and fed from the bundle of sheets stacked on the feed tray 40*a* by the feeder 40 is conveyed onto a platen 9 supporting the sheet in a manner facing the printhead 3 by a first conveyance roller pair (i.e., the conveyor) including the conveyance roller 7 and a pinch roller 8. Here, the carriage 4 mounting the printhead 3 thereon is moved in the X direction, and then, ink is ejected toward the sheet from the printhead 3. A sheet detecting sensor for detecting the end of the sheet is disposed on one side surface of the carriage 4. The relative position between the sheet and the printhead and a print starting timing with respect to the sheet are determined based on a detection output from the sheet detecting sensor.

Upon completion of printing of one scanning with respect to the sheet, the sheet is conveyed by a predetermined distance in the Y direction perpendicular to the X direction by the first conveyance roller pair. The repetition of the scanning of the printhead 3 and the conveyance of the sheet achieves serial printing on the sheet in a serial printing system.

A printed sheet is discharged onto the discharge tray 12 by a second conveyance roller pair (i.e., a conveyor) including discharge rollers 10 and a pulley 11 disposed downstream of the platen 9 in the sheet conveyance direction (i.e., the Y direction). Incidentally, the above-described feeder 40, carriage guide shaft 41, carriage rail 42, and platen 9 are securely supported by a chassis 28 that forms the frame of the printing apparatus body 1A. In addition, other members including the above-described discharge tray 12, top cover 1*c*, and feed tray 5 are supported by the chassis 28.

2. Platen

Figure 4A:
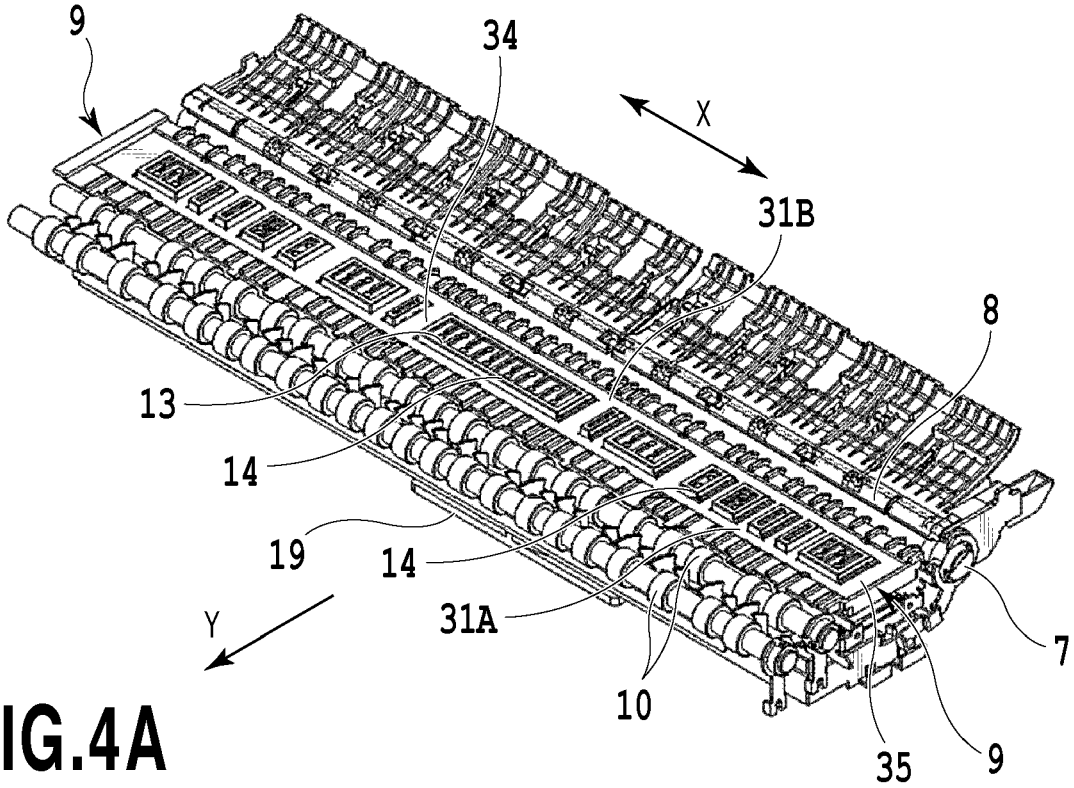
FIG. 4A is a perspective view showing a platen and its peripheral structure.
Figure 4B:
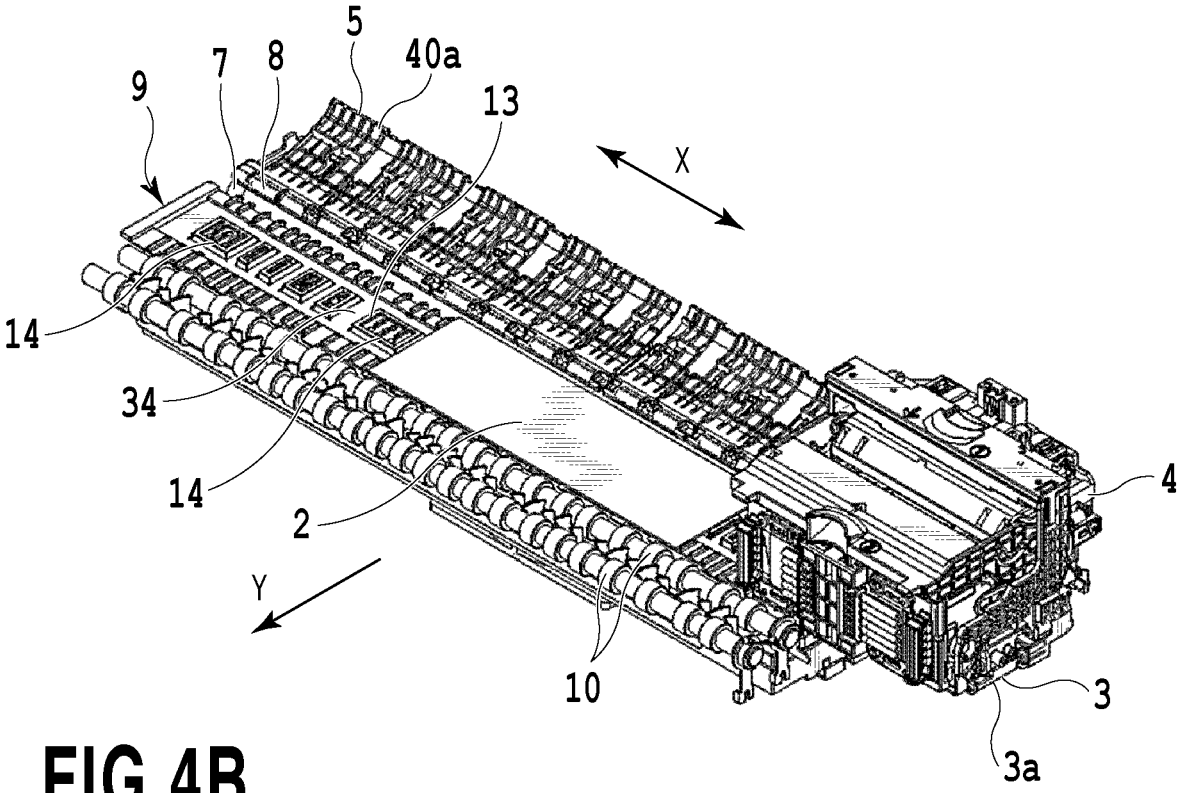
FIG. 4B is a perspective view showing the platen, its peripheral structure, and a sheet.

Next, explanation will be made on the structure of the platen 9. FIGS. 4A and 4B are perspective views showing the platen 9 and its peripheral structure. As shown in FIGS. 4A and 4B, the platen 9 is interposed between the first conveyance roller pair including the conveyance roller 7 and the pinch roller 8 and the second conveyance roller pair including the discharge rollers 10 and the pulley 11. The platen 9 supports the sheet to be conveyed by the first and second conveyance roller pairs on a side (i.e., a reverse) opposite to a side to be printed.

A description will be given of the structure of the platen 9 for use in the printing apparatus 1. As shown in FIGS. 3, 4A, and 4B, the platen 9 is interposed between the first conveyance roller pair including the conveyance roller 7 and the pinch roller 8 and the second conveyance roller pair including the discharge rollers 10 and the pulley 11. The platen 9 is disposed at a position facing an ejection port forming face 3*a* of the printhead 3 having ejection ports for ejecting ink arranged thereat. Moreover, the platen 9 supports the surface (i.e., the reverse) of the sheet 2, which is conveyed by the first and second conveyance roller pairs, opposite to a surface to be printed facing the ejection port forming face 3*a* (see FIG. 2).

In FIGS. 4A and 4B, the platen 9 is provided with at least one sheet supporting portion 14 (i.e., a first supporting portion) capable of supporting the reverse of the sheet while suppressing floating or flexure of the sheet 2 in order to properly keep an interval between the ejection port forming face 3*a* of the printhead 3 and the sheet 2. The plurality of sheet supporting portions 14 are arranged in a longitudinal direction (i.e., the X direction) of the platen 9 so as to cope with a plurality of kinds of sheet width sizes.

Specifically, as to a plurality of sheets having standard sizes, the sheet supporting portion 14 is disposed in such a manner as not to be positioned within a range of about 2 mm from the side end of the sheet during the conveyance of each of the sheets. In the platen 9 in the present embodiment, the arrangement and shape of the sheet supporting portion 14 are determined according to the sheet width of each of types such as an L size, a KG size, a 2 L size, a 6P size, a letter size, an A4 size, a 4P size, an A3 size, an A3 elongation size, an HP size, an A2 size, an A2 elongation size, and a 17-inch size.

2.1 Sheet Supporting Portion

FIG. 5 is a perspective view showing the general configuration of the platen 9. The platen 9 is provided with the sheet supporting portion 14 (i.e., the first supporting portion) capable of supporting the reverse of the sheet 2 while suppressing floating or flexure of the sheet 2 in order to properly keep the interval between the ejection port forming face 3*a* of the printhead 3 and the sheet 2. The plurality of sheet supporting portions 14 are formed in the longitudinal direction (i.e., the X direction) of the platen 9.

Figure 6:
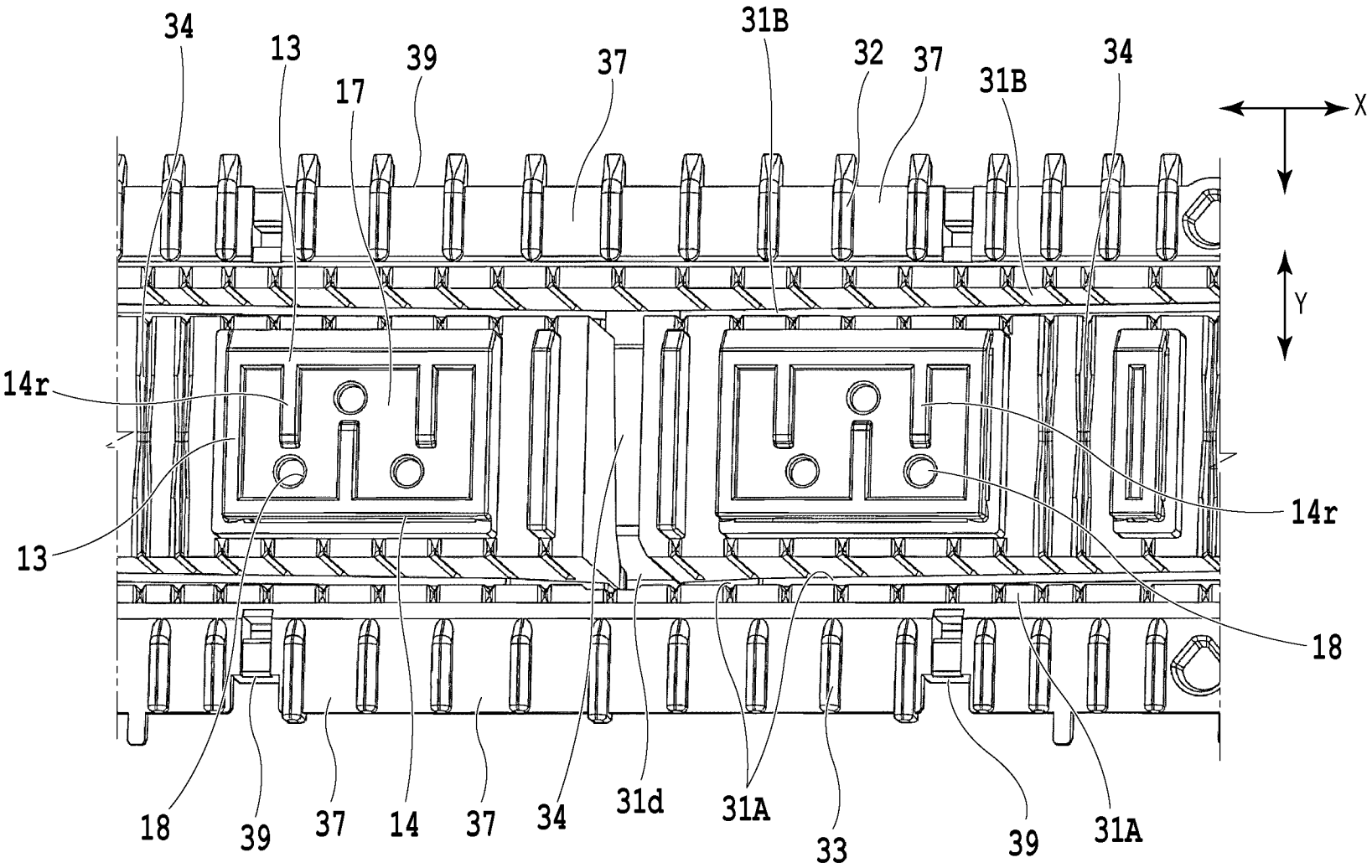
FIG. 6 is an enlarged view partly showing the platen.

FIG. 6 is an enlarged view partly showing the platen 9 shown in FIG. 5. The sheet supporting portion 14 is formed into a rectangular frame with a projecting portion. A sheet supporting surface 13 of the supporting portion 14 has a width of about several millimeters. Moreover, a suction recess 17 is formed at the upper portion of the sheet supporting portion 14, thereby forming a recess lower by one step than the sheet supporting surface 13. Suction holes (i.e., suction units) 18 are formed at the bottom surface of the suction recess 17 in such a manner as to penetrate the platen 9. The suction holes 18 communicate with a negative pressure generator 19, described later. A negative pressure generated by the negative pressure generator 19 is supplied to the suction recess 17 through the suction holes 18. The sheet passing the sheet supporting surface 13 is sucked by the negative pressure supplied to the suction recess 17, and then, is sucked to the sheet supporting surface 13. In this manner, the sheet 2 is conveyed while being kept flat without any flexure or floating. Consequently, a distance (i.e., a distance to a sheet) between the ejection port forming surface 3*a* of the printhead 3 and the sheet 2 is kept at a preset proper distance.

2.2 Ink Discarding Unit

In order to securely perform printing on the entire sheet without any margins at the peripheral edges of the sheet, that is, so-called marginless printing, it is necessary to eject ink up to the outside of the end of the sheet. Moreover, in the printing apparatus of the inkjet system, ink is ejected to the outside of the sheet immediately before a printing operation, that is, preliminary ejection is performed in order to stabilize ink ejection performance of the printhead 3. The above-described ink ejected to the outside of the sheet is received in ink receivers formed at the platen 9. As the ink receivers in this embodiment, there are provided a leading end ink discarding groove (i.e., a first ink receiver) 31A for receiving ink ejected to the outside of the leading end of the sheet and a trailing end ink discarding groove (i.e., a second ink receiver) 31B for receiving ink ejected to the outside of the trailing end of the sheet.

Figure 7:
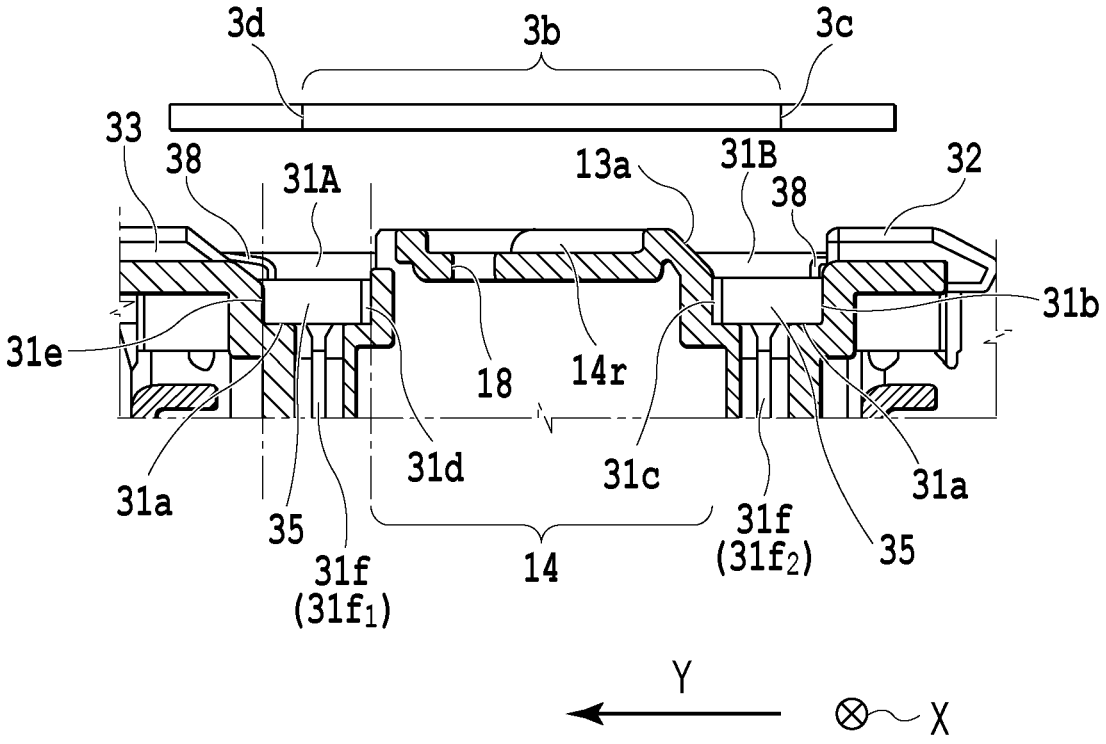
FIG. 7 is a vertical side view partly showing the platen.

FIG. 7 is a vertical side view partly showing the platen 9. FIG. 7 shows the cross sections of the leading end ink discarding groove 31A and trailing end ink discarding groove 31B of the platen 9. As shown in FIG. 7, the leading end ink discarding groove 31A is elongated in the X direction downstream of the sheet supporting portion 14 whereas the trailing end ink discarding groove 31B is elongated in the X direction upstream of the sheet supporting portion 14. The leading end ink discarding groove 31A includes a bottom 31*a* lower than the sheet supporting surface 13, a downstream wall 31*d* of the sheet supporting portion 14, and a side wall 31*e* of a downstream sheet supporting portion 33. In contrast, the trailing end ink discarding groove 31B includes a bottom 31*a* lower than the sheet supporting surface 13, an upstream wall 31*c* of the sheet supporting portion 14, and a side wall 31*b* of an upstream sheet supporting portion 32. The leading end ink discarding groove 31A and the trailing end ink discarding groove 31B have a capacity enough to prevent the ink from overflowing in a case where they receive the ink ejected from the printhead 3.

In the meantime, in order to securely perform the marginless printing at the right and left ends (i.e., sheet side ends) of the sheet in the sheet widthwise direction, it is necessary to eject the ink up to the outside of the right and left ends of the sheet in a case where the printhead 3 ejects the ink while performing scanning in the X direction. Even in a case where the width of the sheet to be used is changed, the platen has right/left end ink discarding grooves (i.e., a third ink receiver) 34 according to the width of the sheet in such a manner as to receive the ink ejected to the outside of the sheet side end (see FIG. 8).

The sheets that can be subjected to marginless printing have mainly standard sizes such as an L size, a 2 L size, a postcard size, an A4 size, a letter size, an A3 size, a legal size, and an A2 size. In view of this, the plurality of ink discarding grooves 34 are formed at positions corresponding to the right and left ends of the sheet according to the sizes of sheets. As described above, the leading end ink discarding groove 31A, the trailing end ink discarding groove 31B, and the right/left end ink discarding grooves 34 are formed in a grid pattern at the obverse of the platen 9, thus surrounding the sheet supporting portion 14.

The arrangement of the sheet supporting portion is determined with reference to a print position. In the present embodiment, the reference of the print position is set at the center of the width of a print sheet: namely, a so-called center reference sheet supply is adopted. In the case of the center reference, the sheet is conveyed such that the center of the sheet width (i.e., a print width) matches the center of the platen 9 in the widthwise direction in a case where the sheet has any one of various sheet widths. The sheet supporting portion 14 is symmetrically disposed such that the right/left end ink discarding grooves 34 are formed at symmetric positions with reference to the center position of the width of the platen 9 in the X direction. In performing the marginless printing, it is preferable that one side of the right/left end ink discarding groove 34 should be positioned inward by about 2 mm of the right or left end of the sheet whereas the other side thereof should be positioned outward by about 5 mm of the end of the sheet. As a consequence, the width of the ink discarding groove and the position of the sheet supporting portion are determined in such a manner as to satisfy the above-described positional relationship with respect to the various kinds of sheets having the standard sizes. Incidentally, other than the center reference, a one-side reference may be adopted such that all sheets having various kinds of sizes are aligned at one of right and left reference positions.

Figure 8:
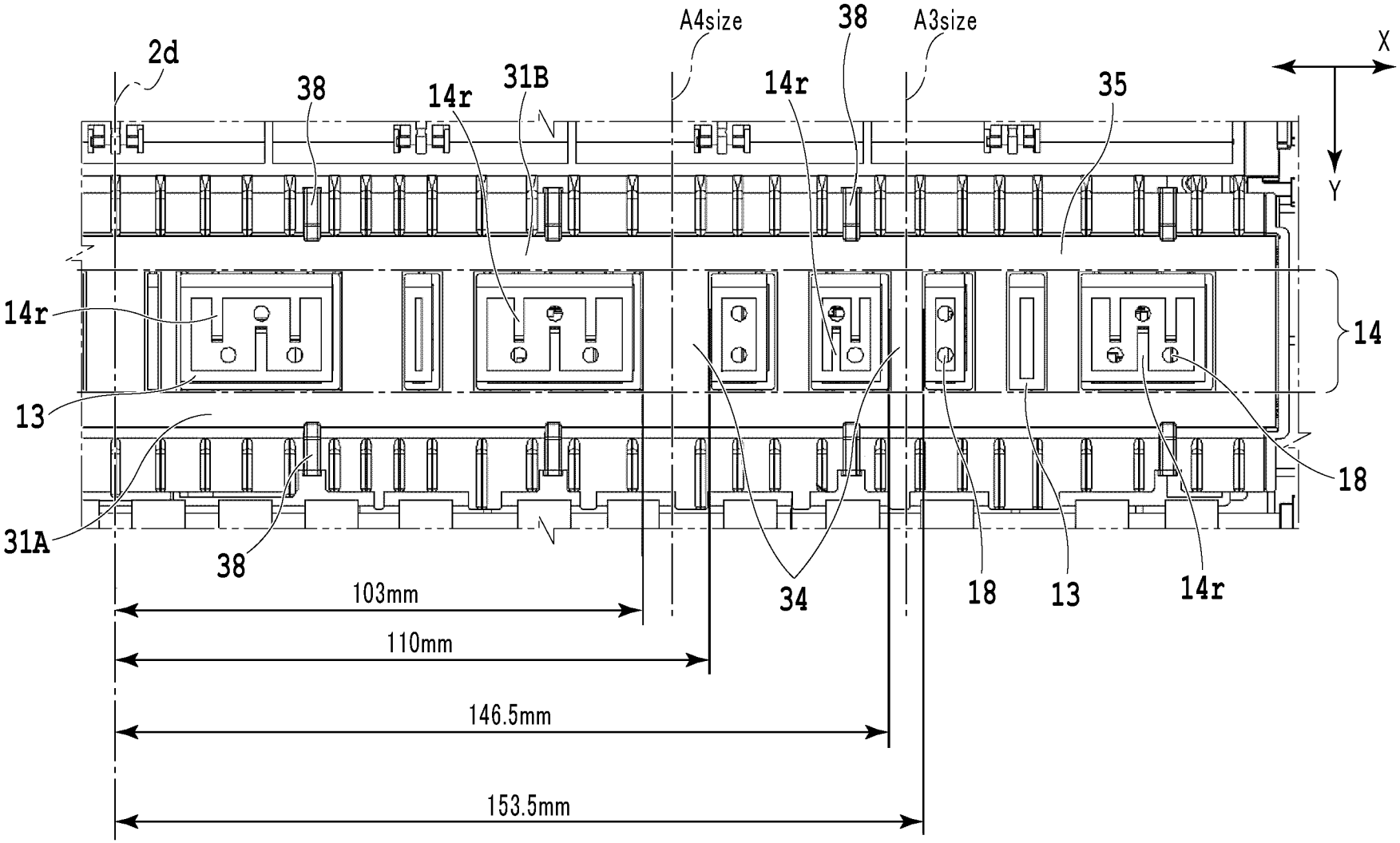
FIG. 8 is a view showing a sheet supporting portion corresponding to the size of a sheet.

FIG. 8 is a view showing sheet supporting portions corresponding to the sheets of A4 and A3 sizes, for example. Since the center reference is adopted, as described above, the centers of the sheets having different sizes pass one center reference 2*d* set on the platen 9 all the time. In a case where a sheet of an A4 size is conveyed in the longitudinal direction of the sheet, the end of the sheet passes a position apart by 105 mm in the X direction from the center reference 2*d* of the platen 9. In view of this, the sheet supporting portion 14 is arranged such that the right/left end ink discarding groove 34 is formed within a range apart by 103 mm to 110 mm from the center reference 2*d*. In the meantime, in a case where a sheet of an A3 size is conveyed in the longitudinal direction of the sheet, the end of the sheet passes a position apart by 148.5 mm in the X direction from the center reference 2*d* of the platen 9. In view of this, the sheet supporting portion 14 is arranged such that the right/left end ink discarding groove 34 is formed within a range apart by 146.5 mm to 153.5 mm from the center reference 2*d*. Incidentally, the number of right/left end ink discarding grooves 34 is halved in the case of not the center reference but the one-side reference, and furthermore, the distance from a reference position is changed.

Figure 9:
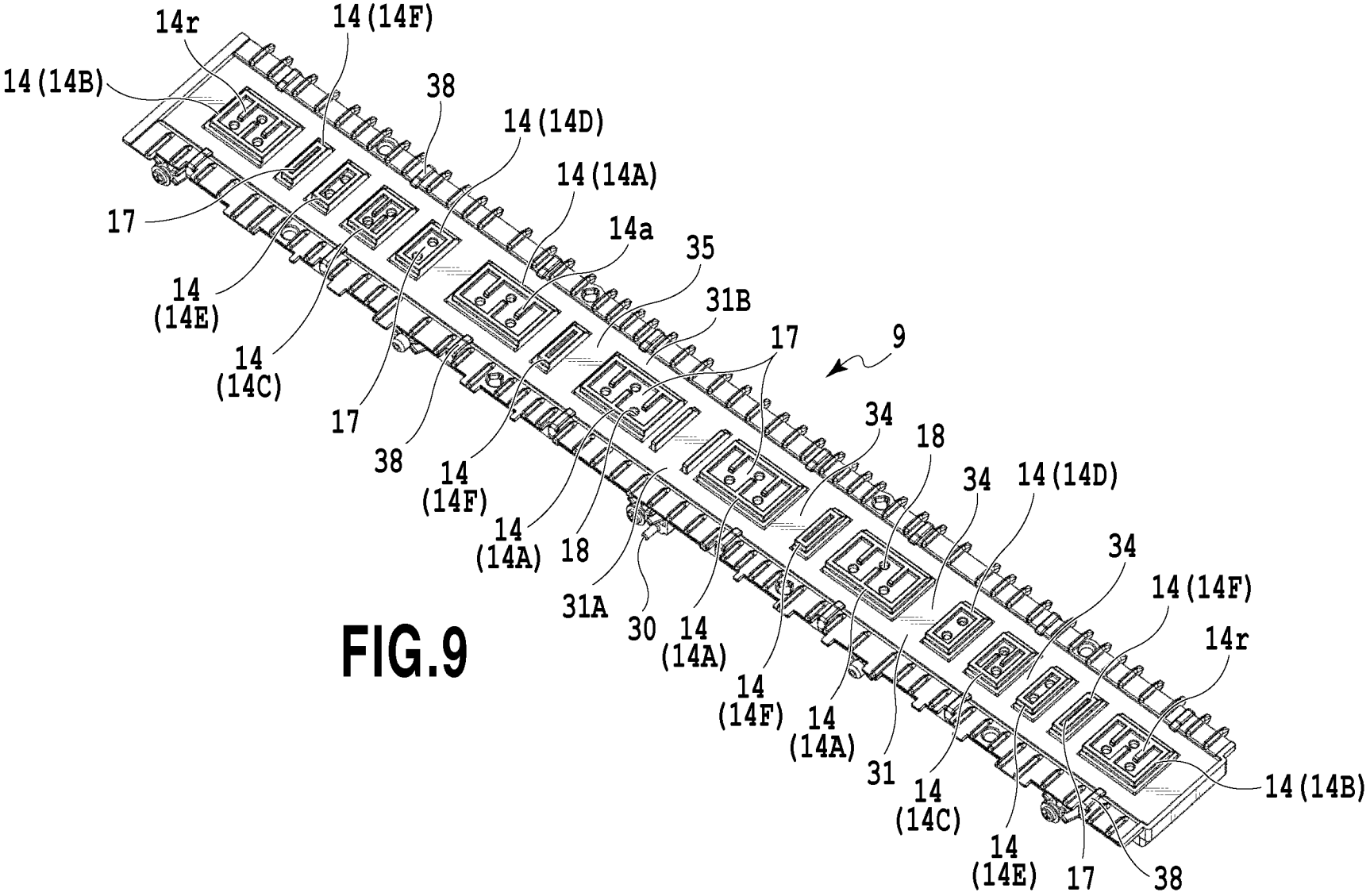
FIG. 9 is a perspective view showing a state in which an ink absorber is disposed in an ink discarding groove.

Six kinds of sheet supporting portions 14 (first to sixth sheet supporting portions (14A to 14F)) having different sizes are formed to cope with a plurality of kinds of sheets having different sheet widths (i.e., sizes of sheets in the X direction) (see FIGS. 5 and 9). Among these sheet supporting portions 14, each of the first sheet supporting portion 14A to the fifth sheet supporting portion 14E has the suction recess 17 having a relatively large area, and therefore, the suction holes 18 are formed thereat, as described above. However, the area of the suction recess 17 is small at the smallest sixth sheet supporting portion 14F, and therefore, no suction hole 18 is formed. In the present embodiment, the sheet supporting portion 14F copes with a sheet of a 2 L size and a sheet of an HP size, and no suction hole 18 is formed at the suction recess 17 of each of the sheet supporting portions 14F.

At the first, second, and third sheet supporting portions 14A, 14B, and 14C that are formed into a relatively large frame, intermediate ribs 14*r*, each having the same height as that of the sheet supporting surface 13, are formed in the direction perpendicular to the X direction (i.e., the Y direction) in such a manner as to prevent the sheet from denting at the suction recess 17. Here, three intermediate ribs 14*r* are formed at each of the first sheet supporting portion 14A and the second sheet supporting portion 14B; and two intermediate ribs 14*r* are formed at the third sheet supporting portion 14C. Here, the upper surface of the intermediate rib 14*r* has a support surface flush with the sheet supporting surface 13 formed into a frame. The fifth and sixth sheet supporting portions 14E and 14F have no intermediate rib 14*r*. It is desirable that the number of suction holes 18, the diameter of the suction hole 18, the number of intermediate ribs 14*r*, and the like should be appropriately determined according to the sizes of the sheet supporting portion 14 and the suction recess that are determined according to the corresponding sheet sizes.

In this manner, assuming that the marginless printing is performed on four sides of a cut sheet, the sheet supporting portion 14 of the platen 9 is individually surrounded by the fore and trailing end ink discarding grooves 31A and 31B and the right/left end ink discarding grooves 34. In order to suppress the generation of mist caused by a splash at the time of landing of the ink and the leakage of the discarded ink, an ink absorber 35 is disposed at each of the ink discarding grooves 31A, 31B, and 34, as shown in FIGS. 7 and 9. It is preferable that the ink absorber 35 should be a spongy single sheet made of expanded urethane. The upper surface of the ink absorber 35 is locked by a plurality of lock claws 38 (see FIG. 8), so that the ink absorber 35 can be inhibited from being detached.

Moreover, the platen 9 is provided with an outer peripheral wall 20 that surrounds the sheet supporting portion 14 including the suction holes 18 and the ink discarding grooves 31A and 31B. The outer peripheral wall 20 forms a casing (i.e., a platen casing). At the side of the outer peripheral wall 20 is formed a waste ink discharge port 30 communicating with the ink discarding grooves 31A and 31B. Waste ink discarded into each of the ink discarding grooves 31A and 31B is discharged to the outside of the platen 9 through the waste ink discharge port 30.

In this manner, the first ink receiver and the second ink receiver are connected to each other via the third ink receivers. As viewed from above (from the top), each of the plurality of supporting portions is individually surrounded by the first ink receiver, the second ink receiver, and the third ink receivers. Therefore, the waste ink received in these three ink receivers is collected at one site, and then, can be discharged through the common ink discharge port 30.

2.3 Air Channel

Figure 10:
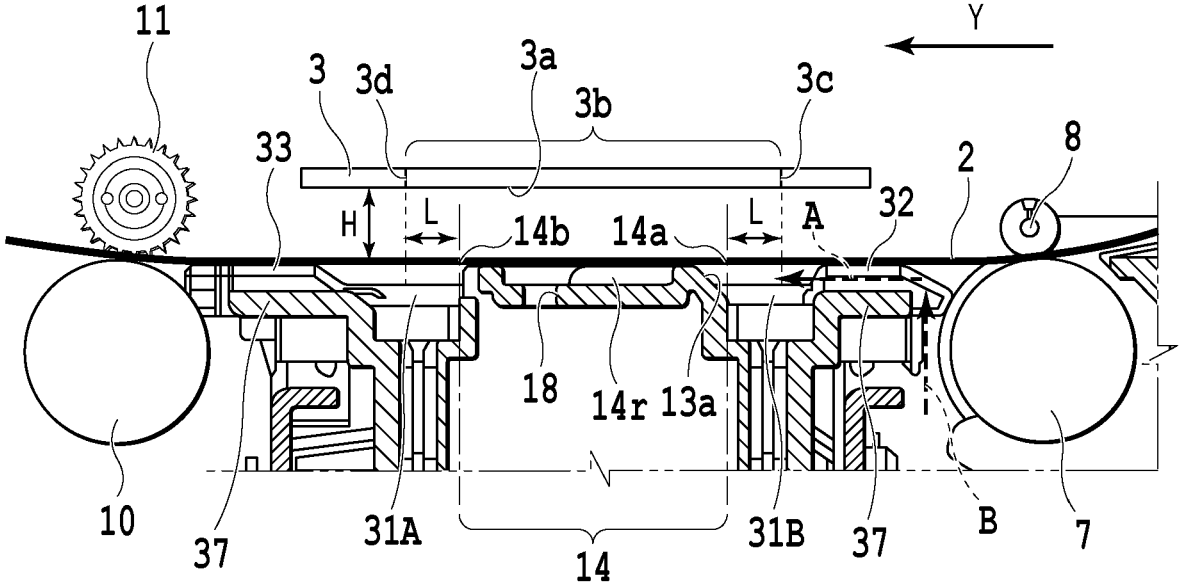
FIG. 10 is another vertical side view partly showing the platen.

FIG. 10 is a vertical side view showing an air channel disposed at the upstream and downstream sheet supporting portions 32 and 33. The upstream sheet supporting portion 32 for supporting the sheet conveyed by the conveyance roller 7 at the reverse thereof is formed at the platen 9 further upstream of the trailing end ink discarding groove 31B. In addition, the downstream sheet supporting portion 33 for supporting the sheet conveyed by the discharge roller 10 at the reverse thereof is formed at the platen 9 further downstream of the leading end ink discarding groove 31A. The upstream sheet supporting portion 32 and the downstream sheet supporting portion 33 each are ribbed projections extending in the sheet conveyance direction (i.e., the Y direction). The plurality of upstream sheet supporting portions 32 and the plurality of downstream sheet supporting portions 33 are arranged at predetermined intervals in the X direction, as shown in FIG. 6.

The top of each of the upstream sheet supporting portion 32 and the downstream sheet supporting portion 33 is formed in the same height as that of the sheet supporting surface (i.e., a contact portion) 13 of the sheet supporting portion 14. The upstream sheet supporting portion 32 and the downstream sheet supporting portion 33 fulfill the function of preventing the sheet 2 from denting or being involved at the sheet supporting portion 14 or each of the rollers in a case where the fore or trailing end of the sheet 2 passes there.

In the meantime, the adjacent upstream sheet supporting portions 32 are connected to each other via a connection seat 37 at the lower portions thereof (see FIGS. 6 and 10). A clearance is formed between a passing sheet and the connection seat 37 (see FIG. 10). In the same manner, the adjacent downstream sheet supporting portions 32 are connected to each other via the connection seat 37. A clearance is formed between the sheet 2 supported by the downstream sheet supporting portions 32 and the connection seat 37. Therefore, as indicated by a broken arrow A in FIG. 10, an air channel is formed in such a manner as to introduce fresh air from the outside of the platen 9 toward the ink discarding groove 31B. Furthermore, a notch 39 is formed at a part of the connection seat 37, as shown in FIG. 6, and therefore, an air channel for enabling air to flow in also is formed in a direction perpendicular to the reverse of the sheet, as indicated by a broken arrow B. In general, since the conveyance roller 7 is a cylindrical roller in which the entire surface thereof is covered with rubber or coating particles in most cases, a closed space is liable to be defined by the sheet 2 to be conveyed, the conveyance roller 7, the connection seal 37 of the platen 9. However, the formation of the notch 39 for enabling the air to flow in defines a clearance between the sheet 2 and the upstream sheet supporting portion 32, thus enabling a greater quantity of fresh air to be supplied toward the ink discarding grooves 31A, 31B, and 34 at the platen 9. Consequently, even if ink mist generated during an ejecting operation by the printhead floats or diffuses inside of the ink discarding grooves, the density of the ink mist is reduced by the fresh air flowing in from the outside, thereby reducing the quantity of ink mist adhering to the reverse of the sheet 2.

2.4 Positional Relationship Between Printhead and Sheet Supporting Portion

Figure 11:
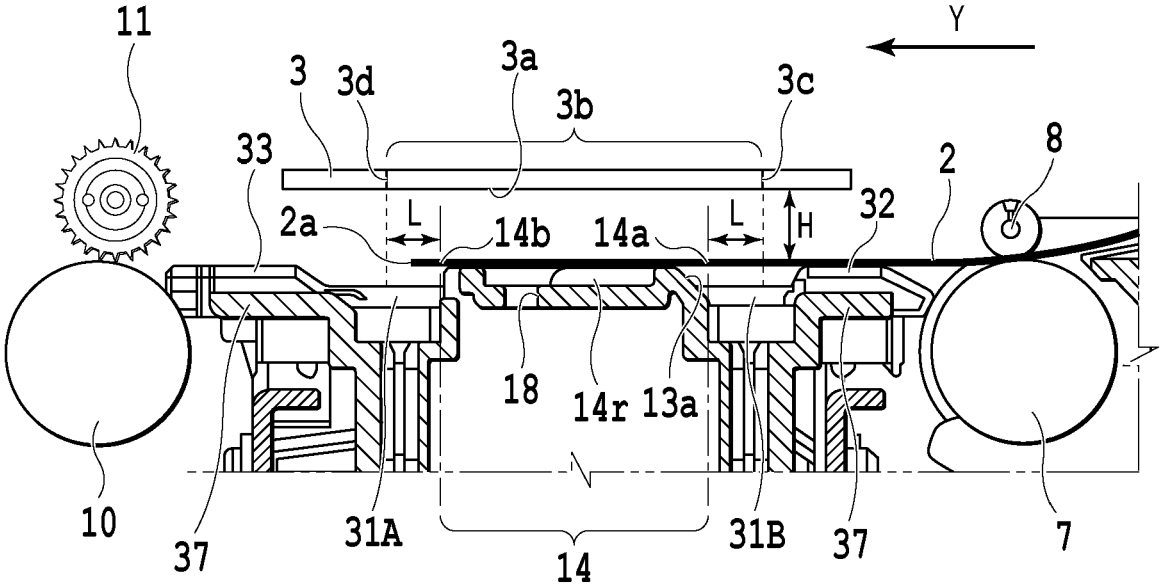
FIG. 11 is a further vertical side view partly showing the platen.
Figure 12:
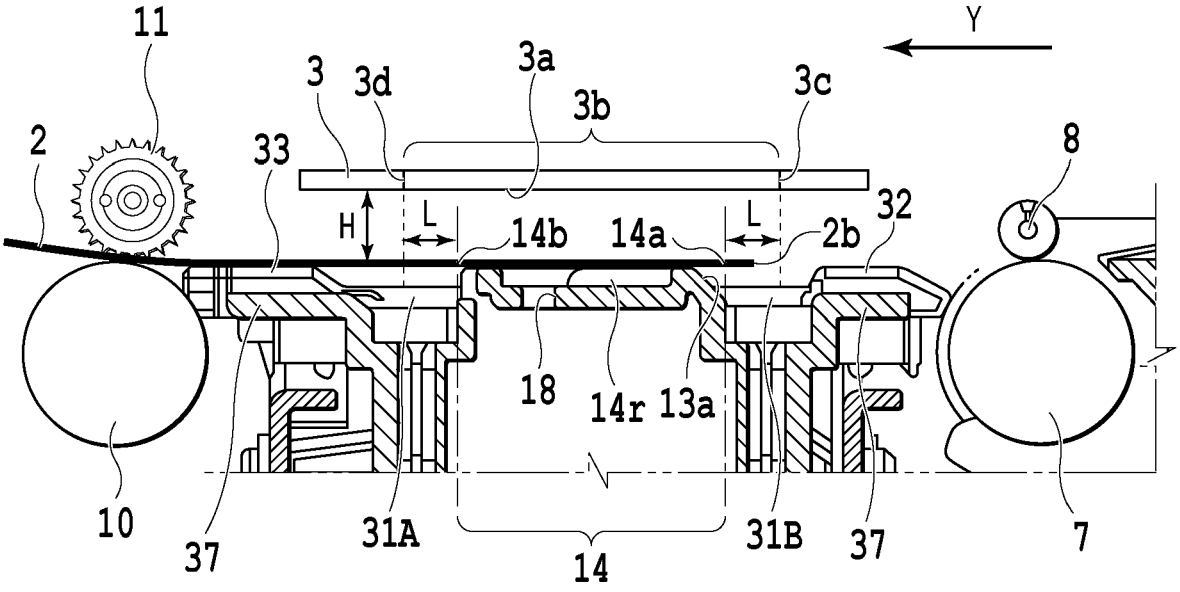
FIG. 12 is a still further vertical side view partly showing the platen.

FIG. 11 is a view showing the positional relationship between the ejection port of the printhead 3 and the sheet supporting portion 14 at the beginning of the printing operation. FIG. 12 is a view showing the positional interrelationship between the trailing end of the sheet 2, the ejection port of the printhead 3, and the sheet supporting portion 14 at the end of the printing operation.

As shown in FIG. 11, the sheet 2 is conveyed up to a position at which the sheet supporting surface 13 is completely covered at the beginning of the printing operation. The sheet supporting surface 13 is completely covered with the sheet 2, so that a stable negative pressure can be generated at the suction recess 17. Since the sheet can be sucked even if the sheet 2 is slightly misaligned, the sheet is conveyed up to a position slightly off the sheet supporting portion 13.

In the printing apparatus of the serial type, the length of an ejection port array having a plurality of ejection ports arrayed thereat is determined as follows: namely, as shown in FIGS. 11 and 12, an ejection port array 3*b* of the printhead 3 is formed within a range completely encompassing the sheet supporting portion 14 in the sheet conveyance direction (i.e., the Y direction). Consequently, a most upstream ejection port 3*c* at the ejection port array 3*b* is positioned outside (i.e., upstream) of an upstream end 14*a* of the sheet supporting portion 14 whereas a most downstream ejection port 3*d* is positioned outside (i.e., downstream) of a downstream end 14*b* of the sheet supporting portion 14.

In the case of the marginless printing in which an image is formed over the entire sheet without any margins at the fore and trailing ends of the sheet 2, the sheet 2 is conveyed in such a manner that a leading end 2*a* or a trailing end 2*b* is slightly off the sheet supporting portion 14. As a consequence, the most downstream ejection port 3*d* of the printhead 3 is required to be positioned slightly downstream of the leading end 2*a* of the sheet 2 during printing at the leading end 2*a* of the sheet 2 (FIG. 11). In contrast, the most upstream ejection port 3*c* of the printhead 3 is required to be positioned slightly upstream of the trailing end 2*b* of the sheet 2 during printing at the trailing end 2*b* of the sheet 2 (FIG. 12). Strictly speaking, it is preferable that an off amount L should be determined in consideration of a dimension at which no margin is produced in expectation of the stoppage position accuracy or dimensional tolerance of the fore or trailing end of the sheet 2. An off amount L of about 2 mm is normally set.

In summary, the relationship between the sheet supporting portion 14 and the ejection ports of the printhead 3 is required to be determined, as follows: namely, the upstream end 14*a* of the sheet supporting portion 14 is positioned downstream of the most upstream ejection port 3*c* of the printhead 3 in the sheet conveyance direction whereas the downstream end 14*b* of the sheet supporting portion 14 is positioned upstream of the most downstream ejection port 3*d* of the printhead 3. In this manner, the ink can be ejected up to a range slightly off the fore and trailing ends 2*a* and 2*b* of the sheet 2, so that the marginless printing can be securely performed at the fore and trailing ends 2*a* and 2*b* of the sheet 2.

In performing the marginless printing at the ends (i.e., the right and left ends) in the sheet widthwise direction, the sheet 2 is supported by the sheet supporting portion 14 disposed in a slightly narrower range than the size of the sheet 2 to be printed. And then, the scanning range of the printhead 3 is determined such that the ink is ejected up to a range slightly off outward (i.e., sideways) of the sheet 2. In this manner, the marginless printing can be performed at the right and left ends of the sheet 2.

3. Sheet Sucking Mechanism

Figure 13:
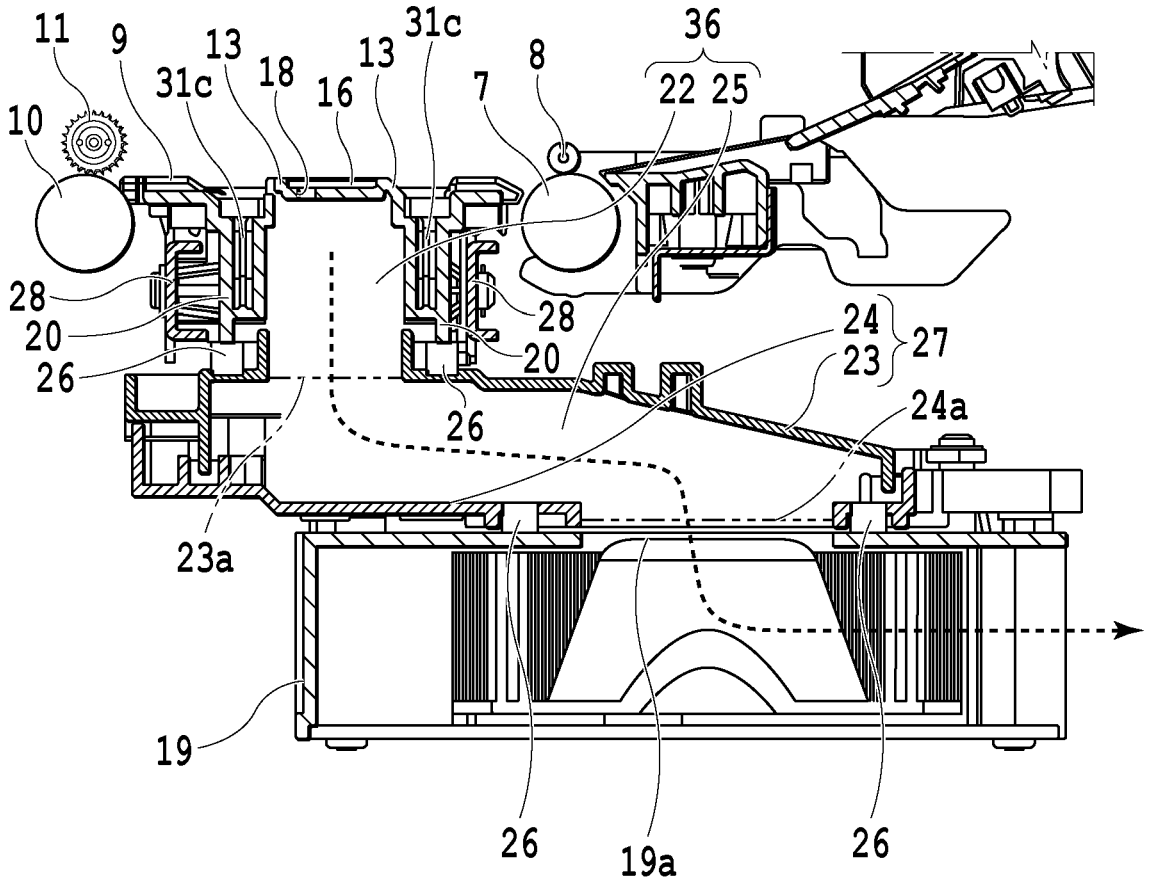
FIG. 13 is a vertical side view showing a sheet sucking mechanism.
Figure 14:
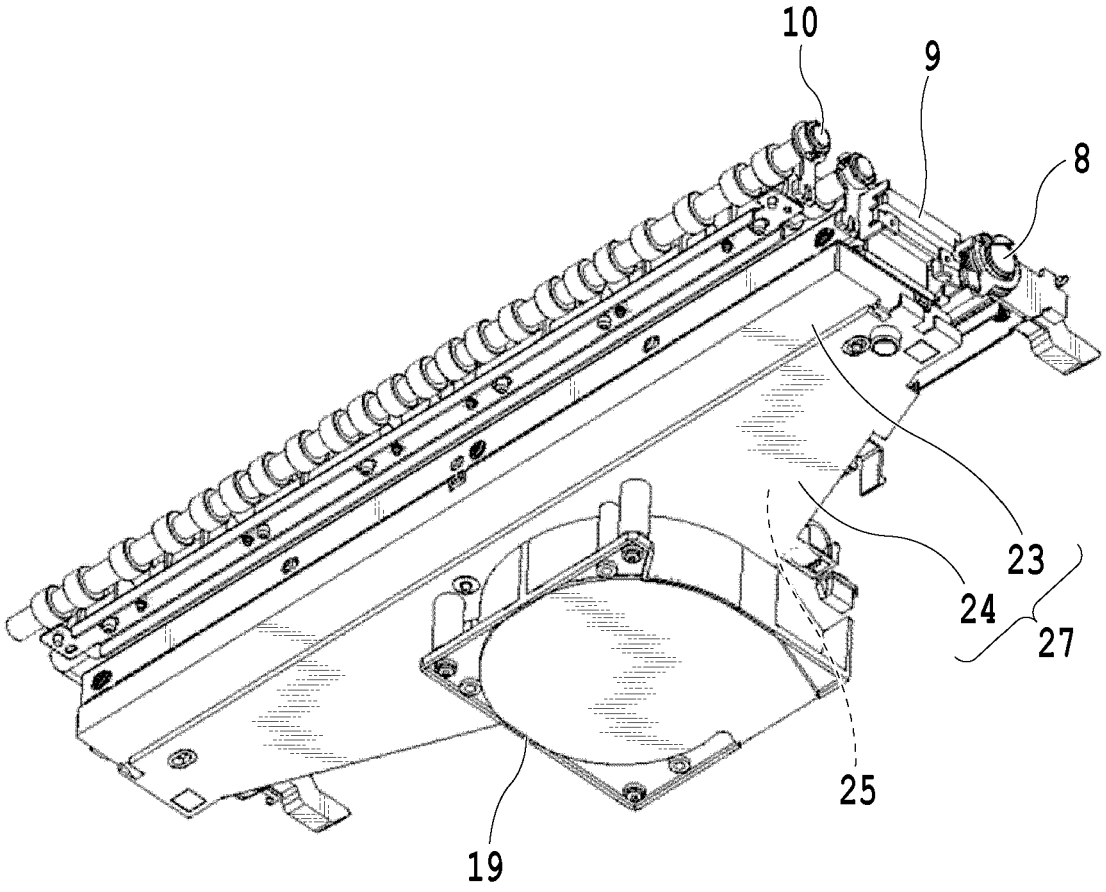
FIG. 14 is a perspective view showing the sheet sucking mechanism, as viewed from the bottom.

FIG. 13 is a vertical side view showing a sheet sucking mechanism disposed in the printing apparatus; and FIG. 14 is a perspective view showing the sheet sucking mechanism, as viewed from the bottom. The sheet sucking mechanism includes the platen 9, a duct 27 communicating with the suction holes 18 formed at the platen 9, and the negative pressure generator communicating with the duct 27.

The duct 27 having a cavity therein is formed right under the platen casing formed of the outer peripheral walls 20 of the platen 9, wherein the duct 27 includes a cover member 23 having a first opening 23*a* formed at the upper surface thereof and a base member 24 having a second opening 24*a* formed at the lower surface thereof. The upper surface of the cover member 23 engages with the bottom of the outer peripheral walls 20 of the platen 9 in such a manner as to include the first opening 23*a*. In contrast, the second opening 24*a* formed at the lower surface of the base member 24 engages with a suction port 19*a* of a suction fan 19 serving as the negative pressure generator. In this manner, an intake channel 36 is formed from the suction holes 18 formed at the platen 9 toward the suction fan 19. The intake channel 36 includes a first negative pressure chamber 22 corresponding to a space inside of the platen casing defined by the outer peripheral wall 20 of the platen 9 and a second negative pressure chamber 25 formed inside of the duct 27 including the base member 24 and the cover member 23. Here, the base member 24 forming the duct 27 is fixed to a chassis 28.

The first negative pressure chamber 22 is divided into a plurality of small spaces independent of each other in the sheet widthwise direction in a manner corresponding to the plurality of sheet supporting portions 14. FIG. 13 shows one small space. The first negative pressure chamber 22 and the second negative pressure chamber 25 are partitioned by the cover member 23. The common second negative pressure chamber 25 communicates with the plurality of first negative pressure chambers 22 via the openings 23*a* of the small spaces.

A seal member 26 for preventing any leakage of air is disposed at each of an engagement portion between the upper surface of the cover member 23 and the bottom of the outer peripheral wall 20 of the platen 9 and an engagement portion between the second opening 24*a* of the base member 24 and the suction port 19*a* of the suction fan 19. It is preferable that the seal member 26 should be formed of soft expanded rubber or the like that has high sealability and is made of EPDM such that the platen 9 or the cover member 23 cannot be deformed by the repulsive force of the seal member 26 at the time of compression. The seal member 26 is interposed between members, thus suppressing the transmission of vibrations caused by driving the suction fan 19 to the platen 9 while keeping the sealability between the members so as to suppress an adverse effect on the printing operation.

The waste ink discharge port 30 at the platen 9 is disposed on the outer peripheral wall 20 of the platen 9, and therefore, the duct 27 disposed right under the platen 9 can occupy the space right under the platen 9 without any inhibition of the arrangement of the waste ink discharge port 30. Consequently, the second negative pressure chamber 25 of the duct 27 can secure a size enough to stabilize the negative pressure generated by the rotation of the suction fan 19, thereby remarkably enhancing the freedom degree of a design.

It is preferable that the suction fan 19 serving as the negative pressure generator should be a sirocco fan or the like having an excellent suction efficiency. The suction air rate of the suction fan 19 can be adjusted under a PWM control. The air rate is variable according to the type, state, and use atmospheric environment of sheet, thereby adjusting the suction of the sheet.

With the above-described configuration, the suction fan 19 is rotated to discharge the air staying inside of the duct 27, thus bringing the entire intake channel 36 into a negative pressure state, so as to suck the air through the suction holes 18 communicating with the duct 27.

Incidentally, the platen 9 is molded with a resin into a single component part. All of the sheet supporting portion 14, the upstream sheet supporting portion 32, the downstream sheet supporting portion 33, the plurality of the first negative pressure chambers 22, and the ink receivers (i.e., the first to third ink receivers) are aggregated into a single resin-molded component part that forms the platen 9. In this manner, it is possible to simplify the fabrication of the printing apparatus, and furthermore, enhance the accuracy of relative positions among functional component parts.

4. Sheet Offset

Figure 15:
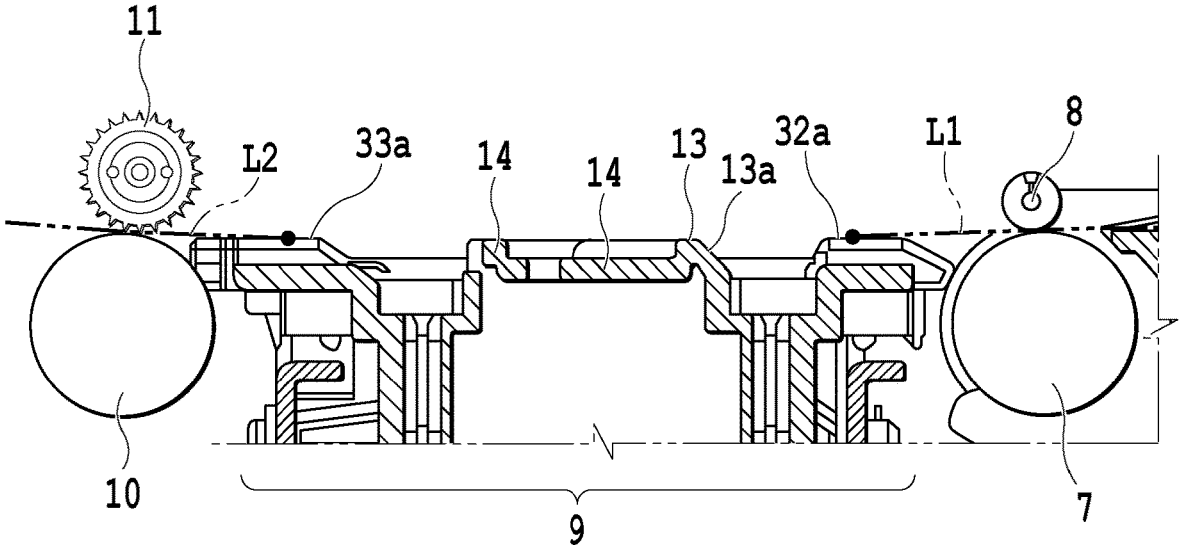
FIG. 15 is a vertical side view showing a first conveyance roller pair, a second conveyance roller pair, and the platen.

FIG. 15 is a vertical side view showing the first conveyance roller pair, the second conveyance roller pair, and the platen 9. The conveyance roller 7 and the pinch roller 8 forming the first conveyance roller pair are arranged in such a manner that a conveyance roller nip tangent L1 passing a contact point between both of the rollers crosses the sheet supporting surface 32*a* of the upstream sheet supporting portion 32. Since the first conveyance roller pair is arranged in the above-described manner, the leading end of the sheet conveyed up to a print start position can be securely brought into contact with the sheet supporting surface 13 of the sheet supporting portion 14. As a consequence, it is possible to efficiently generate a negative pressure so as to further securely suck the sheet.

In the same manner, the discharge roller 10 and the pulley 11 forming the second conveyance roller pair are arranged in such a manner that a discharge roller nip tangent L2 passing a contact point therebetween crosses the sheet supporting surface 33*a* of the downstream sheet supporting portion 33. Since the second conveyance roller pair is arranged in the above-described manner, the trailing end of the sheet can be brought into contact with the sheet supporting surface 13 at the last moment even after the printing operation, thus keeping a posture in the efficiently sucked state for a longer period of time.

As described above, the fore and trailing ends of the sheet 2 can be efficiently sucked by the sheet supporting surface 13 of the platen 9 in the present embodiment, and thus, the floating of the sheet can be reduced over the entire sheet from the leading end to the trailing end.

5. Control Circuit

Figure 16:
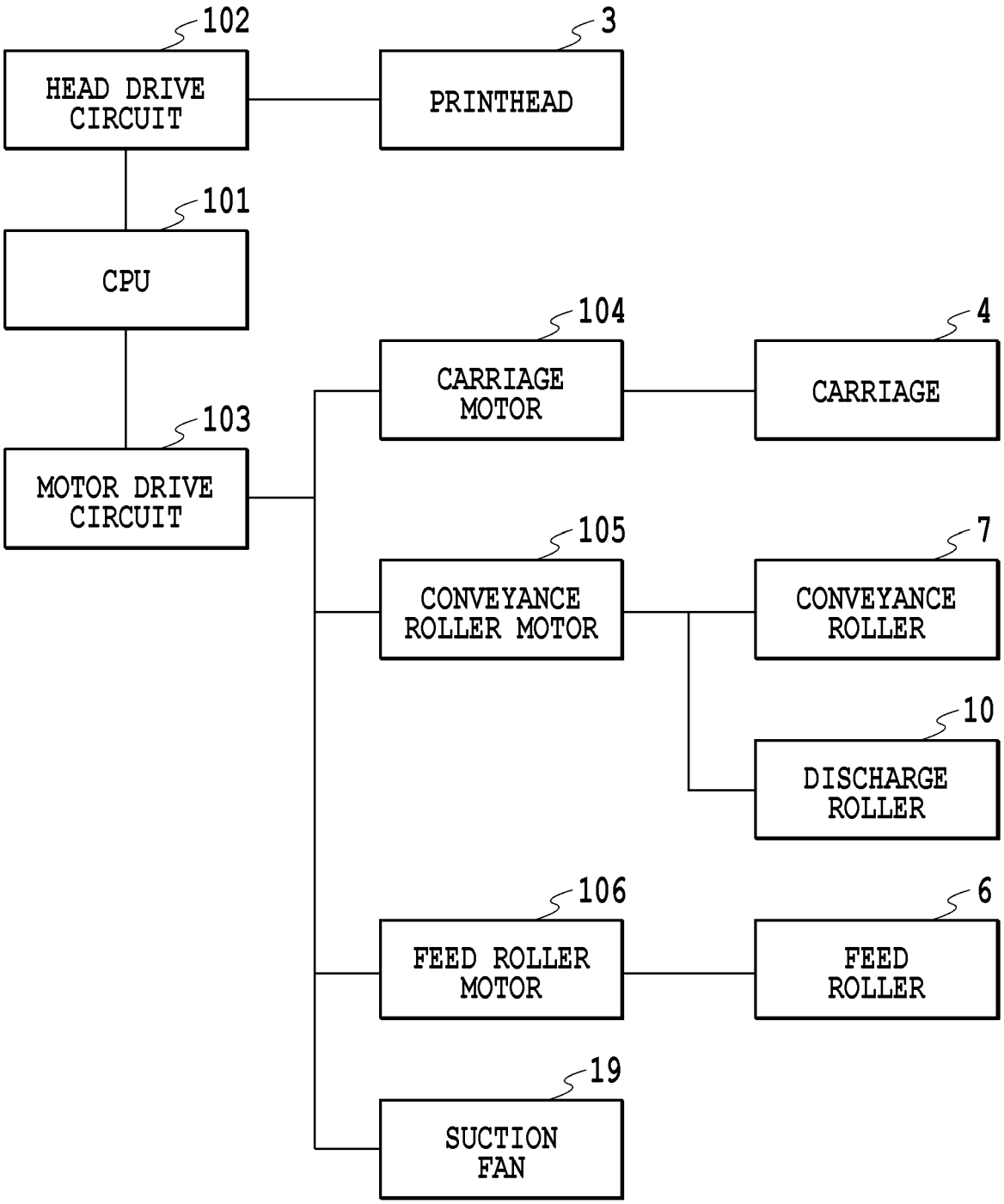
FIG. 16 is a block diagram illustrating the configuration of a control system in the printing apparatus.

FIG. 16 is a block diagram illustrating the schematic configuration of a control system of the printing apparatus 1 in the present embodiment. To a CPU 101 is connected a head drive circuit 102 for controlling the ink ejection by the printhead 3. Furthermore, to the CPU 101 is connected a motor drive circuit 103 for controlling motors for actuating the mechanisms (a carriage motor 104, a conveyance roller motor 105, a feed roller motor 106, the suction fan 19, etc.) and the like.

The motor drive circuit 103 can perform the PWM control, thus adjusting the air rate of the suction fan 19 so as to adjust the suction negative pressure at the sheet sucking mechanism. A change in air rate according to the type of sheet, the state of a sheet, and an atmospheric environment condition is effective in adjusting sheet conveyance performance. The air rate may be changed according to the position of the carriage 4 and the sheet conveyance position.

6. Printing Operation

Figure 17:
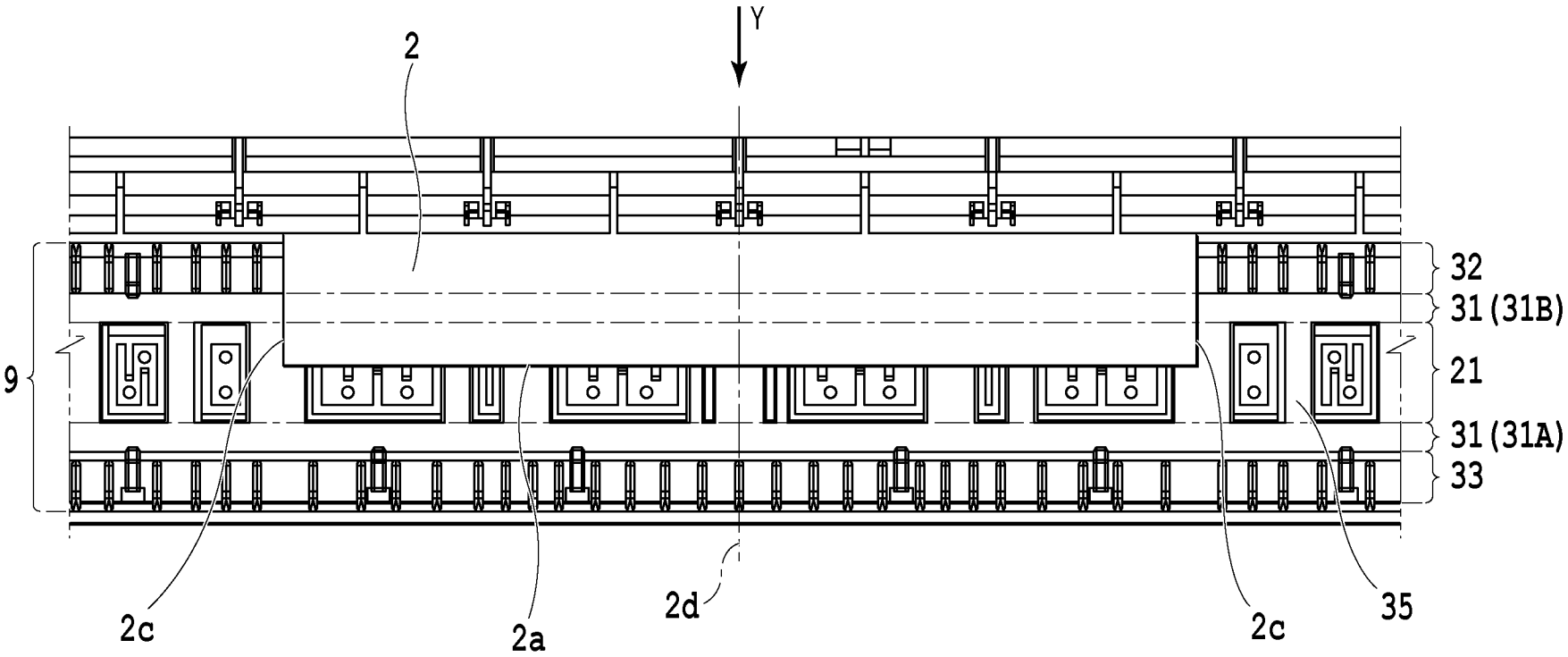
FIG. 17 is a plan view showing a state in which the leading end of a sheet passes over the sheet supporting portion.

FIG. 17 is a plan view showing a state in which the leading end of the sheet 2 passes over the sheet supporting portion 14 during the feeding operation by the feeder 40.

The sheet 2 stacked on the feed tray 5 is fed up to the conveyance roller 7 by the above-described feeder 40, and furthermore, is conveyed up to the platen 9 by the conveyance roller 7. Here, the suction fan 19 is started during the feeding of the sheet 2, and thus, a predetermined negative pressure is generated at the duct 27 communicating with the suction holes 18 formed at the platen 9. The strength of the negative pressure is controlled under the conditions such as the type of sheet, the state of the sheet, and the atmospheric environment. It is preferable that a stronger negative pressure (i.e., a stronger suction pressure) should be generated in the case of the use of a thick sheet or a largely curled sheet or in low humidity. The negative pressure is controlled by the motor drive circuit 103 for controlling the drive of the suction fan 19. Various kinds of control systems may be used. For example, the PWM control or the like may be used.

Figure 18:
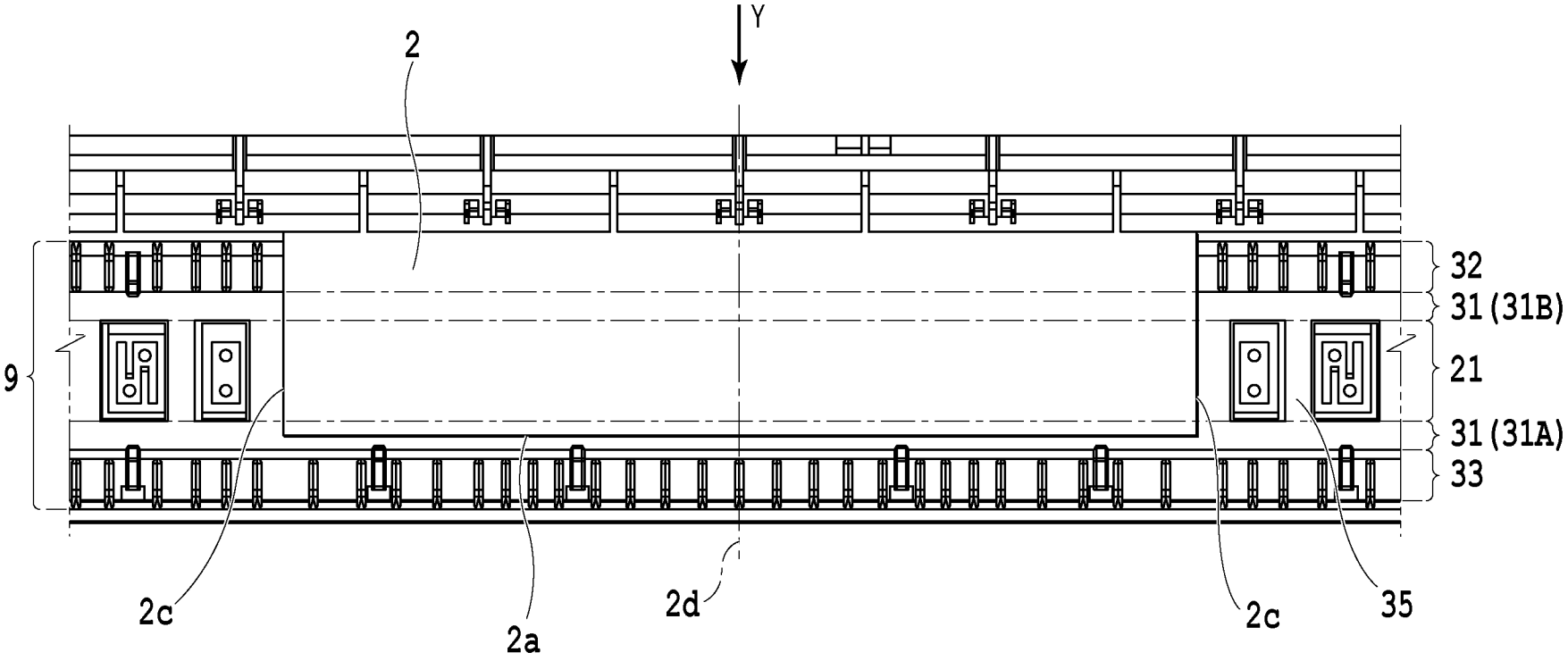
FIG. 18 is a plan view showing the position of the sheet immediately before the start of printing.

Prior to the start of the printing operation, the sheet 2 is conveyed up to a position shown in FIG. 18. That is to say, the leading end 2*a* of the sheet reaches the sheet supporting portion 14 beyond the ink discarding groove 31 of the upstream sheet supporting portion 32, and then, is conveyed up to a position slightly off the downstream end 14*b*, where the conveying operation is temporarily stopped. At this time, the sheet 2 comes to a state sucked by the sheet supporting surface 13. During the conveying operation until the sheet 2 comes to the state, the negative pressure is generated inside the suction recess 17, and therefore, the leading end 2*a* of the sheet 2 is conveyed toward the supporting surface 13 while being sucked. Consequently, the floating of the leading end 2*a* of the sheet 2 can be suppressed until the sheet 2 is conveyed up to the position shown in FIG. 18. FIG. 18 shows the position of the sheet 2 immediately before the printing operation is started. Incidentally, sufficient suction force cannot be exerted on the sheet 2 until the sheet 2 covers the sheet supporting surface 13. However, the sheet 2 is conveyed in the state in which the floating of the leading end 2*a* is suppressed, and therefore, the sheet 2 can be smoothly conveyed up to a header position. In addition, an inclined face 13*a* (FIG. 7) for guiding the leading end 2*a* of the sheet 2 toward the sheet supporting surface 13 is formed at the upstream end of the sheet supporting portion 14. Thus, even if the leading end 2*a* of the sheet 2 almost falls downward in a case where the leading end 2*a* of the sheet 2 passes the ink discarding groove 31B, the leading end 2*a* is guided to the sheet supporting surface 13 due to the contact with the inclined face 13*a*, and therefore, the leading end 2*a* of the sheet 2 can smoothly pass the ink discarding groove 31B.

In the state in which the sheet 2 is fed up to the header position, the printhead 3 performs reciprocal scanning based on image data, thereby starting the printing operation. In the case of the marginless printing with respect to the leading end 2*a* of the sheet 2, an image is printed on the sheet 2, and furthermore, the ink is ejected up to a region outside (i.e., downstream) of the leading end 2*a* of the sheet 2. The ink ejected to the region outside of the sheet 2 is discarded into the ink absorber inside of the trailing end ink discarding groove 31B positioned downstream of the sheet supporting portion 14. Upon the completion of the marginless printing with respect to the leading end 2*a* of the sheet 2, the printing operation is continued by repeating the conveyance of the sheet 2 by the conveyance roller 7 and the discharge roller 10 and the reciprocal scanning by the printhead 3.

Figure 19:
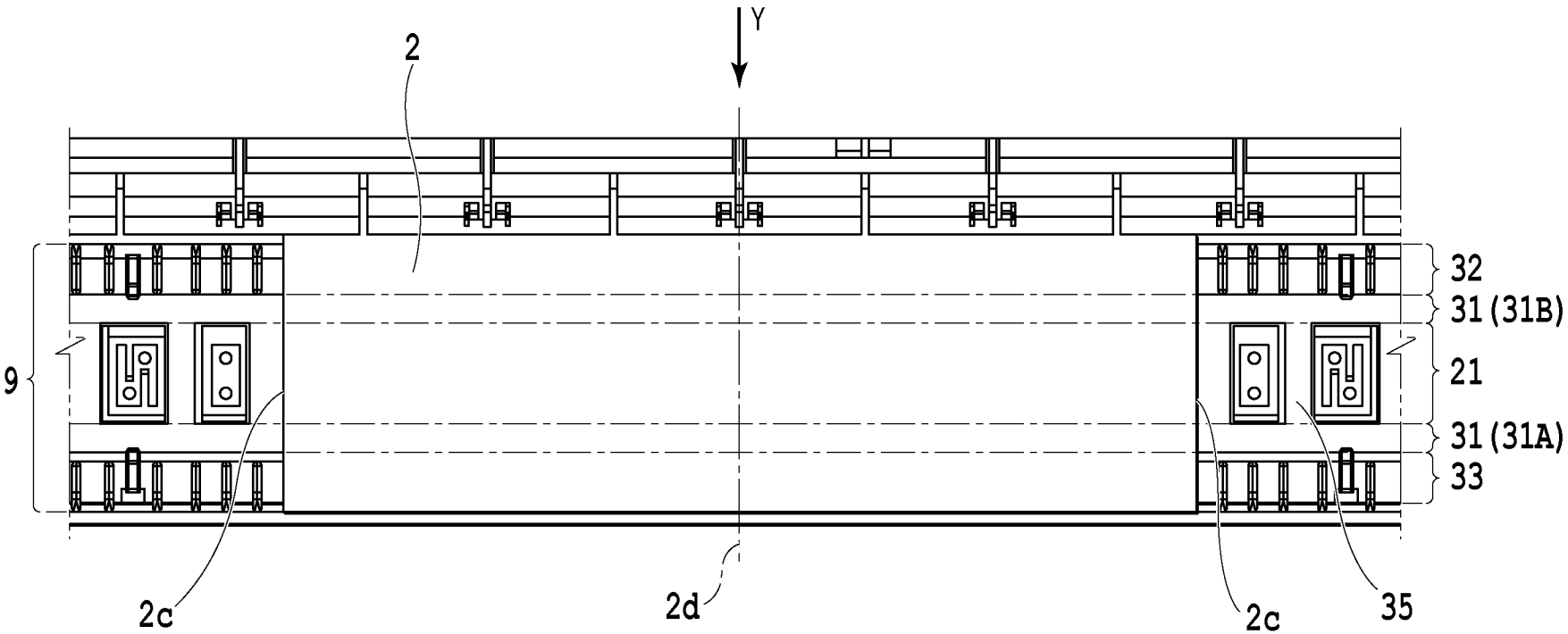
FIG. 19 is a plan view showing a state in which the middle portion of the sheet is printed.

FIG. 19 is a view showing a state in which the middle portion of the sheet 2 is printed. In a case where the marginless printing is performed with respect to the right and left ends of the sheet 2, the ink is ejected not only on the sheet 2 but also regions outside of the right and left ends of the sheet 2. The platen 9 also has the right/left end ink discarding grooves 34 corresponding to the positions of the right and left ends of the sheet 2. The ink ejected outside of the right and left ends of the sheet 2 is discarded into the ink absorber 35 inside of the right/left end ink discarding groove 34 positioned outside of the right and left ends of the sheet 2. The ink mist generated at this time is thinned with the fresh air introduced through the air channels formed upstream and downstream of the platen 9, thus reducing the adhesion of the ink mist onto the reverse of the sheet.

Figure 20:
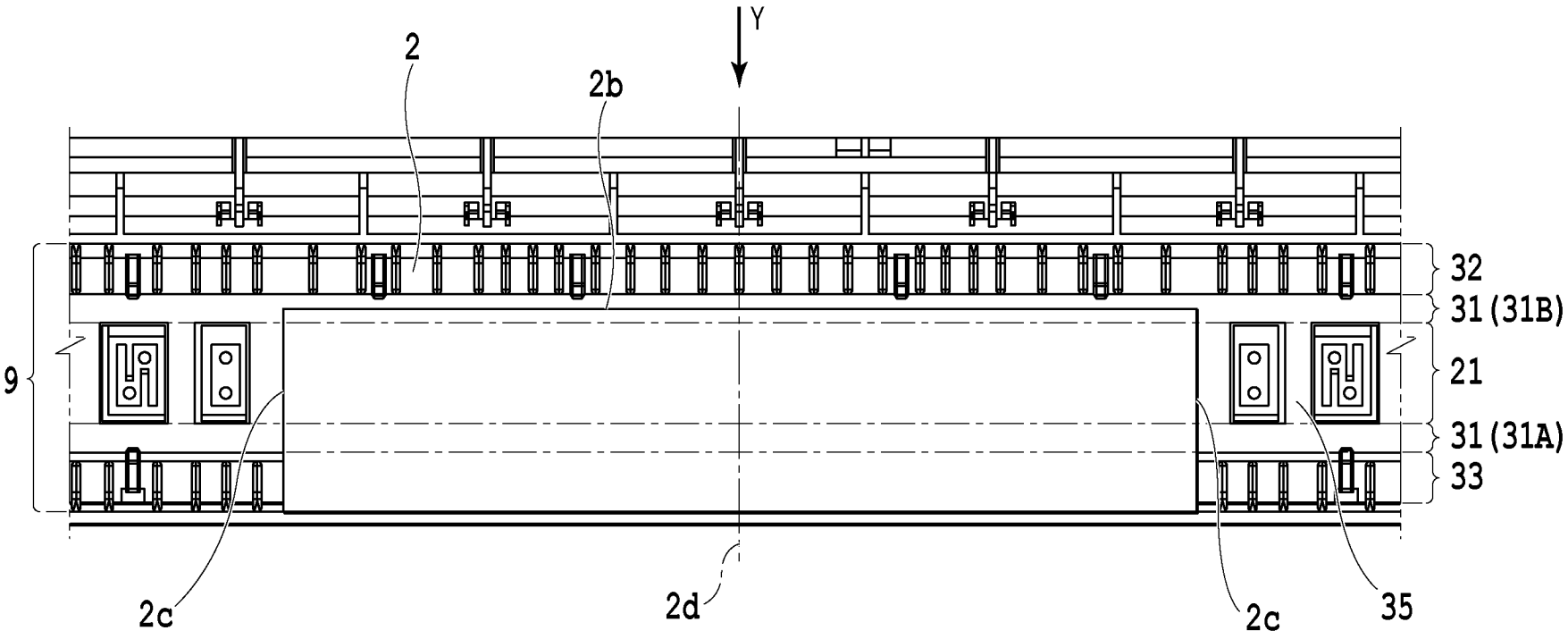
FIG. 20 is a plan view showing a state immediately before the start of printing at the trailing end of the sheet.

The printing operation is further continued, and then, the trailing end 2*b* of the sheet 2 passes through the first conveyance roller pair (i.e., between the conveyance roller 7 and the pinch roller 8), and thereafter, the sheet 2 is conveyed by the second conveyance roller pair (i.e., the discharge roller 10 and the pulley 11). As shown in FIG. 20, in a case where the trailing end 2*b* of the sheet 2 is conveyed up to a position at which the sheet 2 is slightly off upstream of the sheet supporting portion 14, the marginless printing is performed with respect to the trailing end 2*b* of the sheet 2. In the same manner as the marginless printing with respect to the leading end 2*a* of the sheet 2, the ink is ejected onto not only the sheet 2 but also a region outside (upstream) of the trailing end 2*b* of the sheet 2. The ink ejected to the region outside of the trailing end 2*b* of the sheet 2 is discarded into the ink absorber 35 (i.e., sponge) inside of the trailing end ink discarding groove 31B positioned upstream of the sheet supporting portion 14. In this manner, the printing operation with respect to the trailing end 2*b* of the sheet comes to an end in the state in which the sheet 2 is sucked by the sheet supporting surface 13.

As described above, the sheet 2 is placed on the sheet supporting surface 13 of the sheet supporting portion 14 all the time from the beginning of the printing operation to the end thereof. In view of this, a proper negative pressure is introduced into the suction recess 17, so that the printing operation can be performed in the state in which the sheet 2 is sucked by the sheet supporting surface 13 all the time. Thus, the distance H to the sheet (see FIG. 12) between the printhead 3 and the sheet 2 can be kept at a predetermined proper distance, thereby accurately printing an image. In addition, it is possible to reduce a smear on the sheet 2 caused by the adhesion of the ink mist.

Figure 21:
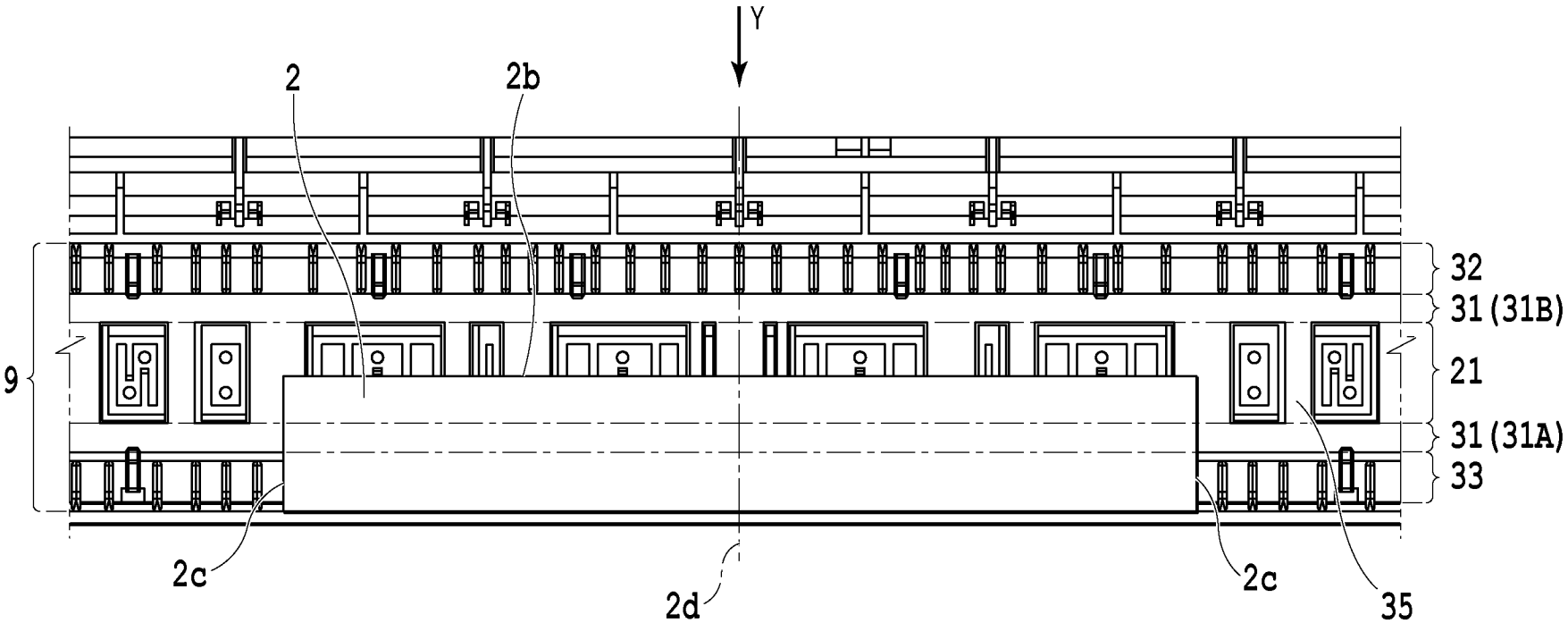
FIG. 21 is a plan view showing a state in which the trailing end of the sheet passes over the sheet supporting portion.

FIG. 21 is a plan view showing a state in which the trailing end 2*b* of the sheet 2 passes the sheet supporting portion 14. After the completion of the printing operation, the sheet 2 is conveyed by the second conveyance roller pair. At this time, the trailing end 2*b* of the sheet 2 passes the leading end ink discarding groove 31B while being supported by the downstream sheet supporting portion 33, and then, is discharged onto the discharge tray 12.

Even in the case of a border printing in which there are margins around an image on a sheet, the printing operation can be performed in the same process as the above-described process except the ink ejection to the outside of the sheet.

During the printing operation, the strength of the negative pressure to be generated by the suction fan 19 or the switch of drive or stop of the suction fan 19 is controlled under the print conditions, so that the proper suction force can be exerted on the sheet.

In the above-described embodiment, four-side marginless printing can be performed with respect to a cut sheet. The printing operation can be performed while suppressing the floating or flexure of the sheet and properly keeping the clearance between the printhead and the sheet. Thus, an image of a high quality can be achieved by the marginless printing.

(Second Embodiment)

Next, a description will be given below of a second embodiment according to the present invention. In the second embodiment, constituent elements identical or corresponding to those in the first embodiment are designated by the same reference numerals, and therefore, the explanation will be omitted.

Figure 22:
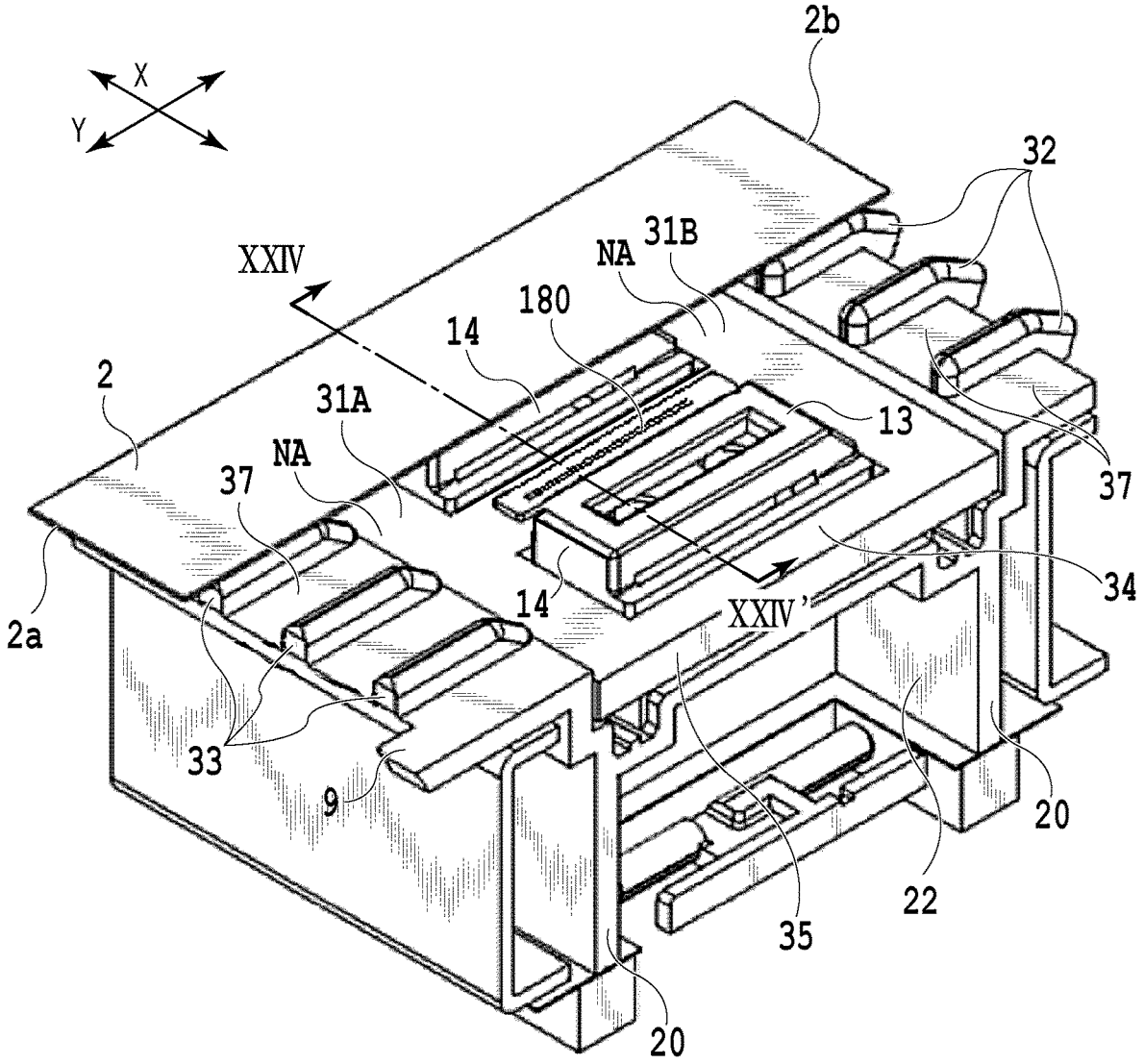
FIG. 22 is a perspective view partly showing a platen and a sheet in a second embodiment.
Figure 23:
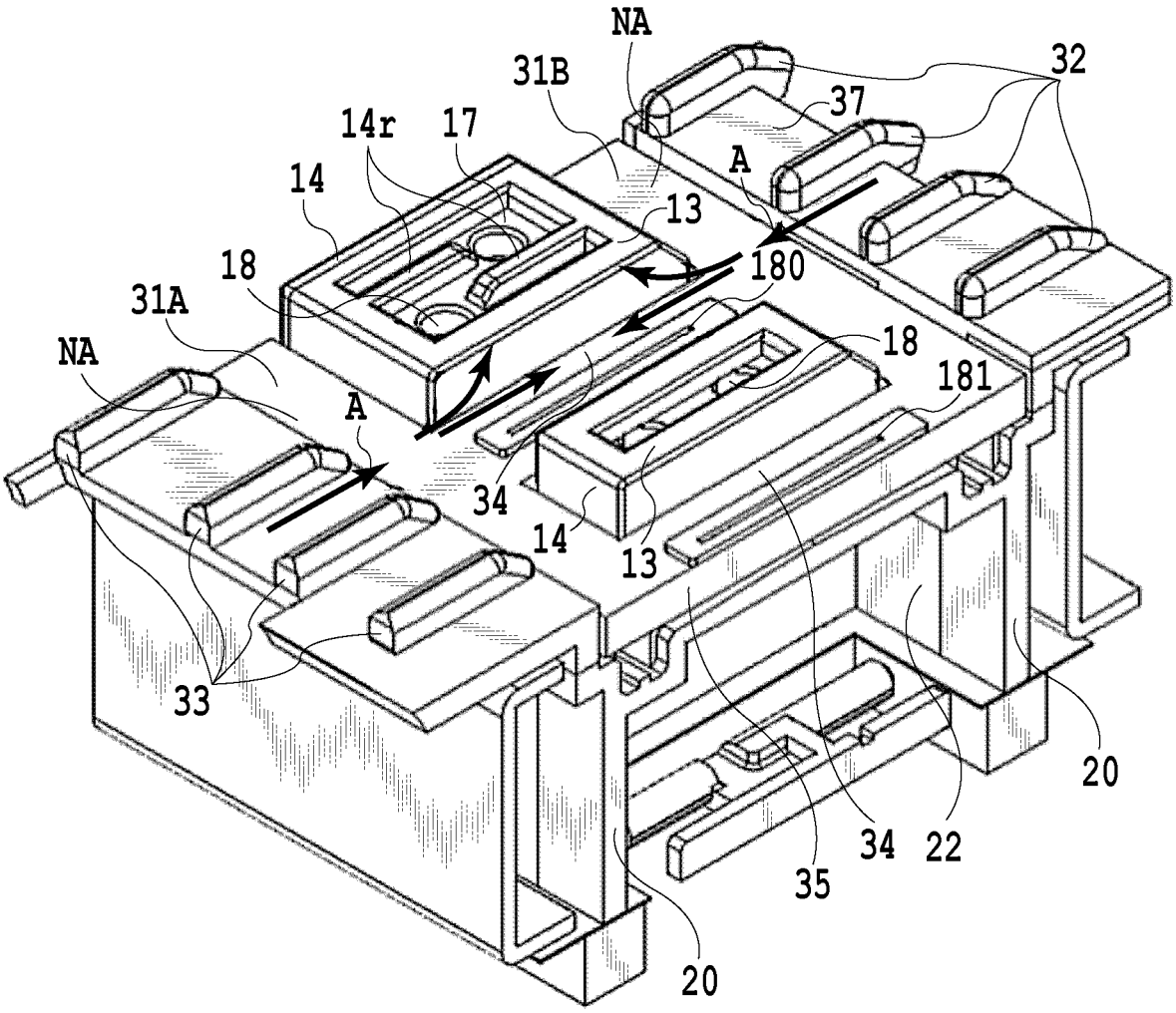
FIG. 23 is a perspective view showing an air flow at the platen shown in FIG. 22.

FIGS. 22 and 23 are enlarged perspective views showing the detailed shape of a sheet supporting portion 14 in the second embodiment. Here, FIG. 22 is a perspective view partly showing a platen and a sheet, and FIG. 23 is a perspective view showing an air flow at the platen shown in FIG. 22. The sheet supporting portion 14 is obtained by forming, into a rectangular frame, a ribbed projection having a flat sheet supporting surface 13 in contact with the reverse of a sheet. A suction recess 17 (i.e., a suction unit) is formed at the upper portion of the sheet supporting portion 14, thereby forming a recess lower by one step than the sheet supporting surface 13. Suction holes 18 (i.e., first suction holes) penetrating from the obverse of the suction recess 17 to the reverse thereof are formed at the suction recess 17. The suction holes 18 communicate with a negative pressure generator 19 via a plurality of first negative pressure chambers 22 defined by outer peripheral walls 20 of a platen 9 and a duct 27 connected to the first negative pressure chambers 22 (see FIGS. 13 and 14 in the first embodiment), thus applying a negative pressure generated by the negative pressure generator 19 to the first negative pressure chambers 22 and the suction holes 18.

In order to prevent a sheet from falling down at the suction recess 17, intermediate ribs 14*r* flush with the sheet supporting surface 13 are formed at the suction recess 17. It is desirable that the surface of the intermediate rib 14*r* should be continuous to the sheet supporting surface 13 and should extend in a sheet conveyance direction (i.e., a Y direction).

Around the sheet supporting portion 14 are formed ink receivers that receive ink ejected to the outside of a sheet 2. It is necessary to eject ink up to the outside of the end of the sheet so as to securely perform printing over the entire sheet without any margin at the peripheral edge of the sheet, that is, so-called marginless printing. In a printing apparatus of an inkjet system, in order to stabilize the ink ejection performance of a printhead 3, ink is ejected to the outside of the sheet immediately before a printing operation, that is, a so-called preliminary ejection is performed. The above-described ink ejected to the outside of the sheet is received in the ink receivers formed at the platen 9.

As shown in FIGS. 22 and 23, the ink receivers include a leading end ink discarding groove 31A that receives ink ejected to the outside of a sheet leading end 2*a* and a trailing end ink discarding groove 31B that receives ink ejected to the outside of a sheet trailing end 2*b*. The leading end ink discarding groove 31A is elongated in an X direction adjacently downstream of the sheet supporting portion 14 whereas the trailing end ink discarding groove 31B is elongated in the X direction adjacently upstream of the sheet supporting portion 14. Moreover, the ink receivers include right/left end ink discarding grooves 34 that receive ink ejected to the outside of right and left ends (sheet side ends) of the sheet 2 in a sheet widthwise direction. The right/left end ink discarding grooves 34 extend in the Y direction, and connect the upstream ink discarding groove 31B and the downstream ink discarding groove 31A.

In this manner, assuming that the marginless printing is performed on four sides of a cut sheet, there are provided the ink receivers including the leading end ink discarding groove 31A, the trailing end ink discarding groove 31B, and the right/left end ink discarding grooves 34. Each of the sheet supporting portions 14 is in a form of an individual island surrounded by the ink receivers.

An ink absorber 35 is disposed at each of the ink discarding grooves in the ink receiver so as to receive the ejected ink and hold the received ink without any leakage. It is preferable that the ink absorber 35 should be made of a spongy single sheet material such as expanded urethane. Since the ink absorber 35 is made of the above-described material having ink absorbency, the ink absorber 35 can securely receive the ink ejected by the printhead 3, and then, introduce the ink to an ink discharge port while being permeated with the received ink and holding it therein.

The ink discarded to the outside of the sheet 2 includes atomized ink mist floating in the air. In view of this, in order to suck and recover ink mist, a second suction hole 180 formed into a slit is formed at the bottom of the right/left ink discarding groove 34, as shown in FIGS. 22 and 23. The second suction hole 180 communicates with a suction fan 19 serving as the negative pressure generator via the first negative pressure chamber 22 and the duct 27 (see FIGS. 13 and 14). The mist is sucked through the second suction hole 180, and then, is recovered. The slit of the second suction hole 180 is elongated in the sheet conveyance direction. Unlike the suction hole 18 (i.e., the first suction hole) formed on the sheet supporting portion 14, the second suction hole 180 is formed at a position lower than the sheet supporting portion 14 (i.e., the ink receiver). The second suction hole 180 sucks air through a clearance defined between the sheet supported by the sheet supporting portion 14 and the ink receivers.

In FIGS. 22 and 23, upstream sheet supporting portions 32 that support the reverse of the sheet 2 conveyed by a conveyance roller 7 are formed further upstream of the trailing end ink discarding groove 31B at the platen 9. Downstream sheet supporting portions 33 that support the reverse of the sheet 2 conveyed by a discharge roller 10 are formed further downstream of the leading end ink discarding groove 31A at the platen 9. Each of the upstream sheet supporting portions 32 and downstream sheet supporting portions 33 is formed into a rib extending in the sheet conveyance direction (i.e., the Y direction). The plurality of upstream sheet supporting portions 32 and the plurality of downstream sheet supporting portions 33 are arranged at a predetermined interval in the X direction.

Assuming the plurality of sheet supporting portions 14 as "first supporting portions," the upstream sheet supporting portions 32 and the downstream sheet supporting portions 33 may be assumed as "second supporting portions." The second supporting portions are adapted to support the sheet in the sheet conveyance direction apart from the first supporting portions.

The upstream sheet supporting portions 32 and the downstream sheet supporting portions 33 are formed such that the tops thereof become flush with the sheet supporting surfaces (i.e., contact portions) 13 of the sheet supporting portions 14. The upstream sheet supporting portions 32 and the downstream sheet supporting portions 33 fulfill the functions of preventing the sheet 2 from falling or being involved and of forming a communication channel, described later, in a case where the fore or trailing end of the sheet 2 passes the sheet supporting portions 14 and the rollers.

Figure 25:
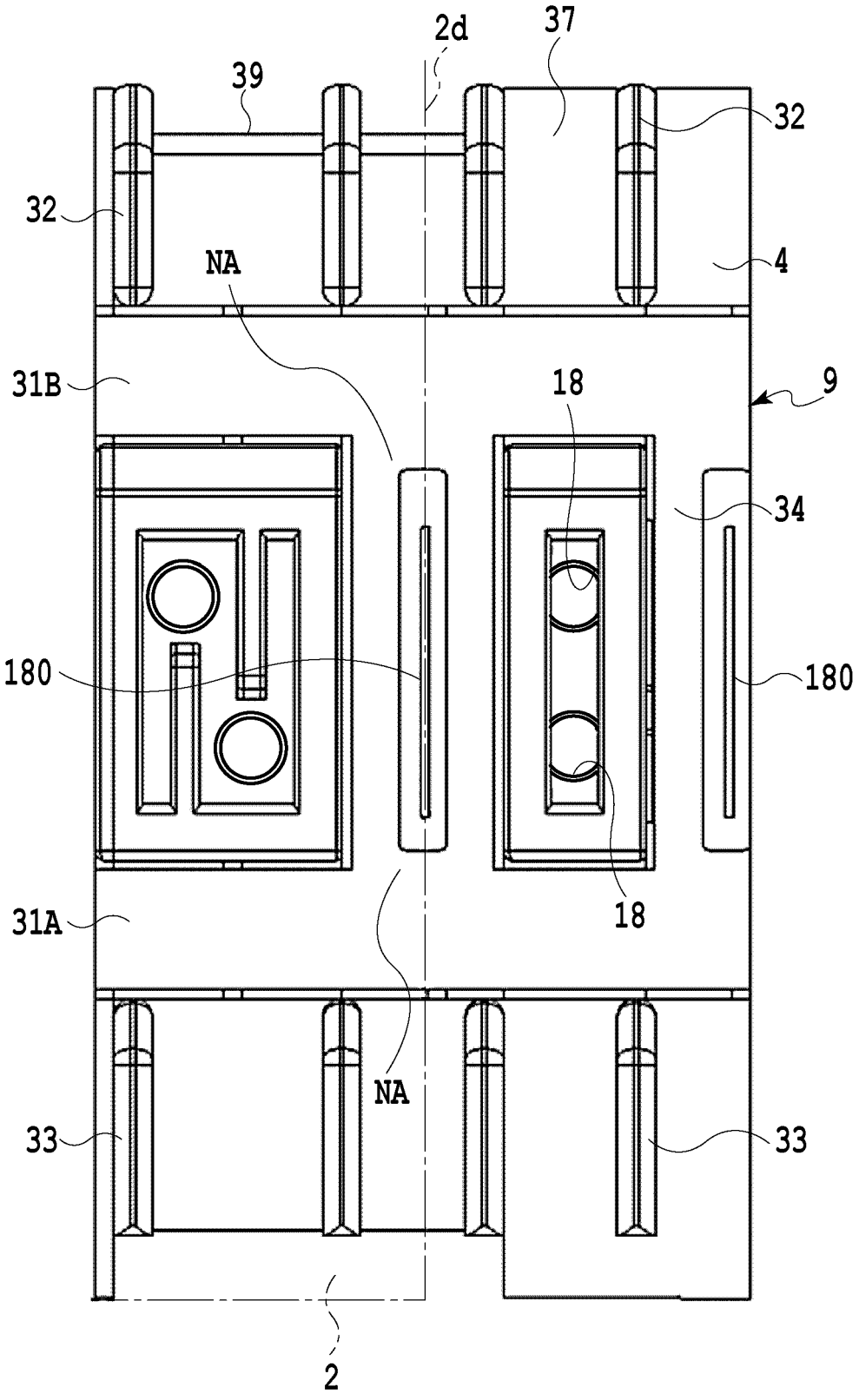
FIG. 25 is a plan view partly showing the platen shown in FIG. 24.

Moreover, in the plurality of upstream sheet supporting portions 32, the adjacent upstream sheet supporting portions 32 are connected to each other via a connection seat 37 at the lower portions thereof (see FIGS. 22, 23, and 25). A clearance is formed between a sheet and the connection seat 37. In the same manner, in the plurality of downstream sheet supporting portions 32, the adjacent downstream sheet supporting portions 32 are connected to each other via a connection seat 37. A clearance is formed between the sheet 2 supported by the downstream sheet supporting portions 32 and the connection seat 37.

Incidentally, the platen 9 is molded with a resin into a single component part. All of the sheet supporting portion 14, the upstream sheet supporting portion 32, the downstream sheet supporting portion 33, the first negative pressure chambers 22, and the ink receivers are aggregated into a single resin-molded component part that forms the platen 9. In this manner, it is possible to simplify the fabrication of the printing apparatus, and furthermore, to enhance the accuracy of relative positions among functional component parts.

Like in the first embodiment, the sheet 2 stacked on a feed tray 5 is fed to the conveyance roller 7 by a feeder 40 shown in the first embodiment, and furthermore, is fed up to the platen 9 by the conveyance roller 7. Here, the suction fan 19 is started during feeding the sheet 2 to generate a predetermined negative pressure at the duct 27 communicating with the suction holes 18 at the platen 9.

Prior to the start of the printing operation, the leading end 2*a* of the sheet 2 reaches the sheet supporting portion 14 beyond the ink discarding groove 31B adjacent to the upstream sheet supporting portions 32, and thereafter, is fed up to a position (i.e., a header position) slightly off a downstream end 14*b*. Since the negative pressure is generated inside of the suction recess 17 during this conveying operation, the leading end 2*a* of the sheet 2 is conveyed toward the supporting surface 13 while being sucked. Consequently, the floating of the leading end 2*a* of the sheet 2 can be suppressed.

In the state in which the sheet 2 is fed up to the header position, the printhead 3 performs reciprocal scanning based on image data, thereby starting the printing operation. In the case of the marginless printing with respect to the leading end of the sheet, an image is printed on the sheet 2, and furthermore, the ink is ejected up to a region outside (i.e., downstream) of the leading end of the sheet 2. The ink ejected to the region outside of the sheet 2 is discarded into the ink absorber 35 inside of the trailing end ink discarding groove 31 positioned downstream of the sheet supporting portion 14. After the completion of the marginless printing with respect to the leading end 2*a* of the sheet 2, the printing operation is continued by repeating the conveyance of the sheet 2 by the conveyance roller 7 and the discharge roller 10 and the reciprocal scanning of the printhead 3.

Figure 24:
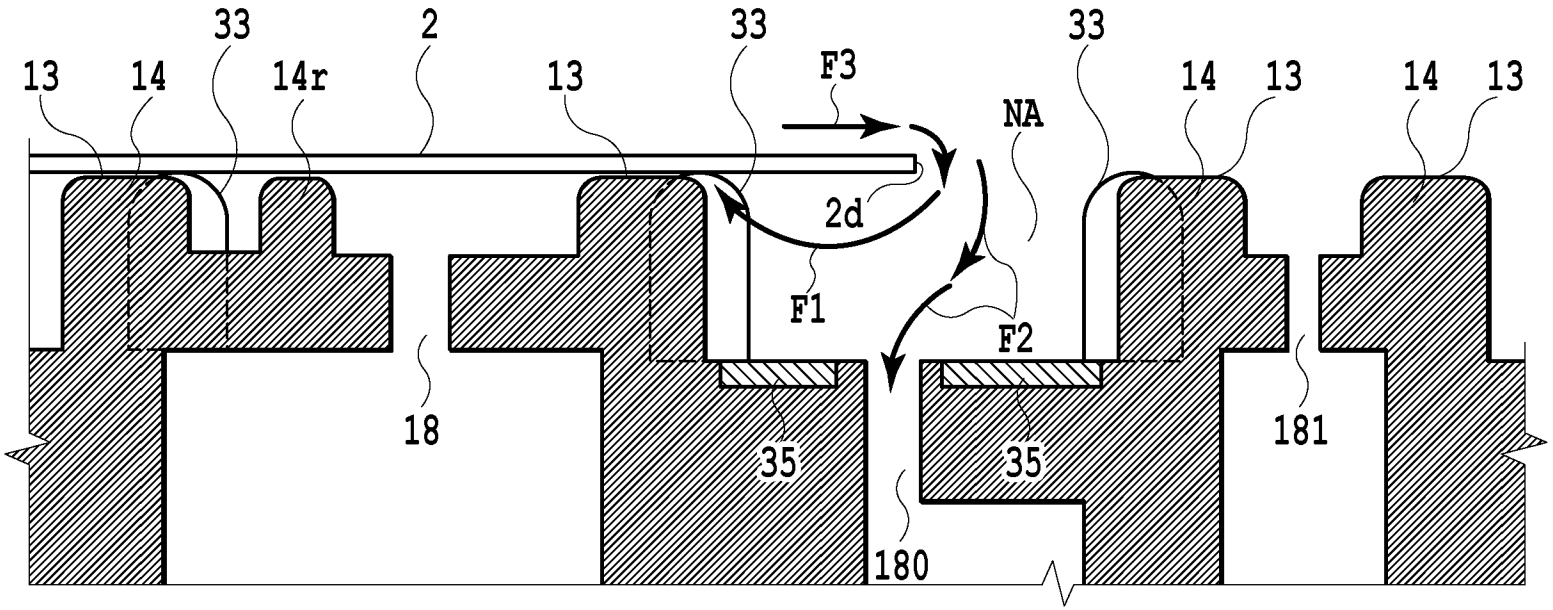
FIG. 24 is a cross-sectional view taken along a line XXIV-XXIV' of FIG. 22.

In a case where the marginless printing is performed with respect to the right and left ends of the sheet (i.e., the sheet side ends), the ink is ejected not only on the sheet 2 but also in regions outside of the right and left ends of the sheet 2 in a state shown in FIGS. 22 and 24. The platen 9 also has the right/left end ink discarding grooves 34 corresponding to the positions of the right and left ends of the sheet 2. The ink ejected to the outside of the right and left ends of the sheet 2 is discarded into the ink absorbers 35 in the right/left end ink discarding grooves 34 positioned outside of the right and left ends of the sheet 2.

The printing operation is further continued, and then, the trailing end of the sheet 2 passes through a first conveyance roller pair (i.e., the conveyance roller 7 and a pinch roller 8), and thereafter, the sheet 2 is conveyed by a second conveyance roller pair (i.e., the discharge roller 10 and a pulley 11). In a case where the trailing end 2*b* of the sheet 2 is conveyed up to a position at which the sheet 2 is slightly off upstream of the sheet supporting portion 14, the marginless printing is performed with respect to the trailing end 2*b* of the sheet 2. In the same manner as the marginless printing with respect to the leading end 2*a* of the sheet 2, the ink is ejected not only onto the sheet 2 but also in a region outside (upstream) of the trailing end 2*b* of the sheet 2. The ink ejected to the region outside of the trailing end 2*b* of the sheet 2 is discarded into the ink absorber 35 (i.e., sponge) in the trailing end ink discarding groove 31B positioned upstream of the sheet supporting portion 14. In this manner, the printing operation with respect to the trailing end 2*b* of the sheet 2 comes to an end in the state in which the sheet 2 is sucked to the sheet supporting surface 13.

As described above, the sheet 2 is placed on the sheet supporting surface 13 of the sheet supporting portion all the time from the beginning of the printing operation to the end thereof. In view of this, a proper negative pressure is introduced into the suction recess 17, so that the printing operation can be performed in the state in which the sheet 2 is sucked to the sheet supporting surface 13 all the time. Thus, a sheet distance between the printhead 3 and the sheet 2 can be kept to be a predetermined proper distance, thereby accurately printing an image. Incidentally, since a carriage 4 is provided with a sensor that detects the sheet end, the sheet end can be accurately placed on the tops of the ribs according to the detection by the sensor.

As shown in FIG. 22, a space region NA surrounded by the sheet 2, the sheet supporting portions 14, and the fore and trailing end ink discarding grooves 31A and 31B is defined in the contact state of the sheet 2 with the upstream sheet supporting portions 32 and the downstream sheet supporting portions 33. Here, the space region NA communicates with the clearance defined by the connection seat 37 and the sheet 2, as described above. The clearance forms a communication channel that allows the space region NA to communicate with the outside. The space region NA includes the second suction hole 180, and therefore, a pressure in the space region NA is lower than an ambient pressure. As a consequence, air is supplied to the space region NA having a lower pressure (hereinafter referred to as a negative pressure portion) through the communication channel, as shown in FIG. 24.

In this manner, an air flow F1 that will flow into a clearance defined between the sheet 2 and the sheet supporting surface 13 from the end (2*d* in FIG. 24) of the sheet 2 is remarkably reduced in comparison with an air flow F2 from the end 2*d* of the sheet 2 to the second suction hole 180. As a consequence, it is possible to suppress any intrusion of the ink mist backward of the sheet 2 during the marginless printing or any adhesion of the ink mist to the sheet 2.

A pressure in the negative pressure portion NA is increased (i.e., the negative pressure is reduced) by supplying the air to the negative pressure portion NA, thereby reducing a difference in pressure between the negative pressure portion NA and the surroundings of the end 2*d* of the sheet 2. Consequently, the speed of an air flow F3 at the surroundings of the end 2*d* of the sheet 2 is reduced. In this manner, it is possible to reduce the misalignment of a landing position by the printhead caused by the adverse influence of the air flow F3 so as to suppress the degradation of an image in the surroundings of the right end 2*d* of the sheet 2. Here, although FIG. 24 shows the right end 2*d* of the sheet 2, a similar effect can be produced as to the left end of the sheet 2.

In a case where the upstream sheet supporting portions 32 and the downstream sheet supporting portions 33 are formed into a flat shape, instead of forming the upstream sheet supporting portions 32 and the downstream sheet supporting portions 33 in the ink receivers formed into the plurality of ribs as in the present embodiment, the following phenomenon emerges: namely, out of the air flows intruding into the second suction hole 180 positioned right under the sheet end 2*d*, the flow resistance of the air flow flowing upstream and downstream in the sheet conveyance direction (i.e., the Y direction) becomes larger than that of the air flow flowing in the sheet widthwise direction (i.e., the X direction). Thus, the rate of the air flow in the sheet widthwise direction (i.e., the X direction) markedly becomes larger than that of the air flow in the sheet conveyance direction (i.e., the Y direction) out of the air flows from the outside to the second suction hole 180. In other words, the rate of the air flow flowing into the second suction hole 180 depends on the air flow in the sheet widthwise direction.

At this time, the air is sucked also through a suction hole (designated by reference numeral 181 in FIG. 24) formed at the suction recess 17 of the ink supporting portion 14 positioned outside of the sheet end 2*d*. Most of the air outside of the sheet end 2*d* flows into the suction hole 181.

A very slight quantity of the air flows into the suction hole 180 positioned right under the sheet end 2*d* from the outside of the sheet end 2*d*. As a consequence, the air strongly flows from the sheet end 2*d* to the second suction hole 180, and accordingly, the air rapidly flows from the center of the sheet toward the sheet end 2*d* around the end of the sheet. The ink ejected near the sheet end 2*d* flows by the force of the air flow, thereby causing the misalignment of the landing position, so as to raise a phenomenon that the image to be formed near the sheet end 2*d* is degraded. In particular, in a case where an image to be printed includes a ruled line, the width of the line becomes great, and therefore, the degradation of the image can be visually recognized with ease.

Here, it is possible to reduce the mist suction force at the second suction hole 180 formed at the right/left ink discarding groove 34 so as to suppress the degradation of the image around the end of the sheet. However, in this case, the air flow F2 from the sheet end 2*d* to the second suction hole 180 is weakened whereas the air flowing into the clearance defined between the sheet 2 and the sheet supporting surface 13 is increased, and therefore, the ink mist is liable to be transported to the reverse of the sheet. Consequently, the quantity of the ink mist adhering to the reverse of the sheet is increased.

In a case where the upstream and downstream sheet supporting portions 32 and 33 are formed into a flat shape, the alleviation of a smear on the reverse of the sheet by the ink mist is traded off against the suppression of the degradation of the image at the sheet end. Thus, it is difficult to achieve both the alleviation of the smear and the suppression of the degradation at the same time.

In contrast, the communication channel is formed for supplying the air to the negative pressure portion NA in the present embodiment, thus achieving compatibility between the alleviation of the smear on the sheet 2 by the ink mist and the suppression of the degradation of the image around the sheet end.

(Variations)

Figure 26:
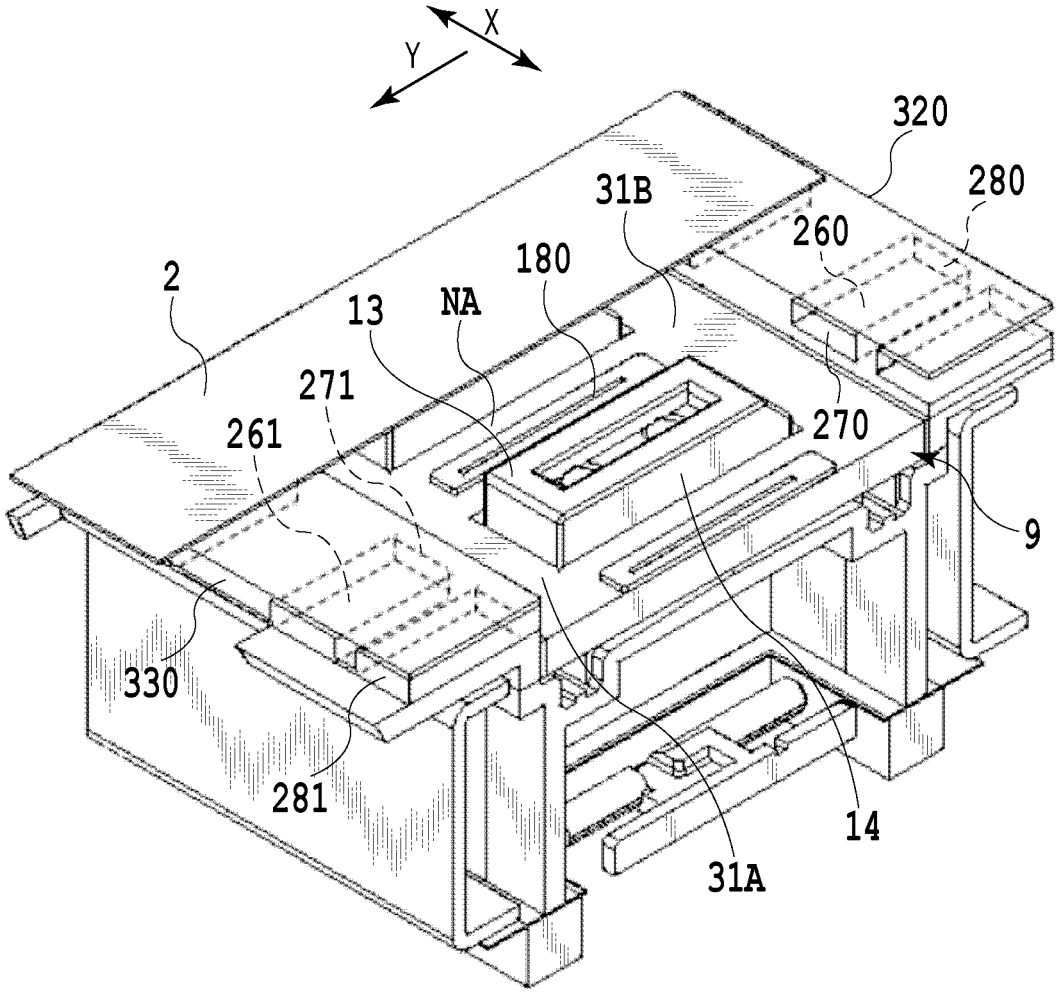
FIG. 26 is a perspective view showing a first variation of the second embodiment.

FIG. 26 is a perspective view showing a first variation of the second embodiment. A downstream sheet supporting portion includes a wall 330 formed in the sheet widthwise direction (i.e., the X direction) outside (downstream) of the leading end ink discarding groove 31A. In contrast, an upstream sheet supporting portion includes a wall 320 formed in the sheet widthwise direction (i.e., the X direction) outside (upstream) of the trailing end ink discarding groove 31B. Communication channels 260 and 261 which are through holes are formed inside of the walls 320 and 330 in the sheet conveyance direction (i.e., the Y direction), respectively.

The communication channel 260 communicates with the trailing end ink discarding groove 31B. One opening 270 is formed at a position at which it communicates with the trailing end ink discarding groove 31B whereas the other opening 280 is formed at a surface (i.e., an outer surface) apart from the trailing end ink discarding groove 31B in the sheet conveyance direction. Moreover, the communication channel 261 communicates with the leading end ink discarding groove 31A. One opening 271 is formed at a position at which it communicates with the leading end ink discarding groove 31A whereas the other opening 281 is formed at a surface (i.e., an outer surface) apart from the leading end ink discarding groove 31A in the sheet conveyance direction.

Figure 27:
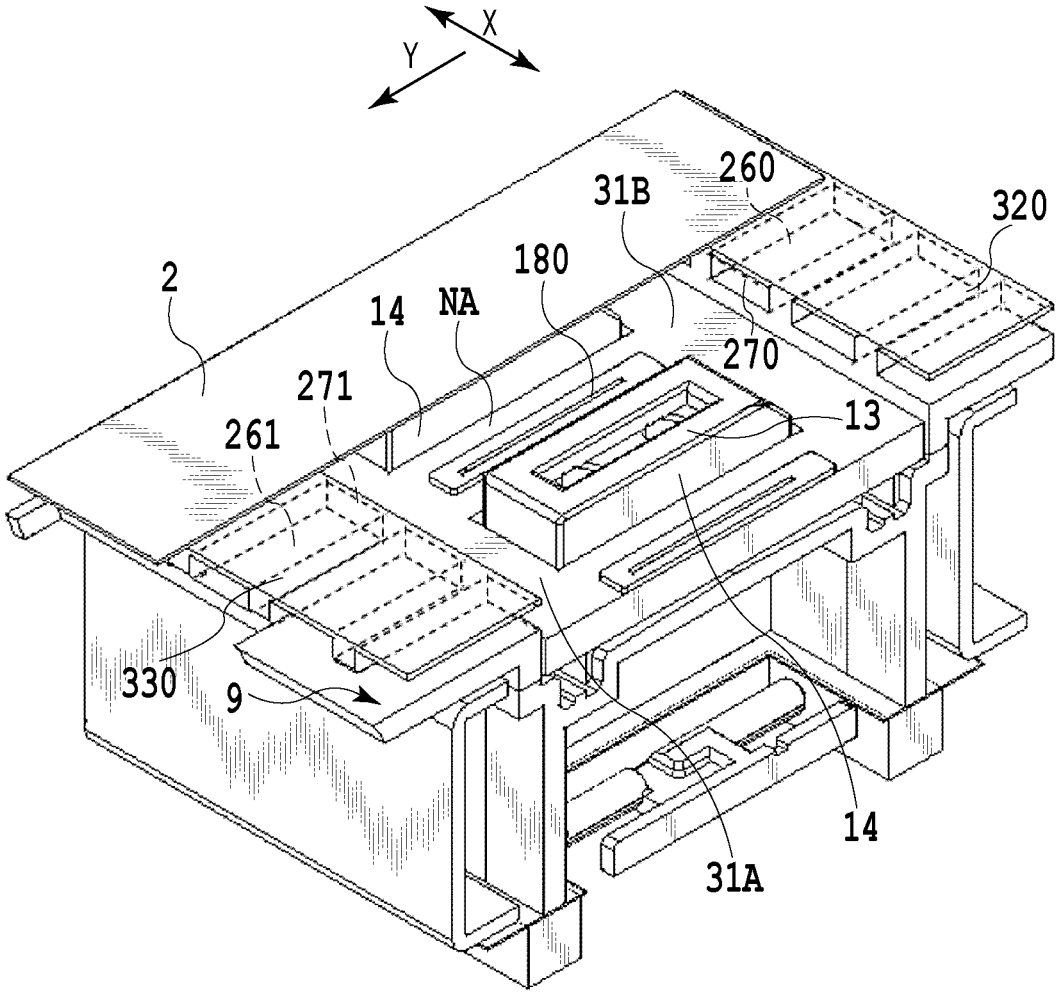
FIG. 27 is a perspective view showing a second variation of the second embodiment.
Figure 28:
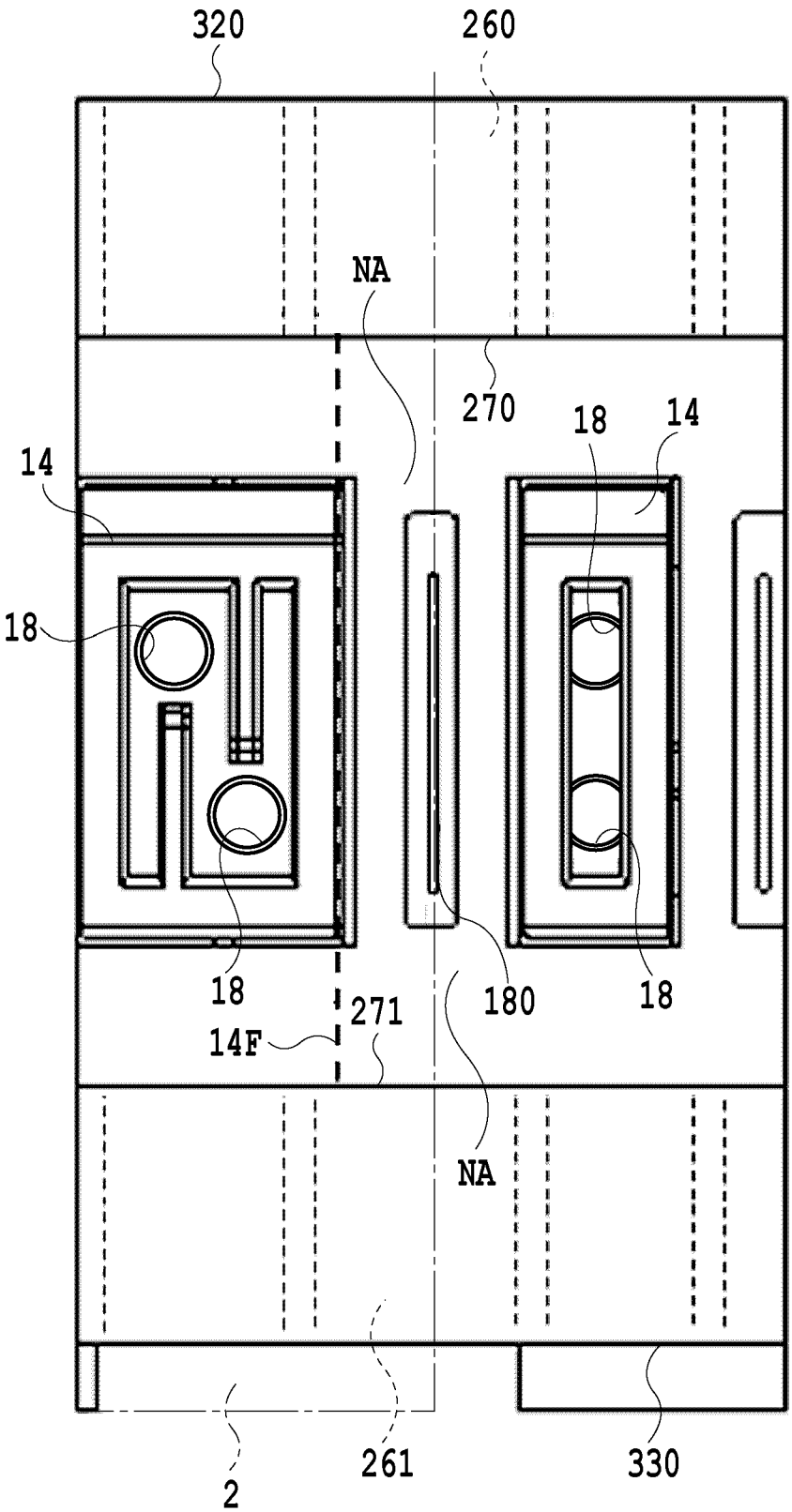
FIG. 28 is a plan view of FIG. 27.

FIG. 27 (a perspective view) and FIG. 28 (a plan view) are views showing a second variation of the second embodiment. The platen 9 includes communication channels 260 and 261 having openings 270 and 271, respectively, at positions at which a surface extending in the sheet conveyance direction (i.e., the Y direction) of the side face of the supporting portion 14 supporting the end of the sheet 2 crosses walls 320 and 330. Most of the air supplied to the negative pressure portion NA passes the communication channels 260 and 261. The communication channels 260 and 261 are arranged such that the first openings 270 and 271 are arranged at positions at which a surface 14F extending in the sheet conveyance direction of the side face of one of the supporting portions 14 on the same side as the end of the sheet 2 crosses the walls 320 and 330.

Figure 29:
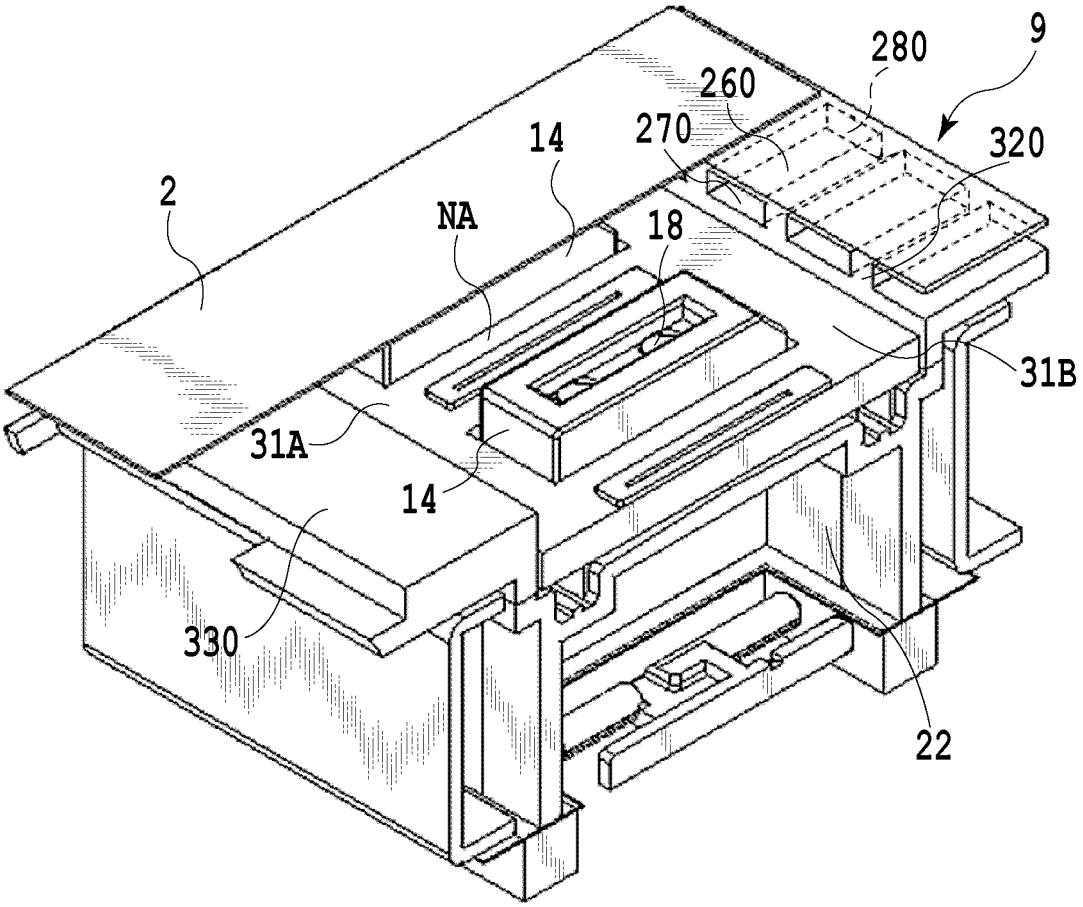
FIG. 29 is a perspective view showing a third variation of the second embodiment.

FIG. 29 is a view showing a third variation of the second embodiment. A communication channel 260 is formed only on an upstream wall 320, that is, only on the wall 320 formed along the trailing end ink discarding groove 31B, but no communication channel is formed on a downstream wall. That is to say, no communication channel is formed on a wall 330 formed along the leading end ink discarding groove 31A. Here, the communication channel 260 has an opening 270 formed at a position at which it faces the negative pressure portion NA and the spur roller 11 (see FIG. 3). To the contrary, a communication channel may be formed only on the downstream wall 330 whereas no communication channel may be formed on the upstream wall 320. The communication channel is formed on either upstream or downstream wall at the platen, thus achieving compatibility between the alleviation of a smear on the sheet 2 and the suppression of the degradation of an image.

Figure 30A:
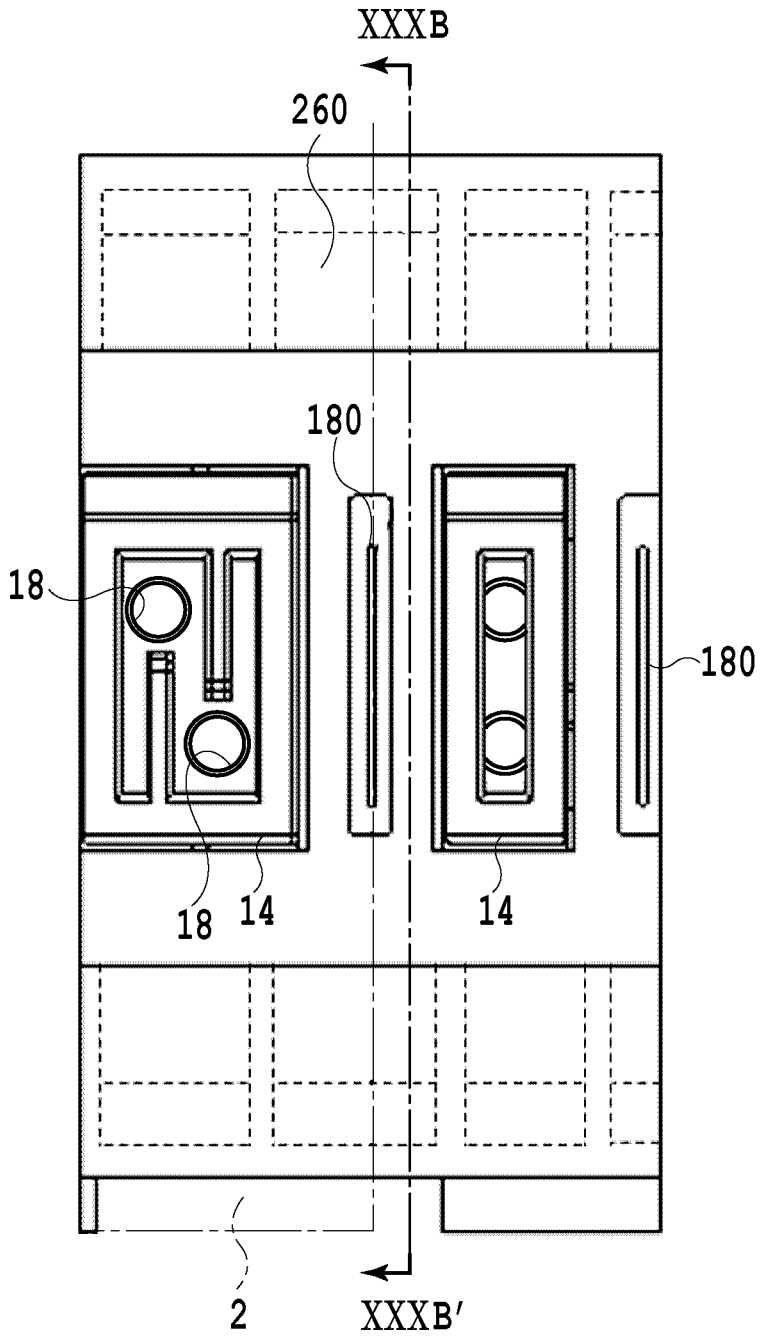
FIG. 30A is a plan view showing a fourth variation of the second embodiment.
Figure 30B:
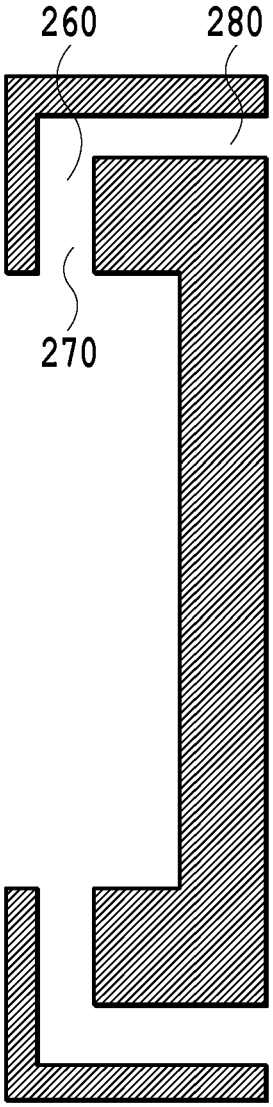
FIG. 30B is a cross-sectional view showing the fourth variation of the second embodiment.

FIGS. 30A and 30B are views showing a fourth variation of the second embodiment. One opening of a communication channel 260 is formed at the reverse of the platen 9. Ink mist caused by printing may not be completely recovered only due to the suction through the second suction hole 180, and consequently, it may float inside of a space defined at the upper portion of the platen 9 inside of the printing apparatus. It is desirable that air supplied to the negative pressure portion NA through the communication channel 260 should not be contaminated by the mist. In view of this, one opening 280 of the communication channel 260 is formed at the reverse of the platen 9 in FIGS. 30A and 30B.

Figure 31:
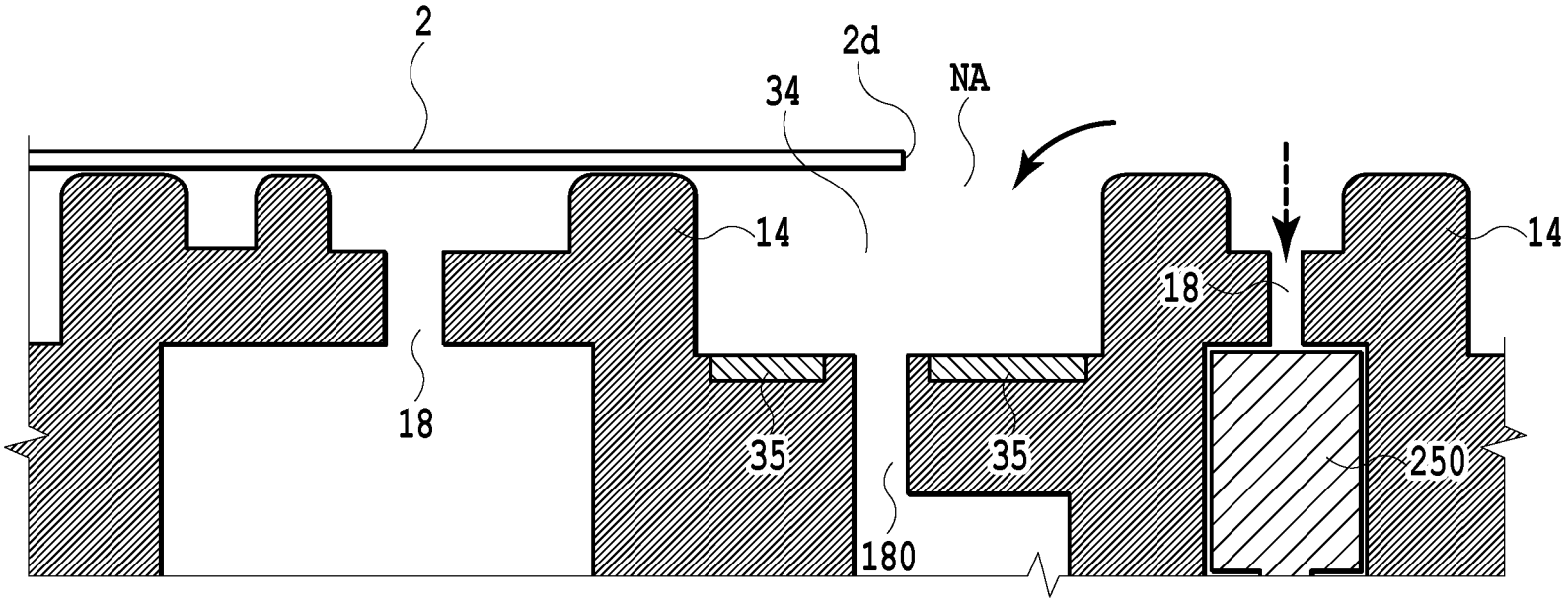
FIG. 31 is a cross-sectional view showing a fifth variation of the second embodiment.

FIG. 31 is a view showing a fifth variation of the second embodiment. This variation is configured in such a manner as to stop the suction through the suction hole 18 at the sheet supporting portion 14 that is not covered with the sheet in a case where the sheet 2 having a certain width is sucked and held. The suction through the suction holes 18 formed at the plurality of different positions in the sheet widthwise direction is individually controlled according to the width of the sheet that is used. A stopper of the suction at the sheet supporting portion 14 is exemplified by a valve 250 for switching communication and cutoff of the suction hole 18 at the lower portion of the sheet supporting portion 14. As for the sheet supporting portion 14 disposed outside of the sheet, the valve 250 is moved upward, as shown in FIG. 31, so as to close the suction hole 18 formed in a projection manner. In contrast, the valve 250 is moved downward, so that the negative pressure is applied to the sheet supporting portion 14. Stopping the suction at the sheet supporting portion 14 positioned outside of the sheet enables more air to be supplied to the negative pressure portion NA from the outside.

Figure 32:
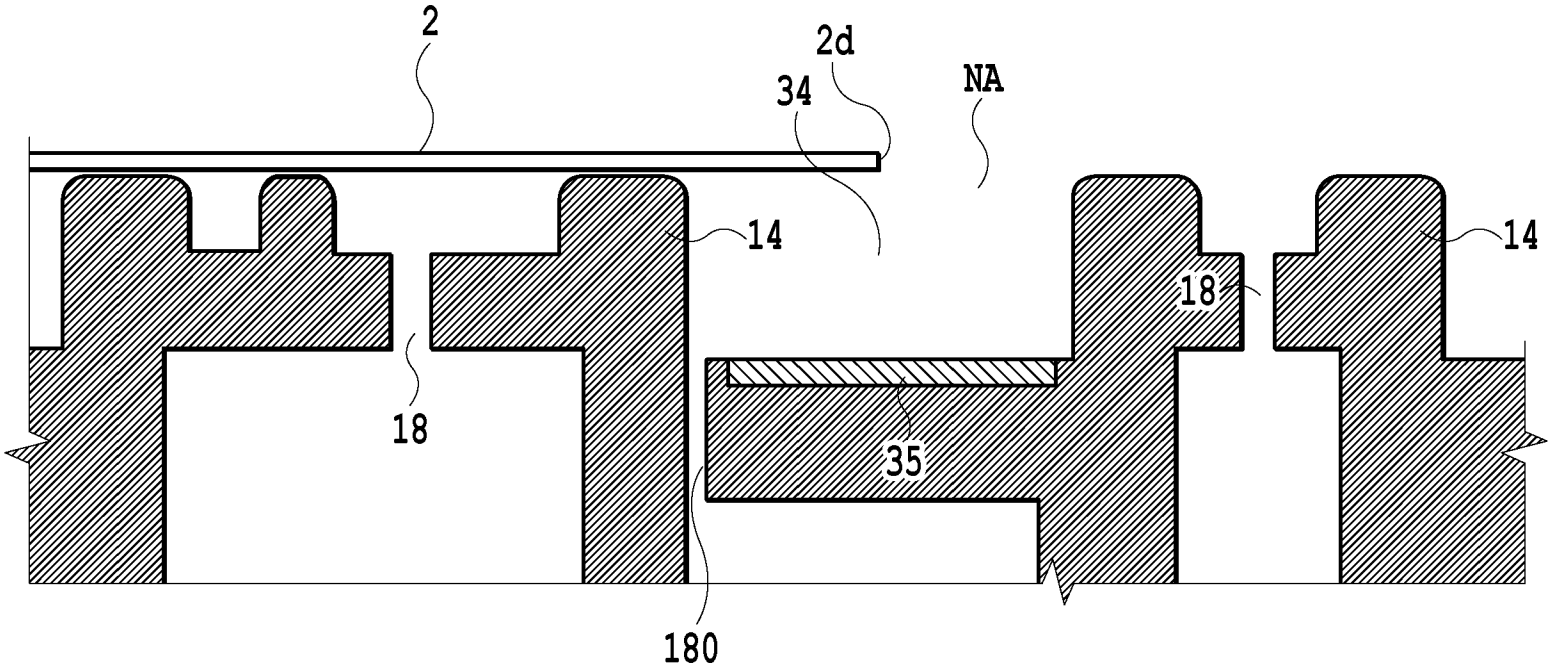
FIG. 32 is a cross-sectional view showing a sixth variation of the second embodiment.

FIG. 32 is a view showing a sixth variation of the second embodiment. In the sixth variation, the second suction hole 180 is formed not right under the sheet 2 but along the side wall of the sheet supporting portion 14 that sucks and holds the sheet 2. Consequently, the ink discarded into the right/ left ink discarding groove 34 adheres to the second suction hole 180, and then, is solidified, thus suppressing the reduction of the recovery quantity of the ink mist. Furthermore, in comparison with a case where the second suction hole 180 is formed right under the end of the sheet 2, more air is supplied to the second suction hole 180 along the side wall of the sheet supporting portion 14 from the surroundings of the end of the sheet 2.

Figure 33:
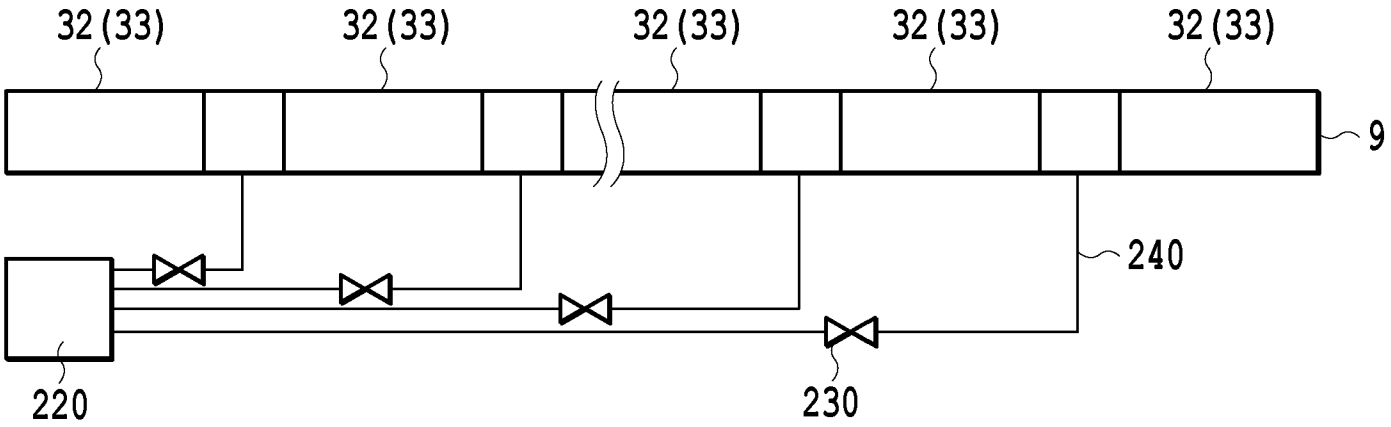
FIG. 33 is a view showing a seventh variation of the second embodiment.

FIG. 33 is a view showing a seventh variation of the second embodiment. In the seventh variation, in the drawing (FIG. 22) showing the second embodiment, a plurality of communication channels defined between the upstream sheet supporting portions 32 and between the downstream sheet supporting portions 33 and a common pressurizer 220 are connected via a plurality of channels 240, and furthermore, a valve 230 is disposed on each of the channels 240. In order to adjust the flow rate of the air to be supplied to the negative pressure portion NA from the pressurizer 220, the opening/closing or the opening degrees of the plurality of valves 230 are individually controlled. Specifically, the plurality of valves 230 are controlled according to the width of the sheet that is used. The pressurizer 220 and the plurality of valves 230 configure an air supplier at an active individual pressurizing mechanism.

Figure 34:
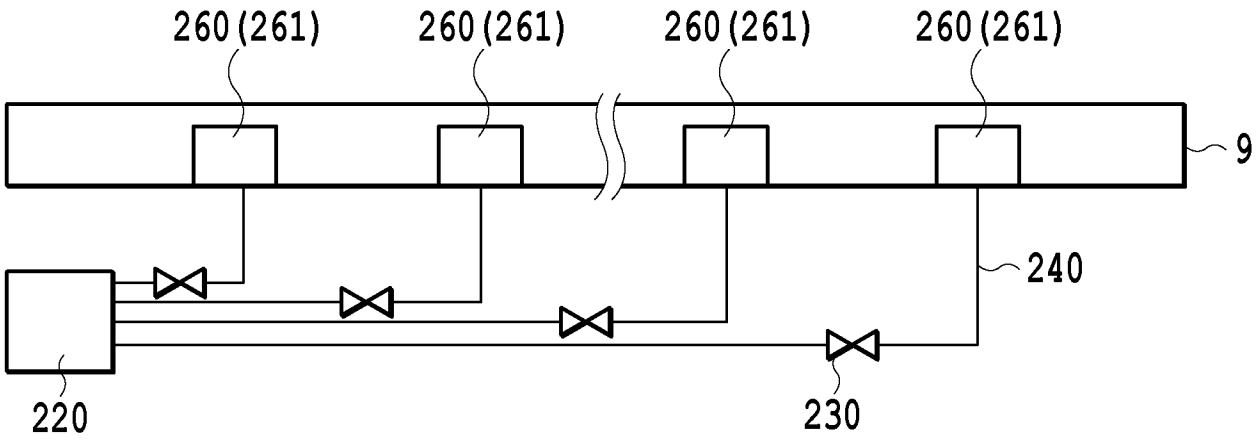
FIG. 34 is a view showing an eighth variation of the second embodiment.

FIG. 34 is a view showing an eighth variation of the second embodiment. In the eighth variation, an active individual pressurizing mechanism is added to the variations shown in FIGS. 26 to 30B. The communication channels formed on the wall 320 and a pressurizer 220 are connected to each other via a plurality of channels 240, and furthermore, a plurality of valves 230 are disposed on the channels 240, respectively, thereby adjusting the flow rate of air to be supplied under the individual control by the valve 230. In this manner, in the variations shown in FIGS. 33 and 34, there are provided the pressurizer and the supplier for individually pressurizing and supplying the air to each of the communication channels disposed at the plurality of different positions in the sheet widthwise direction.

In the above-described embodiments, the four-side marginless printing can be performed with respect to a cut sheet. It is possible to securely perform the marginless printing, and furthermore, to suppress any smear on the reverse of the sheet with the ink mist generated during the ejection of the ink to the outside of the sheet end.

(Third Embodiment)

A description will be given below of a third embodiment. In the third embodiment, constituent elements identical or corresponding to those in the first and second embodiments are designated by the same reference numerals, and therefore, the explanation will be omitted.

Figure 35:
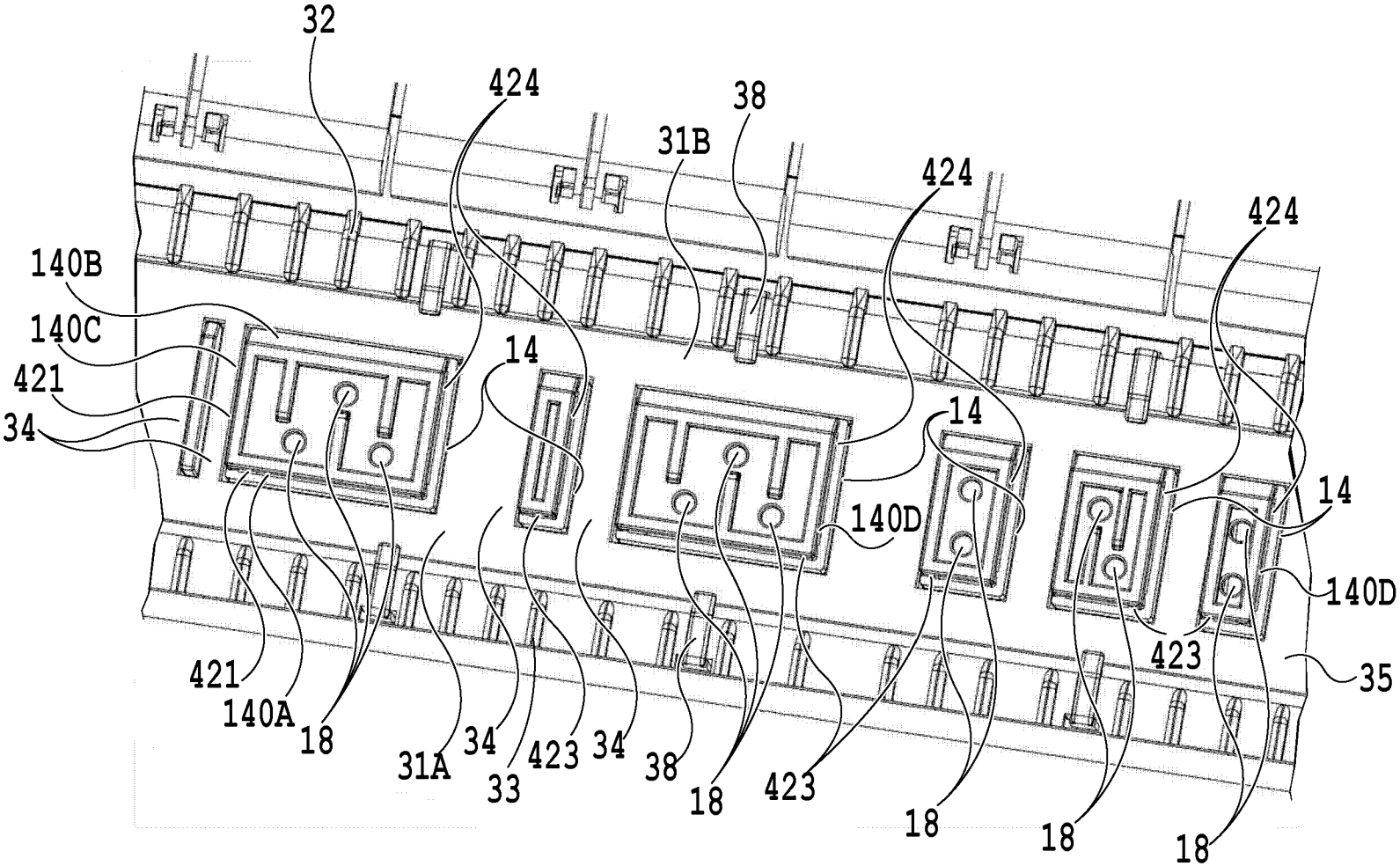
FIG. 35 is an enlarged perspective view partly showing a platen in a third embodiment, as viewed from the top.
Figure 36:
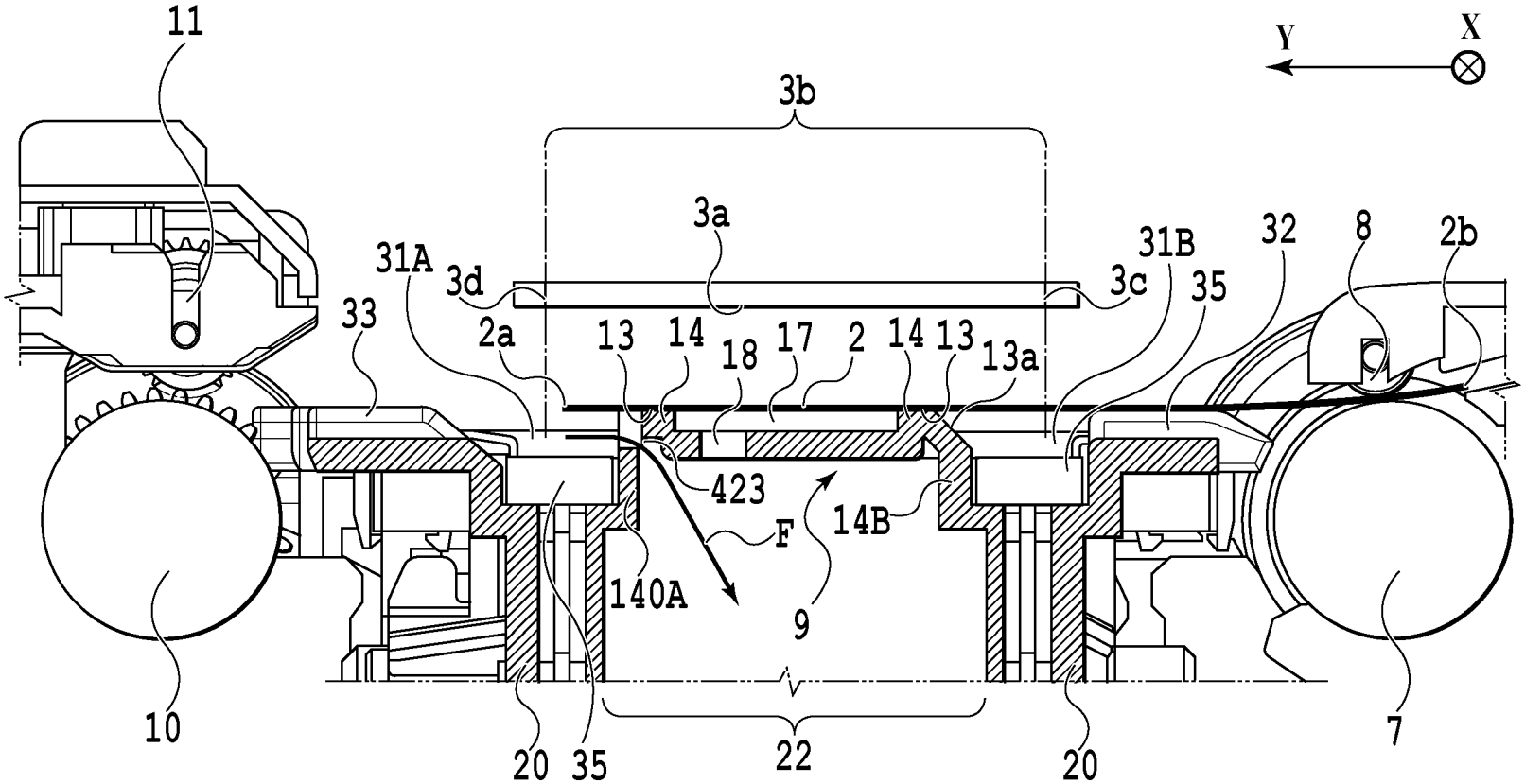
FIG. 36 is a vertical side view partly showing the platen and its peripheral structure in the third embodiment.

Also in the third embodiment, there is provided a platen 9 substantially similar to that in the first embodiment. FIG. 35 is an enlarged perspective view partly showing the platen shown in FIG. 1, as viewed from above. Additionally, FIG. 36 is a vertical side view showing the platen shown in FIG. 35 and its surroundings. FIG. 35 and show a channel in which ink mist generated during printing around a sheet leading end.

As shown in FIG. 36, the platen 9 is interposed between a first conveyance roller pair including a conveyance roller 7 and a pinch roller 8 and a second conveyance roller pair including a discharge roller 10 and a pulley 11. The platen 9 supports a sheet 2 conveyed by the first and second conveyance roller pairs at a surface (i.e., a reverse) opposite to a print surface.

In order to properly keep a clearance between an ejection port forming surface 3*a* of a printhead 3 and the sheet 2, the platen 9 has sheet supporting portions (i.e., supporting portions) 14 capable of supporting the reverse of the sheet while suppressing floating or flexure of the sheet 2. The plurality of sheet supporting portions 14 are formed in a longitudinal direction (i.e., an X direction) of the platen 9.

Figure 37:
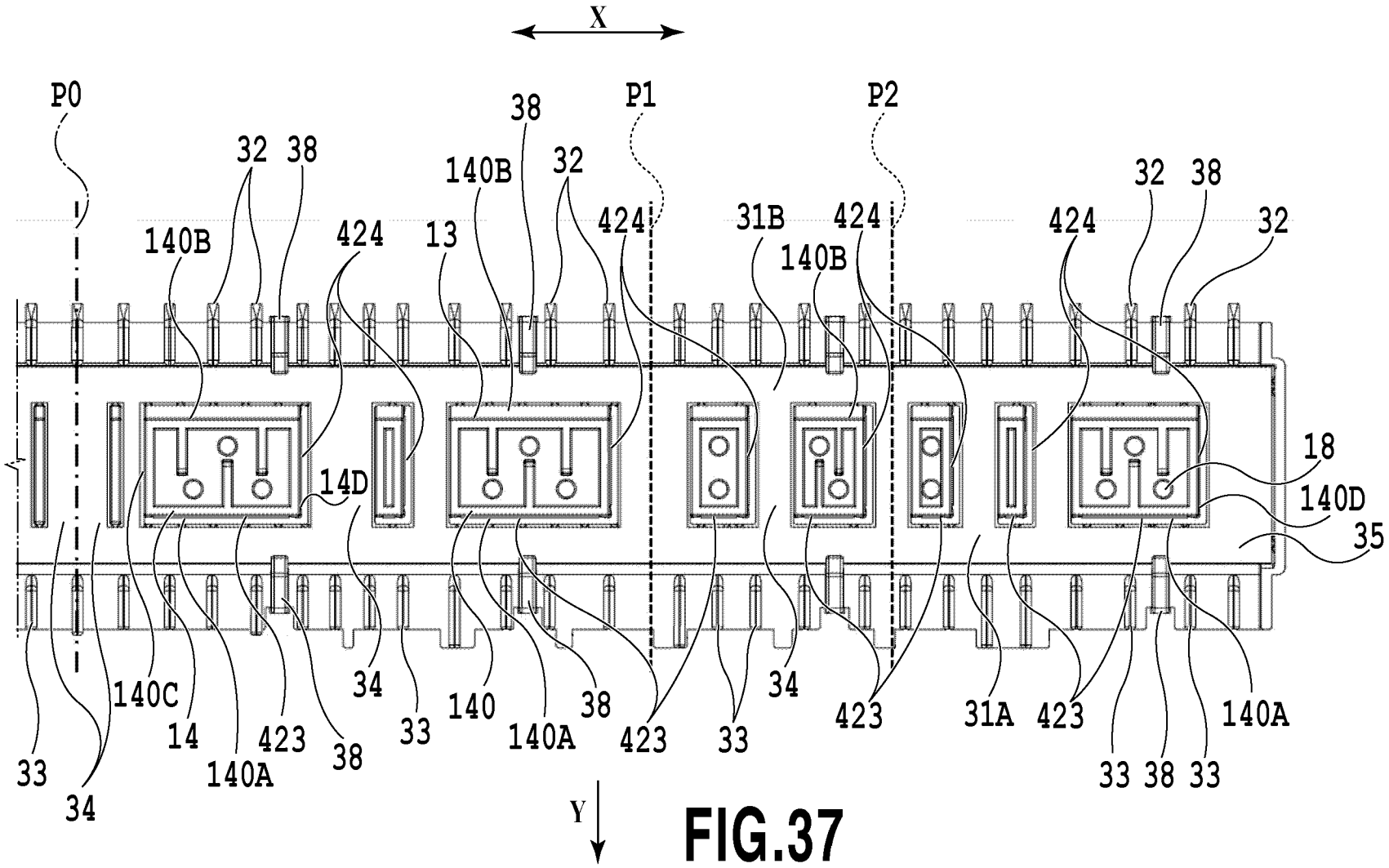
FIG. 37 is an enlarged plan view partly showing the platen in the third embodiment.

FIG. 37 is an enlarged plan view partly showing the platen 9 shown in FIG. 36. Each of the sheet supporting portions 14 is formed into a rectangular frame with a ribbed projection. A suction recess (i.e., a suction unit) 17 is formed at the upper portion of the sheet supporting portion 14 in such a manner as to be lower by one step than the sheet supporting surface 13. A suction hole 18 is formed at the bottom of the suction recess 17 in such a manner as to penetrate the platen 9. The suction hole 18 communicates with a negative pressure generator 19 such as a fan.

Upstream sheet supporting portions 32 for supporting the reverse of the sheet 2 conveyed by the conveyance roller 7 are formed further upstream of a trailing end ink discarding groove 31B, described later, formed on the platen 9. Additionally, downstream sheet supporting portions 33 for supporting the reverse of the sheet 2 conveyed by the discharge roller 10 are formed further downstream of a leading end ink discarding groove 31A, described later, formed on the platen 9. Each of the upstream sheet supporting portions 32 and the downstream sheet supporting portions 33 includes a ribbed projection extending in a sheet conveyance direction (i.e., a Y direction). The plurality of upstream sheet supporting portions 32 and the plurality of downstream sheet supporting portions 33 are arranged in the X direction at a constant interval, as shown in FIG. 37.

The position of the top of each of the upstream sheet supporting portions 32 and the downstream sheet supporting portions 33 is formed in the same height as that of a sheet supporting surface (i.e., a contact portion) 13 of the sheet supporting portion 14. The upstream sheet supporting portion 32 and the downstream sheet supporting portion 33 fulfill the function of preventing the sheet 2 from falling or being involved in a case where the fore or trailing end of the sheet 2 passes the sheet supporting portion 14 and the rollers.

In order to securely perform printing of the entire sheet 2 without any margin at the peripheral edge of the sheet 2, that is, so-called marginless printing, it is necessary to eject ink up to the outside of the end of the sheet 2. Moreover, in the printing apparatus of the ink jet system, ink is ejected to the outside of the sheet 2 immediately before a printing operation, that is, so-called preliminary ejection is performed in order to stabilize ink ejection performance of the printhead 3. The above-described ink ejected to the outside of the sheet is received in ink receivers formed at the platen 9. As the ink receivers in this embodiment, there are provided a leading end ink discarding groove 31A for receiving ink ejected to the outside of the leading end 2*a* of the sheet and a trailing end ink discarding groove 31B for receiving ink ejected to the outside of the trailing end 2*b* of the sheet. Moreover, in the present embodiment, the ink receivers include right/left end ink discarding grooves 34 that receive ink ejected to the outside of the right and left ends (i.e., sheet side ends) of the sheet 2 in the sheet widthwise direction.

FIG. 36 shows the cross sections of the leading end ink discarding groove (i.e., a first ink receiver) 31A and the trailing end ink discarding groove (i.e., a second ink receiver) 31B at the platen 9. As shown in FIG. 36, the leading end ink discarding groove 31A is elongated in the X direction adjacently downstream of the sheet supporting portion 14 whereas the trailing end ink discarding groove 31B is elongated in the X direction adjacently upstream of the sheet supporting portion 14.

In the meantime, in order to securely perform the marginless printing at the right and left ends (i.e., sheet side ends) of the sheet 2, it is necessary to eject the ink also to the outside of the right and left ends of the sheet 2 in a case where the printhead 3 ejects the ink while performing scanning in the X direction. Even in a case where the width of the sheet 2 to be used is changed, the platen 9 has right/left end ink discarding grooves (i.e., a third ink receiver) 34 according to each width of the sheet in such a manner as to receive the ink ejected to the outside of the right and left ends of the sheet 2 (see FIG. 35).

The sheets 2 that can be subjected to marginless printing have mainly standard sizes such as an L size, a 2 L size, a postcard size, an A4 size, a letter size, an A3 size, a legal size, and an A2 size. In view of this, the plurality of ink discarding grooves 34 are formed at positions corresponding to the right and left ends of the sheet 2 according to the sizes of sheets. As described above, the leading end ink discarding groove 31A, the trailing end ink discarding groove 31B, and the right/left end ink discarding grooves 34 are formed in a grid manner at the surface of the platen 9 (see FIG. 35).

Figure 39:
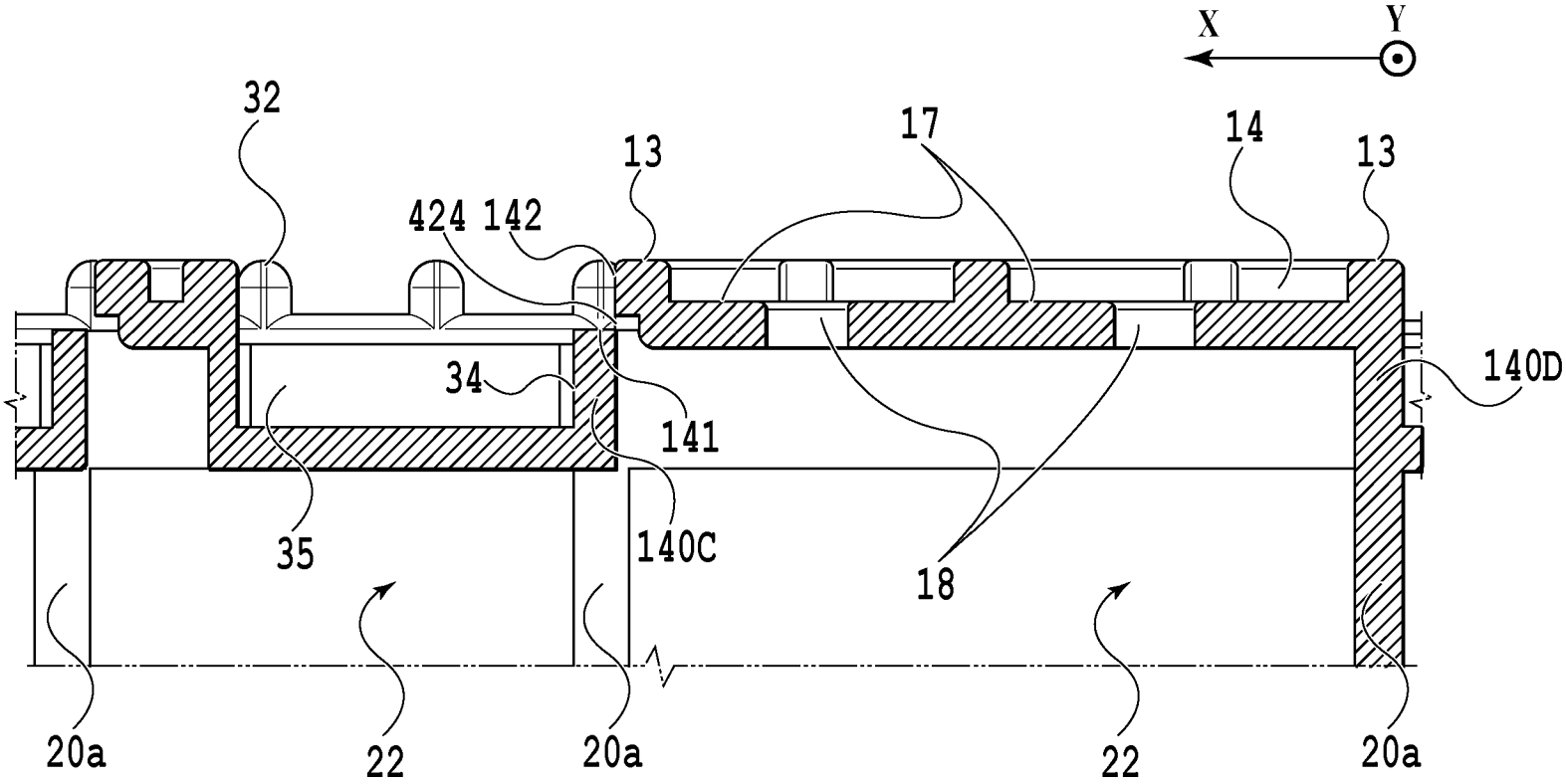
FIG. 39 is an enlarged vertical side view partly showing the platen in the third embodiment.

In this manner, assuming that the marginless printing is performed on four sides of a cut sheet, the sheet supporting portion 14 of the platen 9 is individually surrounded by the fore and trailing end ink discarding grooves 31A and 31B and the right/left end ink discarding grooves 34. In order to alleviate the generation of mist caused by a splash at the time of landing of the ink and the leakage of the discarded ink, an ink absorber 35 is disposed at each of the ink discarding grooves 31A, 31B, and 34, as shown in FIGS. 37 and 39. It is preferable that the ink absorber 35 should be a spongy single sheet made of expanded urethane. The upper surface of the ink absorber 35 is locked by a plurality of lock claws 38 (see FIG. 37), so that the ink absorber 35 can be inhibited from being detached from the platen 9.

Figure 38:
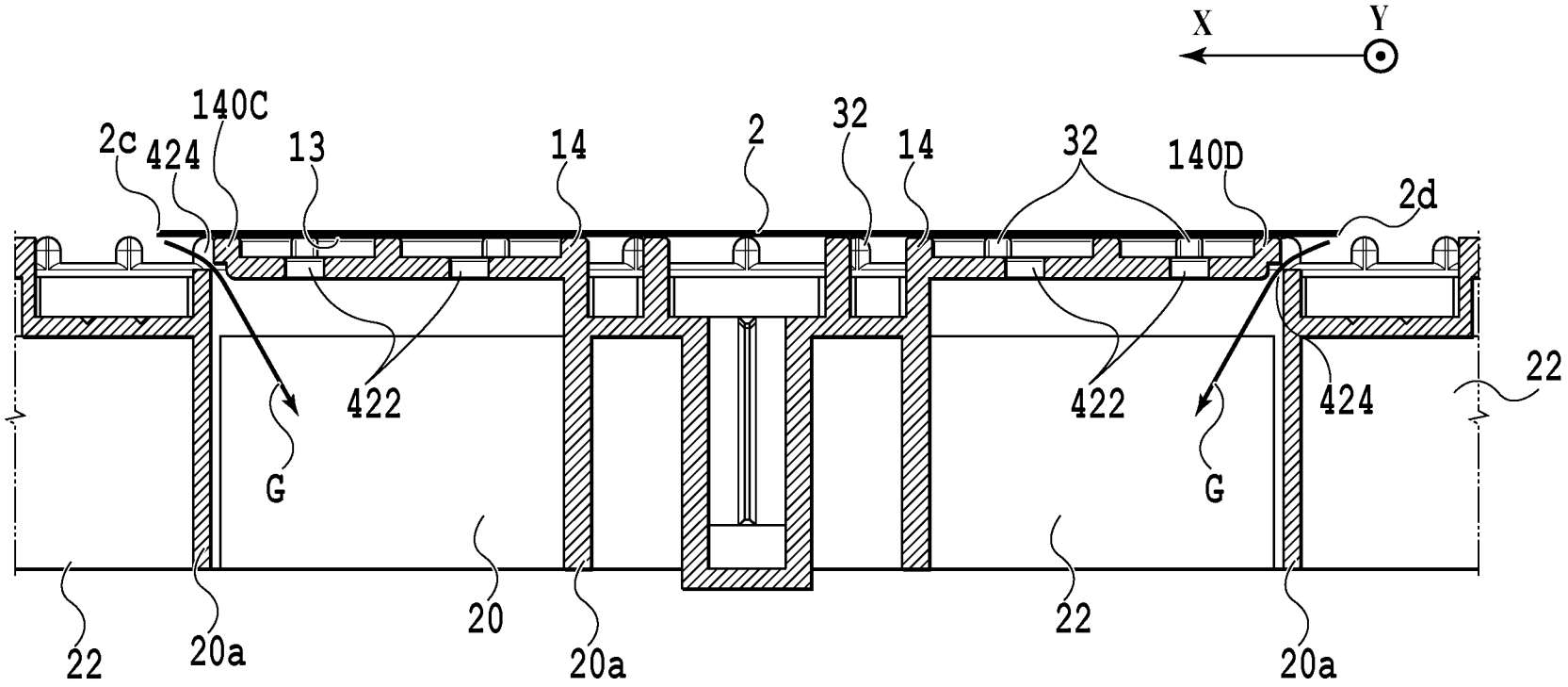
FIG. 38 is a vertical front view showing the platen in the third embodiment.

An outer peripheral wall 20 that projects downward, as shown in FIG. 36, is formed at a surface opposite to a surface at which the platen 9 faces the printhead 3. Moreover, a space defined by the outer peripheral walls 20 is divided into a plurality of spaces 22 by partition walls 20*a*, as shown in FIGS. 38 and 39. The plurality of spaces 22 defined by the partition walls 20*a* and the outer peripheral walls 20 serve as negative pressure chambers, to which a negative pressure is applied by a negative pressure generator 19. The negative pressure chambers 22 correspond to the suction recesses 17 formed at the sheet supporting portions 14, respectively. The negative pressure generator 19 applies a negative pressure to the negative pressure chamber 22, so that air is sucked through the suction holes 18 formed at the suction recess 17, thus sucking the sheet 2 to the sheet supporting surface 13 of the sheet supporting portion 14.

In the meantime, first and second slits 423 and 424 for sucking and recovering ink mist generated at the time of the ejection of the ink into an ink receiving groove are formed on the side walls of the sheet supporting portion 14 at the platen 9. FIGS. 35 and 37 show positions where the first and second slits 423 and 424 are formed. As shown in FIGS. 35 and 37, the first slit 423 is formed on a downstream side wall 140A substantially parallel to the sheet widthwise direction (i.e., the X direction) crossing the sheet conveyance direction (i.e., the Y direction) at each of the sheet supporting portions 14. In contrast, the second slit 424 is formed on a side wall 140D substantially parallel to the sheet conveyance direction at each of the sheet supporting portions 14. The first slit 423 and the second slit 424 communicate with the negative pressure chamber 22. Therefore, the drive of the negative pressure generator 19 causes air to be sucked through not only the suction holes 18 but also the slits 423 and 424.

In the printing apparatus, it is desirable that printing should be performed in the state in which the sheet 2 covers the sheet supporting portion 14. That is to say, air is sucked through the suction holes 18 in the state in which the sheet 2 covers the sheet supporting portion 14, so that the negative pressure is generated in the space defined by the suction recess 17 and the sheet 2 covering the suction recess 17, thus sucking the sheet 2 to the sheet supporting surface 13 of the sheet supporting portion 14. Consequently, it is possible to suppress the occurrence of floating or flexure of the sheet such as cockling or curl during a printing operation. In this manner, it is possible to keep the distance (i.e., the sheet distance) between the ejection port forming surface 3*a* of the printhead 3 and the sheet 2 at a preset proper distance, and furthermore, to reduce the misalignment of the landing position of the ink ejected from the printhead 3, resulting in the formation of an image of a high quality.

Moreover, the ink ejected to the outside (i.e., downstream) of the leading end of the sheet 2 is landed on the ink absorber 35 positioned in the leading end ink discarding groove 31A. At this time, atomized fine ink droplets (i.e., ink mist) are generated in a case where a shock is caused by the landing on the ink absorber 35 or the ink is ejected, and then, they float in the air. The ink mist is sucked toward the suction recess 17 by the negative pressure through the suction hole 18, and then, passes a fine clearance defined between the sheet supporting portion 14 and the sheet 2. A part of the mist is brought into contact with and adheres to the reverse of the sheet 2, which may be smeared with the mist. However, since the first slit 423 is formed on the downstream side wall 140A of the sheet supporting portion 14 in the present embodiment, the ink mist is sucked through the first slit 423, as indicated by an arrow F in FIG. 36, before being sucked to the suction hole 18. As a consequence, even in the case of the marginless printing, it is possible to remarkably reduce a contact of the ink mist on the reverse of the sheet 2 so as to markedly alleviate a smear on the reverse of the sheet 2 with the ink mist. Here, the second slit 423 is formed on the downstream side wall 140A of the sheet supporting portion 14 in the present embodiment. Likewise, a similar slit may be formed on the upstream side wall 140B of the sheet supporting portion 14, thus alleviating the adhesion of ink mist onto the trailing end 2*b* of the sheet 2.

The description has been given above of the treatment of the mist generated in printing the leading end 2*a* and the trailing end 2*b* of the sheet 2 during the marginless printing. Next, explanation will be made below on the treatment of ink mist generated in printing the right and left ends of the sheet 2 during the marginless printing.

FIG. 37 is an enlarged plan view partly showing the platen 9, and shows the positional relationship between the sheet supporting portion 14 at the platen 9 and the sheets 2 having different sizes. In addition, FIG. 38 is a vertical front view showing the platen 9, and shows a channel onto which ink mist is sucked in a case where the right and left ends 2*c* and 2*d* of the sheet 2 are printed.

The arrangement of the sheet supporting portion 14 in the sheet widthwise direction (i.e., the X direction) and the position of the ink discarding groove are determined according to the size of the sheet which can be subjected to the marginless printing (e.g., an L size, a KG size, a 2 L size, an A4 size, a letter size, or an A3 size) and a print position reference. In the present embodiment, the reference of the print position is set at the center of the width of a sheet: namely, a so-called center reference sheet supply is adopted. FIG. 37 shows the positional relationship between the end of each of an A4-size sheet 2 and an A3-size sheet 2 and each of the sheet supporting portions 14 at the platen 9. In FIG. 37, reference character P0 designates the print position reference (i.e., a center reference) of the platen 9 and the sheet 2; P1, the position of the end of the A4-size sheet 2; and P2, the position of the end of the A3-size sheet 2. Incidentally, not the center reference but a one-side reference may be adopted such that all sheets having various sheet widths are aligned at either one of right and left reference positions.

Out of right and left side walls 140C and 140D formed in a direction parallel to the sheet conveyance direction among the side walls of the sheet supporting portion 14, the first slit 423 is formed on the side wall nearer the left and right ends 2*c* and 2*d* of the sheet 2. As described above, since the center reference is adopted, the second slit 424 is formed on the right side wall 140D at the sheet supporting portion 14 positioned rightward of the center reference P0, as shown in FIGS. 37 and 38. In contrast, the second slit 424 is formed on the left side wall 140C at the sheet supporting portion 14 positioned leftward of the center reference P0 (see FIG. 38). In the same manner as the first slit 423, the second slit 424 communicates with the negative pressure chamber 22 formed in such a manner as to correspond to the sheet supporting portion 14. Therefore, air outward of the sheet supporting portion 14 can be sucked into the negative pressure chamber under the negative pressure applied to the negative pressure chamber 22 by the negative pressure generator 19.

With the above-described configuration, the ink mist generated during the marginless printing at the left and right ends 2*c* and 2*d* of the sheet 2 is speedily sucked through the second slit 424 positioned near the left and right ends 2*c* and 2*d* of the sheet 2, as indicated by an arrow G in FIG. 38, to be sent to the negative pressure chamber 22. In this manner, it is possible to reduce the ink mist contacting with the reverse of the sheet 2, so as to alleviate a smear on the reverse of the sheet 2 with the ink mist. Additionally, it is possible to reduce a period of time at which the ink mist floats inside of the printing apparatus 1, so as to suppress contamination inside of the printing apparatus 1.

Although the second slit 424 is formed on the side wall near the left and right ends 2*c* and 2*d* of the sheet 2 out of the left and right side walls 140C and 140D of the sheet supporting portion 14, another slit may be formed on the other side wall. Here, in the case of the adoption of not the center reference but one-side reference, a slit is simply required to be formed on a side wall remoter than at least the reference out of the right and left side walls of the sheet supporting portion 14.

Subsequently, a description will be given in more detail of the configuration of each of the first slit 423 and the second slit 424. FIG. 39 is an enlarged vertical side view showing the sheet supporting portion 14, and shows the configuration of the second slit 424 formed at the sheet support 14. In the following description, the second slit 424 formed on the left side wall 140C of the sheet supporting portion 14 is described with reference to FIG. 39. Both of the second list 424 formed on the right side wall 140D and the first slit 423 formed on the downstream side wall 140A have the same configuration. Therefore, duplicated explanation on the slit 424 will be omitted. At the platen 9, a substantially horizontal step 141 is formed on the left side wall 140C of the sheet supporting portion 14, and furthermore, a side face 142 rising up from the step 141 is formed. The second slit 424 is formed between the step 141 and the side face 142 in the sheet conveyance direction (i.e., the Y direction). Both of the side wall 140C and the side face 142 of the sheet supporting portion 14 are formed in such a manner as to extend in a substantially vertical direction.

The second slit 424 is formed by forming the step 141 on the side wall 140C extending in the substantially vertical direction. In contrast, a side wall may be inclined, and then, a slit may be formed on the inclined side wall. However, in this case, the inclination increases a distance in the sheet widthwise direction, and furthermore, an interval between adjacent sheet supporting portions 14 is required to be increased in a case where a capacity similar to that in the present embodiment is provided for an ink receiving groove, so that a sheet is liable to fall between the adjacent sheet supporting portions. As a consequence, a distance between a printhead and a sheet (i.e., a distance to a sheet) may be unfavorably varied, thereby inducing misalignment of the landing position of ink ejected by the printhead, so as to degrade an image. In addition, the sheet is brought into contact with an ink absorber 35 according to how much the sheet falls, thereby raising a fear of a smear on the sheet. Moreover, the ink absorber 35 is required to be formed in a non-uniform thickness according to the inclination of the side wall on which the slit is formed, thereby making it difficult to fabricate the ink absorber. In contrast, since the side wall 140C is formed in the substantially vertical direction in the present embodiment, the interval between the adjacent sheet supporting portions 14 can be suppressed to a required minimum interval. Consequently, it is possible to avoid the sheet from falling in the ink discarding groove or waste ink from adhering to the reverse of the sheet. Furthermore, the ink absorber 35 is simply required to be formed in a uniform thickness, thereby facilitating fabrication.

Figure 40:
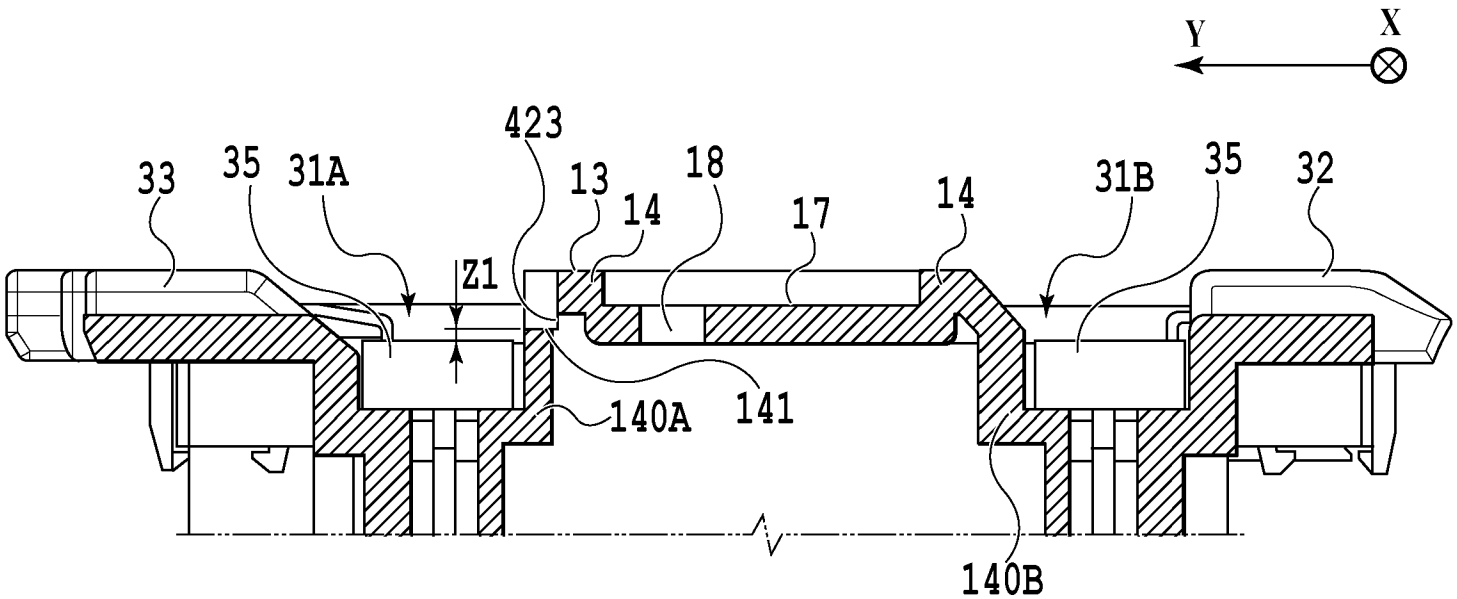
FIG. 40 is another enlarged vertical side view partly showing the platen in the third embodiment.

FIG. 40 is an enlarged vertical side view partly showing the platen 9 shown in FIG. 36, and shows the positional relationship between the first slit 423 and the ink absorber 35. The opening of the first slit 423 is formed at the downstream ink receiving groove 31A at a position higher by a clearance Z1 than the ink absorber 35 in the vertical direction (i.e., near the printhead 3). With this positional relationship, even in a case where the ink absorber 35 is filled with waste ink, it is possible to avoid the waste ink from flowing into the first slit 423 via the side wall 140A adjoining the leading end ink discarding groove 31A or the step 141. Thus, it is possible to suppress clogging of the slit 423 or degradation of suction performance caused by the inflow of the waste ink. The positional relationship between the second slit 424 formed on each of the left and right side walls 140C and 140D and the ink absorber 35 is determined in the same manner as the positional relationship between the ink absorber 35 and the opening of the first slit 423 in the vertical direction.

In a case where the positional relationship between the opening of the first slit 423 and the ink absorber 35 in the vertical direction is reversed, the waste ink accumulated on the ink absorber 35 is liable to flow into the first slit 423. In a case where the waste ink flows into the first slit 423, the ink is thickened or solidified, thereby raising a fear of clogging in the slit. In a case where the slit is clogged, floating ink cannot be sucked, and therefore, the floating ink is sucked to the suction hole 18, thereby possibly smearing the reverse of the sheet.

Alternatively, in a case where the distance between the printhead 3 and the ink absorber 35 is shortened, the ink ejected to the ink absorber 35 splashes, and then, the ink possibly lands on the reverse of the sheet 2 before the ink is sucked into each of the slits 423 and 424. The above-described problem can be solved by disposing the ink absorber 35 downward of the slits 423 and 424 to keep a predetermined distance from the printhead 3 in the present embodiment. Moreover, in a case where the ink absorber 35 is incorporated in the ink discarding groove, the ink absorber 35 can be incorporated while visually comparing the positions of the end of the ink absorber 35 and the step 141 with each other. As a consequence, the step 141 is effective in preventing erroneous incorporation.

Incidentally, the platen 9 is molded with a resin into a single component part. All of the sheet supporting portion 14, the upstream sheet supporting portion 32, the downstream sheet supporting portion 33, the plurality of the negative pressure chambers 22, the plurality of ink receivers (i.e., the first to third ink receivers) are aggregated into a single resin-molded component part that constitutes the platen 9. In this manner, it is possible to simplify the fabrication of the printing apparatus, and furthermore, to enhance the accuracy of relative positions among functional component parts.

(Variation of Third Embodiment)

Next, a variation in the third embodiment according to the present invention will be explained with reference to FIGS. 41 and 42. In the third embodiment, the step 141 is formed on the side wall 140D formed at the sheet supporting portion 14 in the vertical direction, and furthermore, the side face 142 rising from the step 141 in the substantially vertical direction is formed to define the slit for absorbing the ink between the step 141 and the side face 142. In contrast, in this variation, there are formed a first slit 423 and a second slit 424 that penetrate side walls 140A and 140D formed at the sheet supporting portion 14 in the substantially vertical direction and communicate with the negative pressure chamber 22 (see FIG. 42).

Figure 41:
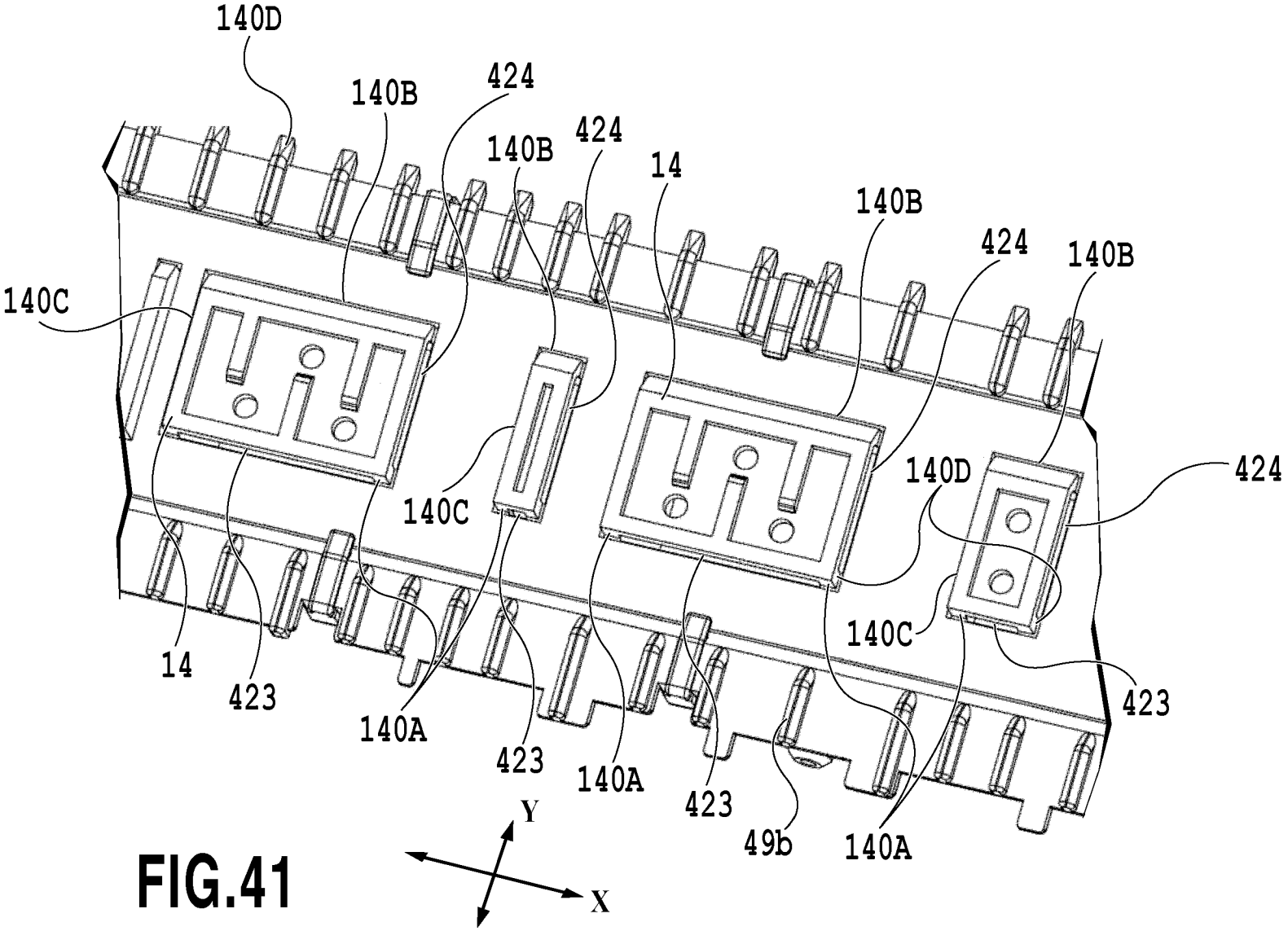
FIG. 41 is an enlarged perspective view partly showing a platen in a variation of the third embodiment.
Figure 42:
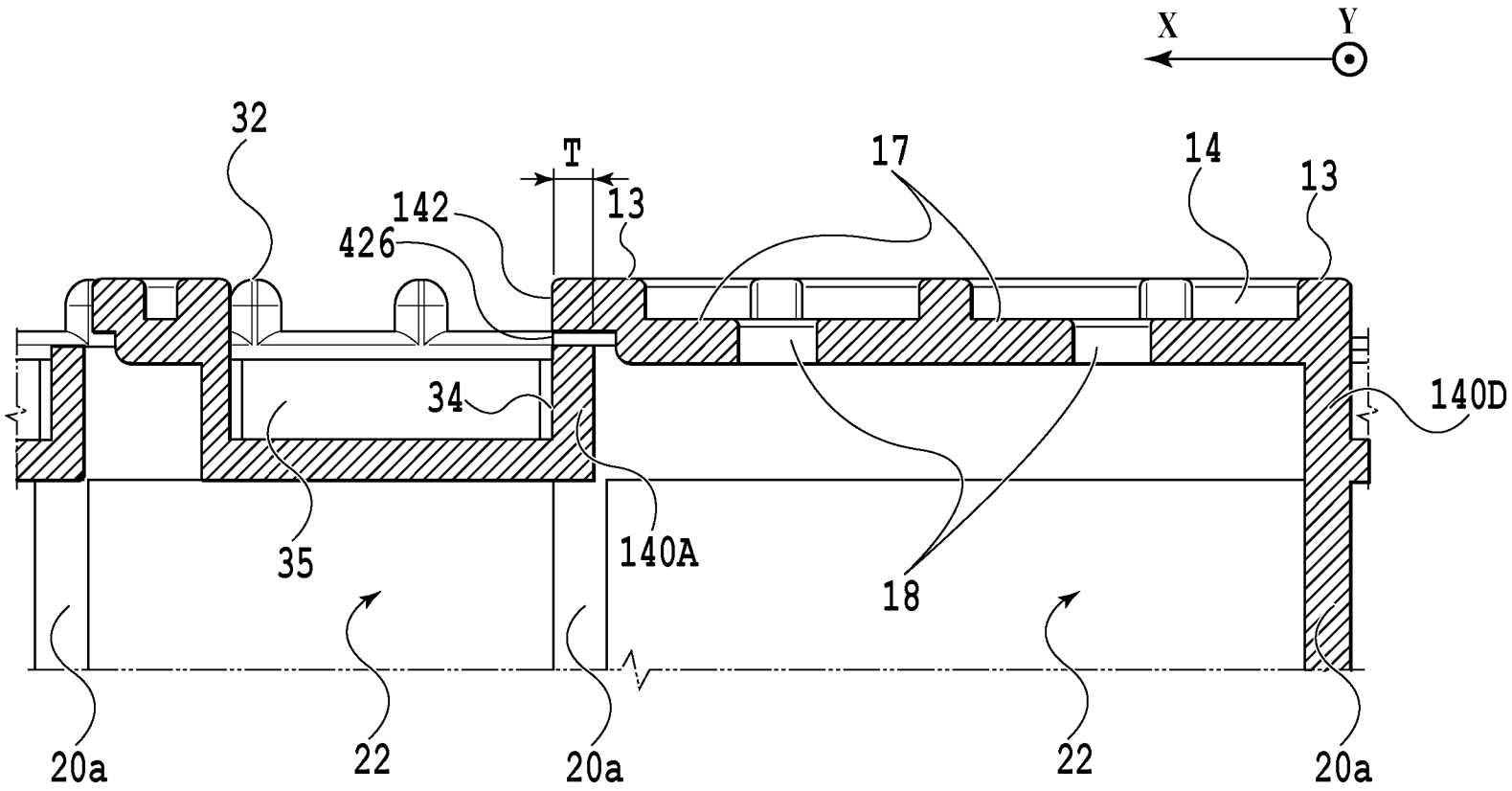
FIG. 42 is another enlarged vertical side view partly showing the platen in the variation of the third embodiment.

Although FIG. 41 shows cases where the first slit 423 is formed on the upstream side wall 140A whereas the second slit 424 is formed on the right side wall 140D, the first and second slits (See, for example, FIG. 42, 426) may be formed on the other side walls 140B and 140C. In addition, the openings of the slits 426 are formed at a position higher than the ink absorber 35 (i.e., a position near the printhead 3) in order to avoid the waste ink from flowing into the slit 425 (see FIG. 42). The other configuration is identical to that in the third embodiment.

As described above, neither a step nor a side wall is formed on the side wall of the sheet supporting portion 14 in the variation. As a consequence, in comparison with the third embodiment, the interval between the adjacent sheet supporting portions 14 is decreased by a distance T, and furthermore, the area of the sheet supporting surface 13 can be increased. Thus, it is possible to more stably support the sheet 2.

As described above by way of the embodiments, the formation of the slit on any side walls formed on the sheet supporting portion 14 is effective in sucking the ink mist. However, not forming any slit on the side wall formed upstream in the sheet conveyance direction may be more effective in preventing the adhesion of the ink to the reverse of the sheet. Specifically, the upstream side wall is upward inclined from downstream to upstream, thereby forming an inclined face. The inclined face may function as a guide face for smoothly moving the leading end of the sheet toward the sheet supporting surface. In this case, in a case where a slit is formed on the upstream side wall, the slit possibly prevents the smooth movement of the sheet. Moreover, in a case where a slit is formed on the upstream side wall, the ink mist may adhere onto the upstream side wall during the suction into the slit, and accordingly, the reverse of the sheet to be guided on the side wall may be possibly smeared with the ink. For the above-described reasons, it may be undesirable to form a slit on the upstream side wall.

In the above-described embodiments, the four-side marginless printing can be performed with respect to a cut sheet. Thus, it is possible to securely perform the marginless printing, and furthermore, to suppress the smear on the reverse of the sheet with the ink mist generated in a case where the ink is ejected to the outside of the end of the sheet.

While the present invention has been described with reference to exemplary embodiments, it is to be understood that the invention is not limited to the disclosed exemplary embodiments. The scope of the following claims is to be accorded the broadest interpretation so as to encompass all such variations and equivalent structures and functions.

What is claimed is:

1. A printing apparatus comprising:

a printhead configured to eject ink;

a sheet conveying unit configured to convey a sheet in a first direction; and a platen configured to support the sheet at a position opposite to the printhead, wherein the platen comprises:

a supporting portion configured to support the sheet, the supporting portion having contact portions contacting the sheet and a recess which is surrounded by the contact portions and is provided with a first suction hole;

a first ink groove configured to receive ink ejected from the printhead, the first ink groove extending in a second direction crossing the first direction and being disposed downstream of the supporting portion with respect to the first direction;

a second ink groove configured to receive ink ejected from the printhead, the second ink groove extending in the second direction and being disposed upstream of the supporting portion with respect to the first direction; and a second suction hole disposed between the first ink groove and the supporting portion.

2. The printing apparatus according to claim 1, wherein the second suction hole has a slit shape.

3. The printing apparatus according to claim 1, wherein an ink absorber having an ink receiving surface is embedded on the platen at a position lower than a position at which the supporting portion supports the sheet, and the second suction hole is formed at a position higher than the ink receiving surface.

4. The printing apparatus according to claim 1, wherein the contact portions include an upstream contact portion disposed upstream with respect to the first direction and extending in the second direction, a downstream contact portion disposed downstream of the upstream contact portion with respect to the first direction and extending in the second direction, and a side contact portion extending in the first direction and connecting the upstream contact portion and the downstream contact portion, and wherein the second suction hole is provided with the downstream contact portion.

5. The printing apparatus according to claim 4, wherein the platen further comprising a third suction hole which is provided with the side contact portion.

6. The printing apparatus according to claim 5, wherein the third suction hole has a slit shape.

7. The printing apparatus according to claim 5, wherein an ink absorber having an ink receiving surface is embedded on the platen at a position lower than a position at which the supporting portion supports the sheet, and the second suction hole and the third suction hole are formed at a position higher than the ink receiving surface.

* * * * *